US007980627B2

(12) United States Patent
Arias et al.

(10) Patent No.: US 7,980,627 B2
(45) Date of Patent: Jul. 19, 2011

(54) PORTABLE TABLE ASSEMBLIES

(75) Inventors: David A. Arias, Virginia Beach, VA (US); Kevin O'Doherty, Tseung Kwan O (HK); Sai Kei Wong, Sai Ying Pun (HK); Chak Por Lee, Kowloon (HK)

(73) Assignee: Swimways Corporation, Virginia Beach, VA (US)

( * ) Notice: Subject to any disclaimer, the term of this patent is extended or adjusted under 35 U.S.C. 154(b) by 0 days.

(21) Appl. No.: 12/719,538

(22) Filed: Mar. 8, 2010

(65) Prior Publication Data

US 2010/0164257 A1 Jul. 1, 2010

Related U.S. Application Data

(63) Continuation of application No. 11/832,980, filed on Aug. 2, 2007, now Pat. No. 7,681,946.

(60) Provisional application No. 60/835,190, filed on Aug. 3, 2006.

(51) Int. Cl.
*A47B 3/00* (2006.01)
*A47B 3/14* (2006.01)
*A47B 83/02* (2006.01)

(52) U.S. Cl. ..... 297/158.4; 297/157.1; 297/158.3; 297/159.1

(58) Field of Classification Search ..... 297/139, 297/140, 141, 142, 143, 157.1, 158.3, 158.4, 297/158.5, 159.1; 108/72
See application file for complete search history.

(56) References Cited

U.S. PATENT DOCUMENTS

| | | | | |
|---|---|---|---|---|
| 159,737 | A | 2/1875 | York | |
| 379,670 | A | 3/1888 | Whitehead | |
| 547,778 | A | 10/1895 | Frantz | |
| 703,077 | A | 6/1902 | Nivison | |
| 982,302 | A | 1/1911 | Roncaglia | |
| 1,422,319 | A | 7/1922 | Stoll | |
| 1,514,418 | A | 11/1924 | Battenfeld | |
| 1,608,924 | A | 11/1926 | Brown | |
| 1,659,840 | A | 2/1928 | Smith | |
| 1,716,612 | A | 6/1929 | Lee | |
| 1,736,531 | A * | 11/1929 | Hodinka | 297/55 |
| 1,934,937 | A | 11/1933 | Macdonald | |
| 2,217,576 | A | 10/1940 | Weber | |
| 2,436,730 | A | 2/1948 | Repke | |
| 2,457,411 | A | 12/1948 | Steinberger | |
| 2,548,682 | A | 4/1951 | Price | |
| 2,583,247 | A | 1/1952 | Aja et al. | |

(Continued)

OTHER PUBLICATIONS

International Search Report and Written Opinion for PCT/US07/75160, mailed Aug. 26, 2008.

*Primary Examiner* — David Dunn
*Assistant Examiner* — Philip Gabler
(74) *Attorney, Agent, or Firm* — Cooley LLP

(57) ABSTRACT

An apparatus includes a table and a bench movably coupled to the table. The table and the bench collectively have a first configuration and a second configuration. The table has a first width when the table and the bench are in the first configuration. The table and the bench collectively have a first height when the table and the bench are in the first configuration. The table and the bench collectively have a second width and a second height when the table and the bench are in the second configuration. The second width is less than half of the first width, and the second height is less than half of the first width.

20 Claims, 33 Drawing Sheets

U.S. PATENT DOCUMENTS 2,647,562 A 8/1953 Hoffar
2,691,410 A 10/1954 Boucher
2,831,739 A 4/1958 Fryckholm
2,837,141 A 6/1958 Shore
2,842,185 A 7/1958 Fortine
2,983,308 A 5/1961 Horowitz
2,991,829 A 7/1961 Post
3,141,424 A 7/1964 Seymour
3,731,971 A 5/1973 Sjogren
3,788,696 A * 1/1974 Loewen ..... 297/158.4
3,885,829 A 5/1975 Haeger
3,994,527 A * 11/1976 Nikitits et al. ..... 297/158.4
4,052,100 A 10/1977 Nikitits et al.
4,131,311 A 12/1978 Nikitits et al.
4,191,111 A 3/1980 Emmert
4,223,945 A 9/1980 Nikitits
4,245,849 A 1/1981 Thiboutot
4,249,773 A 2/1981 Giambalvo
4,341,164 A 7/1982 Johnson
4,415,199 A 11/1983 Wright
4,595,232 A 6/1986 Glenn et al.
4,625,656 A 12/1986 Brickman
4,653,804 A 3/1987 Yoo et al.
4,801,176 A 1/1989 Wolberg
4,826,244 A 5/1989 Choi
4,848,243 A 7/1989 Giordano
4,883,314 A 11/1989 Sakong
5,018,785 A 5/1991 Monson et al.
5,251,955 A 10/1993 Sarafa
5,314,231 A 5/1994 Otterbacher
5,352,015 A 10/1994 Morgan
5,676,419 A 10/1997 Kassai
5,683,135 A 11/1997 Williams
5,709,428 A 1/1998 Hugghins
5,803,536 A 9/1998 Perzee et al.
6,010,186 A * 1/2000 Tsay ..... 297/159.1
6,113,202 A 9/2000 Germano
6,347,831 B1 2/2002 Nye et al.
6,386,119 B1 5/2002 Lin
D463,919 S 10/2002 Lee
6,634,304 B2 10/2003 Wang
6,772,699 B1 8/2004 Elliott
6,792,880 B2 9/2004 Tsai
6,814,403 B2 11/2004 Zheng
6,883,864 B2 4/2005 Gregory
6,955,396 B2 10/2005 Moon et al.
6,997,111 B2 * 2/2006 Giegerich ..... 108/25
7,011,364 B2 3/2006 Meskill et al.
2004/0227382 A1 * 11/2004 Lin ..... 297/158.4
2005/0099054 A1 5/2005 McCarthy et al.
2008/0178776 A1 7/2008 Arias et al.
2009/0140556 A1 6/2009 Degelman et al.

* cited by examiner

PORTABLE TABLE ASSEMBLIES

CROSS-REFERENCE TO RELATED APPLICATIONS

This application is a continuation of U.S. patent application Ser. No. 11/832,980, entitled, "Portable Table Assemblies," filed on Aug. 2, 2007 now U.S. Pat. No. 7,681,946, which claims priority to U.S. Provisional Application Ser. No. 60/835,190, entitled "Portable Table Assemblies," filed Aug. 3, 2006, each of which are incorporated herein by reference in its entirety.

BACKGROUND

The invention relates generally to portable furniture, and more particularly to a portable table assembly having an expanded configuration and a collapsed configuration.

Table assemblies are used both outdoors and/or indoors to provide both temporary and/or permanent seating for a variety of events. For example, some known arrangements, such as picnic tables typically include a table surface coupled to two bench-style seating surfaces. Some known picnic tables are configured to be disassembled and/or folded when not in use to allow for more convenient storage and transportation of the picnic table. For example, some known picnic tables include a seating portion removably coupled to a table such that the seating portion can be removed when the picnic table is not in use. Other known picnic tables include a seating portion and/or table legs that can be folded such that the picnic table can be folded into a long, flat configuration for storage.

Such known picnic tables, however, remain bulky even when in their folded and/or disassembled configurations. Moreover, when disassembling such known picnic tables, parts, such as fasteners and structural components, can be easily misplaced.

Thus, a need exists for a picnic table that has an expanded configuration and a collapsed configuration, in which the picnic table can be more easily stored and transported.

SUMMARY

Portable table assemblies are described herein. In some embodiments, an apparatus includes a table and a bench movably coupled to the table. The table and the bench collectively have a first configuration and a second configuration. The table has a first width when the table and the bench are in the first configuration. The table and the bench collectively have a first height when the table and the bench are in the first configuration. The table and the bench collectively have a second width and a second height when the table and the bench are in the second configuration. The second width is less than half of the first width, and the second height is less than half of the first width.

DETAILED DESCRIPTION

Figure 1:
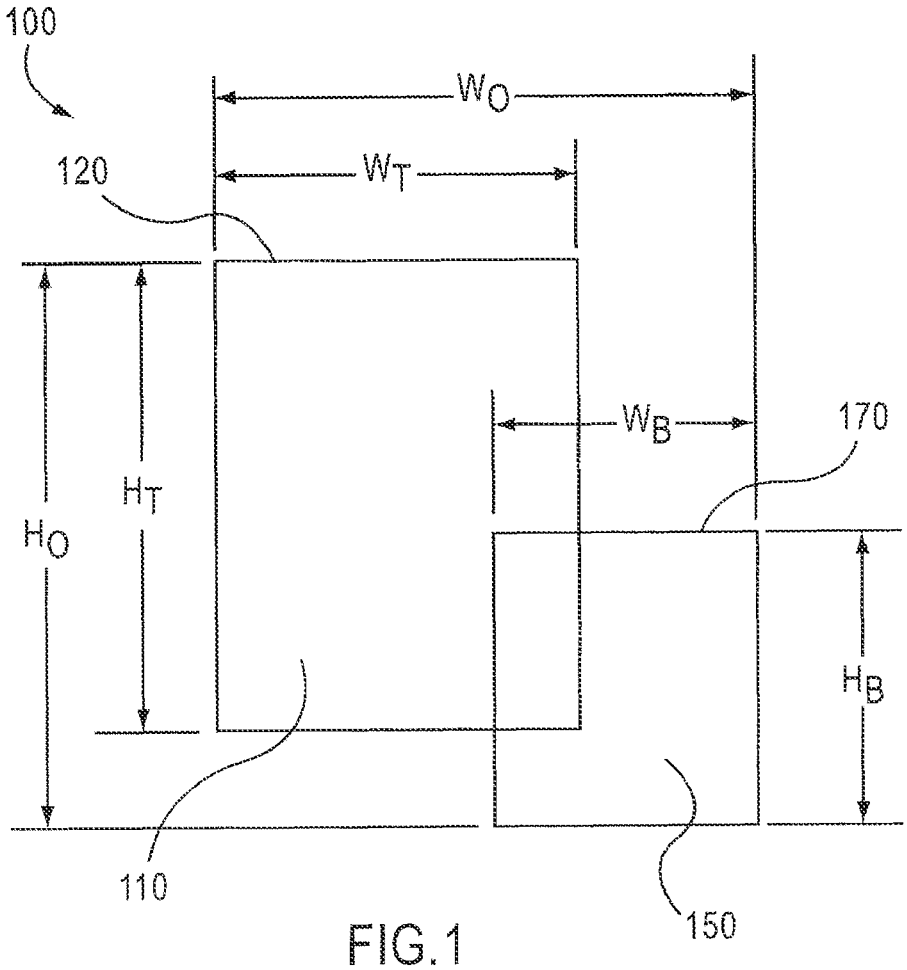
FIGS. 1 and 2 are schematic illustrations showing a front view of a table assembly according to an embodiment of the invention in a first configuration and a second configuration, respectively.

Portable table assemblies are described herein. In some embodiments, an apparatus includes a table and a bench movably coupled to the table. The table and the bench collectively have a first configuration and a second configuration. The table has a first width when the table and the bench are in the first configuration. The table and the bench collectively have a first height when the table and the bench are in the first configuration. The table and the bench collectively have a second width and a second height when the table and the bench are in the second configuration. The second width is less than half of the first width, and the second height is less than half of the first width.

In some embodiments, an apparatus includes a table and a bench coupled to the table. The table includes a frame defining a table top plane. The frame has a longitudinal side member and a lateral side member movably coupled to the longitudinal side member. The table has a first configuration and a second configuration different than the first configuration. The lateral side member is configured to rotate about an axis substantially normal to the table top plane when the table is moved between the first configuration and the second configuration.

In some embodiments, an apparatus includes a table and a bench coupled to the table. The bench includes a first bench support member, a second bench support and a bench seat. The first bench support member is pivotably coupled to the second bench support member. The first bench support member is coupled to the bench seat and is configured to engage a support surface, such as, for example, the ground. The second bench support member is coupled to the bench seat and is also configured to engage the support surface. The bench has a first configuration and a second configuration different than the first configuration. The first bench support member is non-parallel to the second bench support member when the bench is in the first configuration. The first bench support member is substantially parallel to the second bench support member when the bench is in the second configuration.

In some embodiments, an apparatus includes a table and a bench coupled to the table. The table includes a first longitudinal side member, a second longitudinal side member, and a table top configured to be coupled to the first longitudinal side member and the second longitudinal side member. The bench includes a first bench side member, a second bench side member, and a bench seat coupled to the first bench side member and the second bench side member. The table and the bench collectively have a first configuration and a second configuration. The second longitudinal side member is spaced apart from the first longitudinal side member by a first distance when the table and the bench are in the first configuration. The second longitudinal side member is spaced apart from the first longitudinal side member by a second distance less than the first distance when the table and the bench are in the second configuration. The second bench side member is spaced apart from the first bench side member by a third distance when the table and the bench are in the first configuration. The second bench side member is spaced apart from the first bench side member by a fourth distance less than the third distance when the table and the bench are in the second configuration.

In some embodiments, an apparatus includes a table and a bench configured to be coupled to the table. The table has a frame portion and a top surface portion configured to be coupled to the frame portion. The top surface portion can be constructed from, for example, a flexible material. The frame portion has a lateral side member and a longitudinal side member pivotably connected to the lateral side member. A central portion of the lateral side member is configured to pivot about an axis substantially normal to the top surface portion such that the table can be an moved between a first configuration and a second configuration.

In some embodiments, an apparatus includes a table and a bench configured to be coupled to the table. The bench has a bench frame portion, a bench surface, a first bench support member coupled to the bench frame portion and a second bench support member coupled to the bench frame portion. A portion of the first bench support member is being configured to engage a support surface, such as, for example, the ground. The second bench support member is pivotably coupled to the first bench support member. The bench has a first configuration, in which the first bench support member is angularly offset from the second bench support member, and a second configuration, in which the first bench support member is substantially parallel to the second bench support member.

In some embodiments, an apparatus includes a table and a bench configured to be slidably coupled to the table. The bench has a bench frame portion, a bench surface, a first bench support member coupled to the bench frame portion and a second bench support member coupled to the bench frame portion and pivotably coupled to the first bench support member. The bench has a first configuration, in which the first bench support member is angularly offset from the second bench support member and the first bench support member is normal to a longitudinal axis of the bench frame portion, and a second configuration, in which the first bench support member is substantially parallel to the second bench support member and the first bench support member is substantially parallel to the longitudinal axis of the bench frame portion The term "parallel" or is used herein to describe a relationship between two structural members (e.g., a table frame member, a bench support member or the like) and/or the geometric constructions defined by two structural members (e.g., a longitudinal axis, a lateral axis, a planar surface or the like) in which the two structural members and/or the two geometric constructions are substantially non-intersecting as they extend substantially to infinity. For example, as used herein in the context of geometrical constructions, when a planar surface (i.e., a two-dimensional surface) is said to be parallel to a line (e.g., a longitudinal axis), every point along the line is spaced apart from the nearest portion of the planar surface by a substantially equal distance. Similarly, as used herein in the context of two structural members, a first structural member (e.g., a frame member of a table) is said to be parallel to a second structural member when a longitudinal axis of the first structural member and a longitudinal axis of the second structural member do not intersect if they were extended to infinity. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances or the like.

The term "normal" is used herein to describe a relationship between two structural members (e.g., a table frame member, a bench support member or the like) and/or the geometric constructions defined by two structural members (e.g., a longitudinal axis, a lateral axis, a planar surface or the like) in which the two structural members and/or the two geometric constructions intersect at an angle of approximately 90 degrees within at least one plane. For example, as used herein in the context of two structural members, a first structural member is said to be normal to a second structural member when a longitudinal axis of the first structural member and a longitudinal axis of the second structural member intersect at an angle of approximately 90 degrees within at a plane.

The term "member" as used herein can refer to either a single item or multiple items that cooperatively perform a function. For example, as used herein, a "side member" can include a single component or can be constructed from multiple components coupled together. More particularly, when a side member includes a single component, the single component can be, for example, a single rod monolithically constructed from a single material or a single rod constructed from multiple different materials (e.g., a composite rod). When a side member is constructed from multiple components, such multiple components can include, for example, multiple rods, hinges, joining members, connecting members, or the like.

The term "side member" can be used herein to describe any structural member of a table assembly, regardless of whether the "side member" is located adjacent and/or parallel to a side of a component (e.g., a table top). For example, as used herein, a side member can be a structural member that is disposed apart from and non-parallel to a side of a component. Similarly, as used herein, a "longitudinal side member" need not be disposed length-wise relative to a component, but can be disposed in any orientation and/or location relative to the component.

Figure 2:
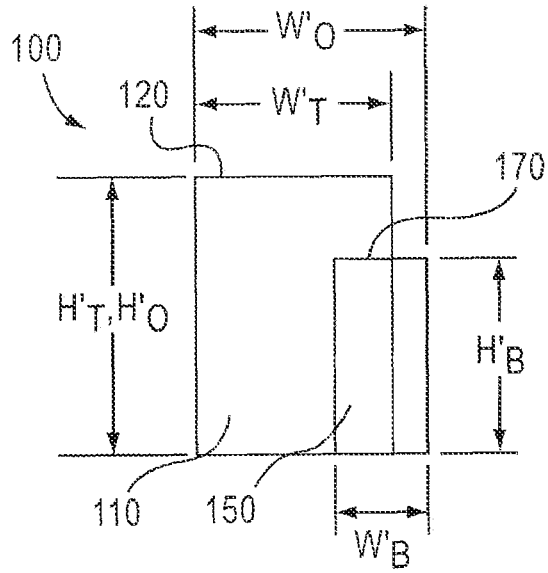

FIGS. 1 and 2 are schematic illustrations showing a front view (i.e., an end view) of a table assembly 100 according to an embodiment of the invention in a first configuration and a second configuration, respectively. The table assembly 100 includes a table 110 and a bench 150 coupled to the table 110. In some embodiments, the table 110 can include a table top 120. Similarly, in some embodiments, the bench can include a bench seat 170. Although only one bench 150 is shown in FIGS. 1 and 2, other embodiments can have at least two benches.

When the table assembly 100 is in the first configuration, as shown in FIG. 1, the table assembly 100 has an overall width $W_O$ and an overall height $H_O$. When the table assembly 100 is in the first configuration, the table 110 has a width $W_T$ and a height $H_T$. Similarly, when the table assembly 100 is in the first configuration, the bench 150 has a width $W_B$ and a height $H_B$. As shown, in some embodiments, when the table assembly 100 is in the first configuration, a portion of the bench 150 can overlap a portion of the table 110 (e.g., from a top view a portion of the bench is disposed under a portion of the table). Said another way, in some embodiments, the overall width $W_O$ of the table assembly 100 can be less than the sum of the width $W_T$ of the table 110 and/or the width $W_B$ of the bench 150, and the overall height $H_O$ of the table assembly 100 can be less than the sum of the height $H_T$ of the table 110 and the height $H_B$ of the bench 150. In other embodiments, however, the overall width $W_O$ of the table assembly 100 can be equal to the sum of the width $W_T$ of the table 110 and the width $W_B$ of the bench 150 and/or the overall height $H_O$ of the table assembly 100 can be equal to the sum of the height $H_T$ of the table 110 and the height $H_B$ of the bench 150.

When the table assembly 100 is in the second configuration, as shown in FIG. 2, the table assembly 100 has an overall width $W'_O$ that is less than half the width $W_T$ of the table 110 when the table assembly 100 is in the first configuration. In some embodiments, for example, the overall width $W'_O$ can be less than one quarter the width $W_T$ of the table 110 when the table assembly 100 is in the first configuration. Similarly, the table assembly 100 has an overall height $H'_O$ that is less than half the width $W_T$ of the table 110 when the table assembly 100 is in the first configuration. In some embodiments, for example, the overall height $H'_O$ can be less than one quarter the width $W_T$ of the table 110 when the table assembly 100 is in the first configuration.

Although the width $W'_B$ of the bench 150 when the table assembly 100 is in the second configuration is shown as being less than the width $W_B$ of the bench 150 when the table assembly 100 is in the first configuration, in some embodiments, the width $W'_B$ can be equal to or greater than the width $W_B$. For example, in some embodiments, a portion of the reduction in the overall width $W_O$ of the table assembly 100 when the table assembly 100 is moved from the first configuration to the second configuration, can be achieved by moving the bench 150 relative to the table 110 without changing the width $W_B$ of the bench. Said another way, in some embodiments, a portion of the reduction in the overall width $W_O$ of the table assembly 100 when the table assembly 100 is moved from the first configuration to the second configuration can be achieved by moving the bench 150 into alignment with the table 110. In some embodiments, for example, the bench 150 can be moved relative to the table 110 when the table assembly 100 is moved from the first configuration to the second configuration such that the overall width $W'_O$ of the table assembly 100 is equal to the width $W'_T$ of the table 110.

Although the height $H'_B$ of the bench 150 when the table assembly 100 is in the second configuration is shown as being less than the height $H_B$ of the bench 150 when the table assembly 100 is in the first configuration, in some embodiments, the height $H'_B$ can be equal to or greater than the height $H_B$. Similarly, although the height $H'_T$ of the table 110 when the table assembly 100 is in the second configuration is shown as being less than the height $H_T$ of the table 110 when the table assembly 100 is in the first configuration, in some embodiments, the height $H'_T$ can be equal to or greater than the height $H_T$. For example, in some embodiments, a portion of the reduction in the overall height $H_O$ of the table assembly 100 when the table assembly 100 is moved from the first configuration to the second configuration can be achieved by moving the bench 150 relative to the table 110 without changing the height $H_B$ of the bench and/or the height $H_T$ of the table 110. Said another way, in some embodiments, a portion of the reduction in the overall height $H_O$ of the table assembly 100 when the table assembly 100 is moved from the first configuration to the second configuration, can be achieved by moving the bench 150 into alignment with the table 110.

Although the overall height $H'_O$ of the table assembly 100 when the table assembly 100 is in the second configuration is described in relation to the width $W_T$ of the table 110 when the table assembly 100 is in the first configuration, in some embodiments, the overall height $H'_O$ of the table assembly 100 when the table assembly 100 is in the second configuration can be less than half the overall height $H_O$ of the table assembly 100 when the table assembly 100 is in the first configuration. In yet other embodiments, the overall height $H'_O$ of the table assembly 100 when the table assembly 100 is in the second configuration can be less than one quarter of the overall height $H_O$ of the table assembly 100 when the table assembly 100 is in the first configuration.

Figure 3:
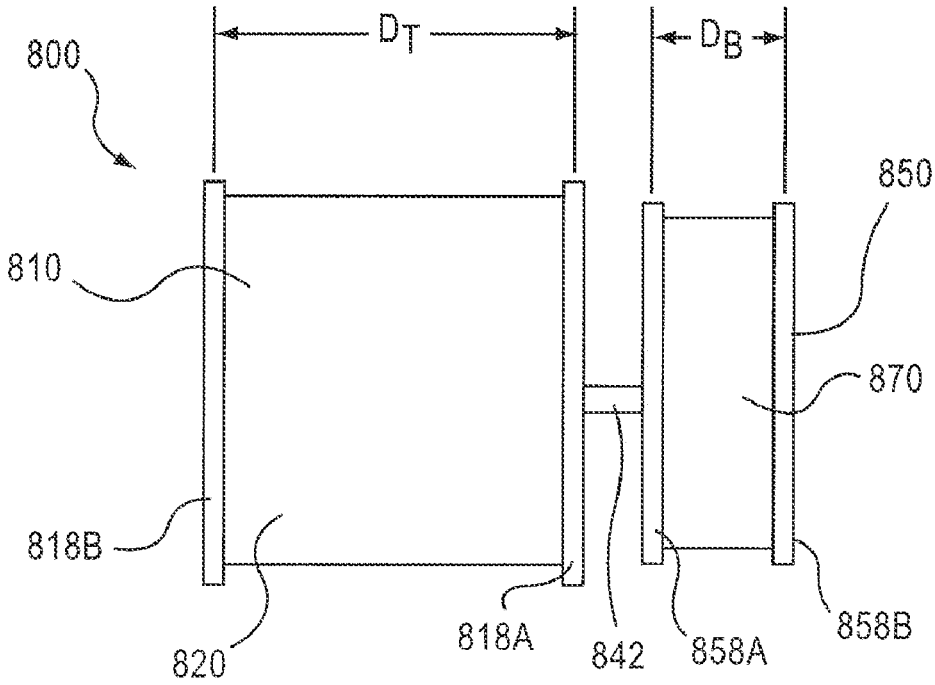
FIGS. 3 and 4 are schematic illustrations showing a top view of a table assembly according to an embodiment of the invention in a first configuration and a second configuration, respectively.
Figure 4:
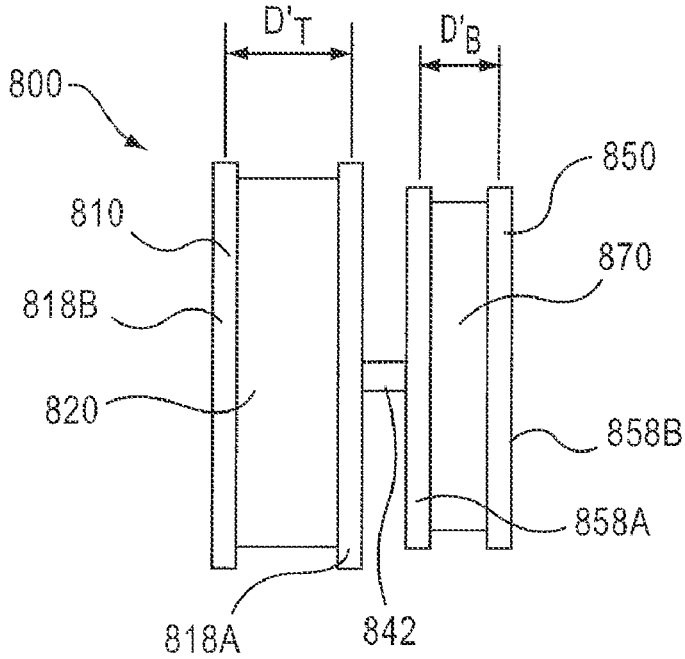
Figure 5:
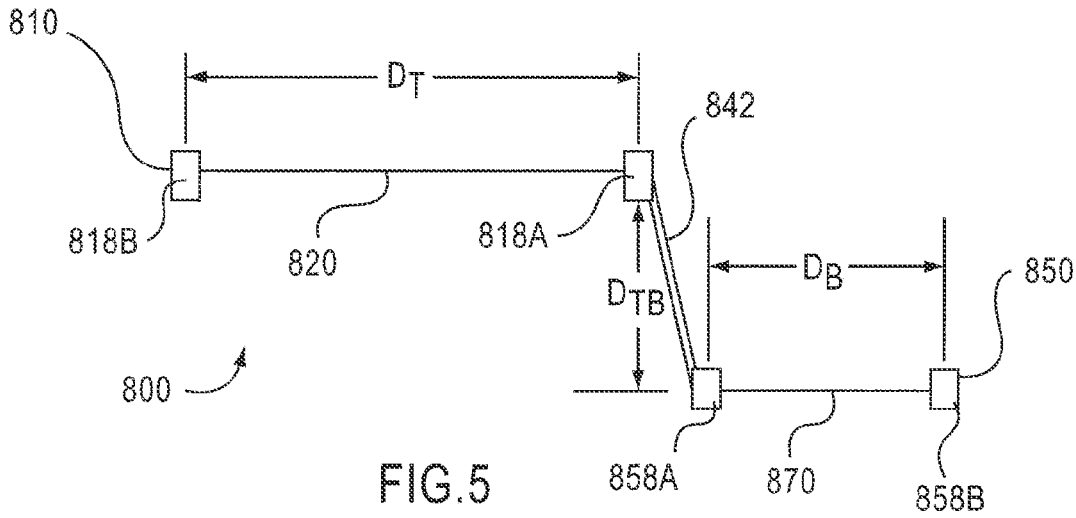
FIGS. 5-7 are schematic illustrations showing a front view of the table assembly shown in FIGS. 3 and 4 in the first configuration, the second configuration and a third configuration, respectively.
Figure 6:
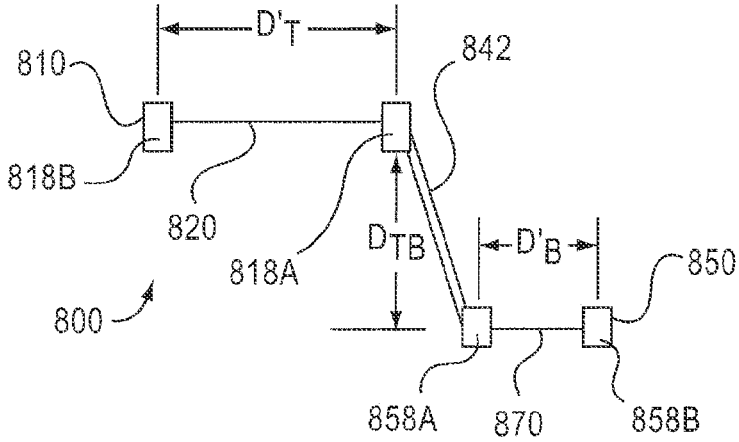
Figure 7:
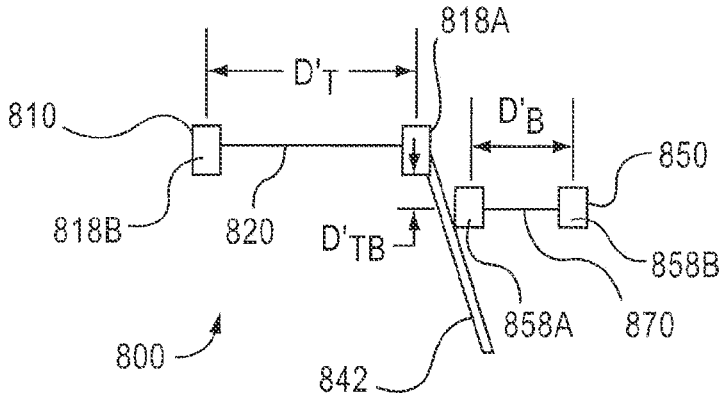

FIGS. 3 and 4 are schematic illustrations showing a top view of a table assembly 800 according to an embodiment of the invention in a first configuration and a second configuration, respectively. FIGS. 5-7 are schematic illustrations showing a front view (i.e., an end view) of the table assembly 800 in the first configuration, the second configuration and a third configuration, respectively. The table assembly 800 includes a table 810 and a bench 850 coupled to the table 810 by a support member 842. The table 810 includes a first longitudinal side member 818A, a second longitudinal side member 818B, and a table top 820. The table top 820 is coupled to the first longitudinal side member 818A and the second longitudinal side member 818B such that when the table assembly 800 is in the first configuration (FIGS. 3 and 5), the table 810 can provide a suitable surface for eating, working or the like. The bench 850 includes a first side member 858A, a second side member 858B and a bench seat 870. The bench seat 870 is coupled to the first side member 858A and the second side member 858B such that when the table assembly 800 is in the first configuration, the bench 850 can provide a suitable surface upon which a person can sit.

When the table assembly 800 is in the first configuration, as shown in FIGS. 3 and 5, the first longitudinal side member 818A is spaced apart from the second longitudinal side member 818B by a distance $D_T$, the first bench side member 858A is spaced apart from the second bench side member 858B by a distance $D_B$, and the first bench side member 858A is spaced apart from the first longitudinal side member 818A by a distance $D_{TB}$ (shown only in FIG. 5). In some embodiments, the distance $D_T$ can be different than the distance $D_B$ and/or the distance $D_{TB}$. In some embodiments, the distance $D_B$ can be different than the distance $D_T$ and/or the distance $D_{TB}$. Although the distance $D_T$ and the distance $D_B$ are shown as being measured in a horizontal direction (i.e., within a plane defined by the table top 820), in some embodiments, the distance $D_T$ and/or the distance $D_B$ can be measured in any suitable direction. For example, in some embodiments, the distance $D_T$ can be measured in a direction that is angularly offset from the horizontal, and the distance $D_B$ can be measured in a direction that is non-parallel to the direction in which the distance $D_T$ is be measured. Similarly, although the distance $D_{TB}$ is shown as being measured in a vertical direction (i.e., within a plane normal to the plane defined by the table top 820), in some embodiments, the distance $D_{TB}$ can be measured in any suitable direction. For example, in some embodiments, the distance $D_{TB}$ can be measured in a direction that is substantially parallel to the support member 842.

When the table assembly 800 is in the second configuration, as shown in FIGS. 4 and 6, the first longitudinal side member 818A is spaced apart from the second longitudinal side member 818B by a distance $D'_T$ less than the distance $D_T$, and the first bench side member 858A is spaced apart from the second bench side member 858B by a distance $D'_B$ less than the distance $D_B$. In this manner, the overall distance between the second longitudinal side member 818B and the second bench side member 858B, which can, for example, represent the width of the table assembly 800, is less when the table assembly 800 is in the second configuration than when the table assembly 800 is in the first configuration. In some embodiments, for example, the distance $D'_T$ can be less than half the distance $D_T$. Similarly, in some embodiments, for example, the distance $D'_B$ can be less than half the distance $D_B$. When the table assembly 800 is in the second configuration, however, the first bench side member 858A remains spaced apart from the first longitudinal side member 818A by the distance $D_{TB}$. Said another way, when the distance between the table top 820 and the bench seat 850, which can, for example, represent a portion of the height of the table assembly 800, can remain unchanged when the table assembly 800 is moved from the first configuration to the second configuration.

When the table assembly 800 is in the third configuration, as shown in FIG. 7, the first bench side member 858A is spaced apart from the first longitudinal side member 818A by a distance $D'_{TB}$ less than the distance $D_{TB}$. In this manner, the distance between the table top 820 and the bench seat 850 is less when the table assembly 800 is in the second configuration than when the table assembly 800 is in the first configuration. In some embodiments, for example, the distance $D'_{TB}$ can be less than half the distance $D_{TB}$.

Although the first longitudinal side member 818A and the second longitudinal side member 818B are shown and described above as being disposed along the length of the table 810, in other embodiments, the first longitudinal side member 818A and/or the second longitudinal side member 818B can be disposed in any orientation relative to the table 810. For example, in some embodiments, the first longitudinal side member 818A and/or the second longitudinal side member 818B can be disposed along the width of the table 810. Similarly, although the first bench side member 858A and the second bench side member 858B are shown and described above as being disposed along the length of the bench 850, in other embodiments, the first bench side member 858A and/or the second bench side member 858B can be disposed in any orientation relative to the bench 850. For example, in some embodiments, the first bench side member 858A and/or the second bench side member 858B can be disposed along the width of the bench 850.

Although the first longitudinal side member 818A is shown as being parallel to the second longitudinal side member 818B, in other embodiments, the first longitudinal side member 818A can be non-parallel to the second longitudinal side member 818B. For example, in some embodiments, the first longitudinal side member 818A can be parallel to the second longitudinal side member 818B when the table assembly 800 is in the first configuration and can be non-parallel to the second longitudinal side member 818B when the table assembly 800 is in the second configuration. Similarly, although the first bench side member 858A is shown as being parallel to the second bench side member 858B, in other embodiments, the first bench side member 858A can be non-parallel to the second bench side member 858B. For example, in some embodiments, the first bench side member 858A can be parallel to the second bench side member 858B when the table assembly 800 is in the first configuration and can be non-parallel to the second bench side member 858B when the table assembly 800 is in the second configuration. Similarly, although the first bench side member 858A is shown as being parallel to the first longitudinal side member 818A, in other embodiments, the first bench side member 858A can be non-parallel to the first longitudinal side member 818A. For example, in some embodiments, the first bench side member 858A can be parallel to the first longitudinal side member 818A when the table assembly 800 is in the first configuration and can be non-parallel to the first longitudinal side member 818A when the table assembly 800 is in the second configuration.

Although the relative orientation of the first longitudinal side member 818A, the second longitudinal side member 818B, the first bench side member 858A, and the second bench side member 858B is shown as being unchanged when the table assembly 800 is moved between the first configuration, second configuration and/or the third configuration, in other embodiments, the relative orientation of the first longitudinal side member 818A, the second longitudinal side member 818B, the first bench side member 858A, and/or the second bench side member 858B can change when the table assembly 800 is moved between the first configuration, second configuration and/or the third configuration. For example, in some embodiments, the first bench side member 858A and/or the second bench side member 858B can be substantially normal to the first longitudinal side member 818A and/or the second longitudinal side member 818B when the table assembly 800 is in the first configuration and substantially parallel to the first longitudinal side member 818A and/or the second longitudinal side member 818B when the table assembly 800 is in the second configuration and/or third configuration. Similarly, in some embodiments, the support member 842 can be substantially normal to the first longitudinal side member 818A and/or the second longitudinal side member 818B when the table assembly 800 is in the first configuration and substantially parallel to the first longitudinal side member 818A and/or the second longitudinal side member 818B when the table assembly 800 is in the second configuration and/or third configuration.

Figure 8:
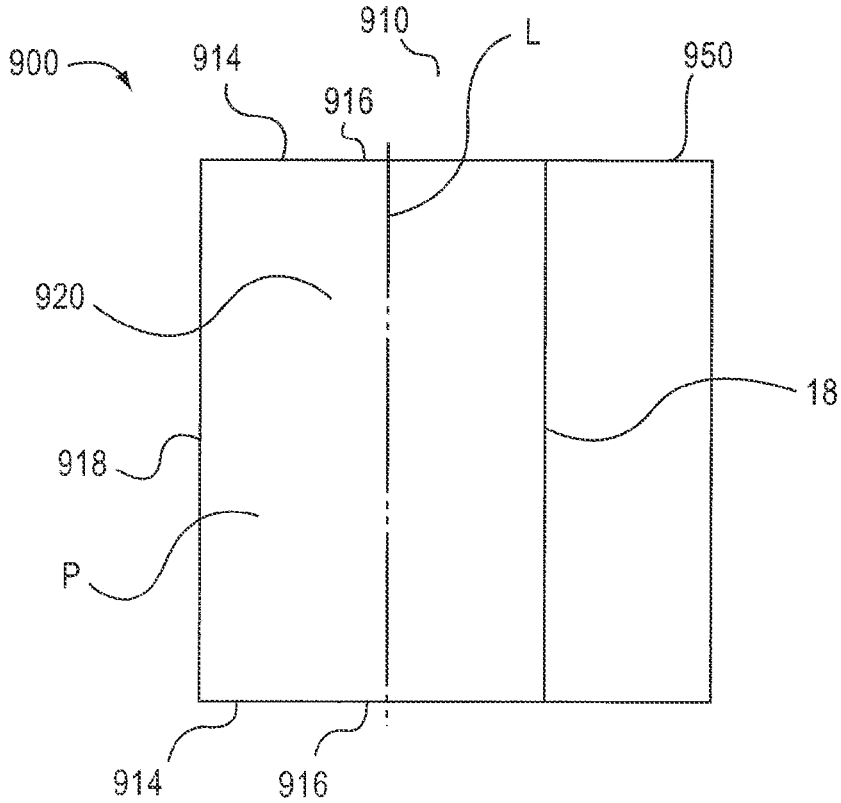
FIGS. 8 and 9 are schematic illustrations showing a top view of a table assembly according to an embodiment of the invention in a first configuration and a second configuration, respectively.
Figure 9:
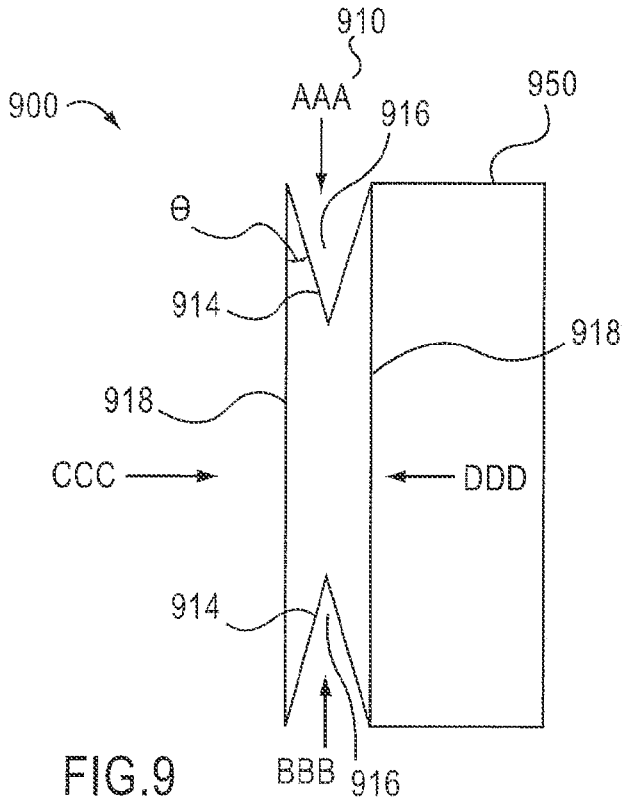

FIGS. 8 and 9 are schematic illustrations showing a top view of a table assembly 900 according to an embodiment of the invention in an expanded configuration and a collapsed configuration, respectively. The table assembly 900 includes a table 910 and a bench 950 coupled to the table 910. The table 910 includes two longitudinal side members 918, two lateral side members 914 and a table top 920 having a longitudinal axis L. The longitudinal side members 918 are substantially parallel to each other and define a table top plane P. The table top 920 is coupled to the longitudinal side member 918 such that the table top 920 is substantially parallel to the table top plane P. Each of the lateral side members 914 has a central portion 916. Although only one bench 950 is shown in FIGS. 8 and 9, other embodiments can have at least two benches.

As shown in FIGS. 8 and 9, the end portions of the lateral side members 914 are movably coupled to the end portions of the longitudinal side member 918. In this manner, at least a portion of the lateral side members 914 can rotate relative to the longitudinal side members 918. Although the end portions of the lateral side members 914 are shown as being coupled to the end portions of the longitudinal side members 918, in other embodiments the lateral side members are not coupled to the longitudinal side members, but are coupled to another portion of the table assembly, such as, for example support legs (not shown in FIGS. 8 and 9).

As illustrated in FIG. 9, the central portion 916 of each lateral side member 914 is configured to be moved in the direction of the arrows AAA and BBB such that the two longitudinal side members 918 can be drawn together, as indicated by the arrows CCC and DDD. In this manner, the table 910 of the table assembly 900 can be moved between its expanded configuration (FIG. 8) and its collapsed configuration (FIG. 9). Said another way, the lateral side members 914 are configured to pivot about an axis substantially normal to a table top plane P such that the table 910 of the table assembly 900 can be an moved between its expanded configuration and its collapsed configuration. In this manner, the longitudinal side members 918 are parallel to each other and the longitudinal axis L when the table assembly 900 is in both its expanded configuration and its collapsed configuration. Moreover, the longitudinal side members 918 remain substantially parallel to and adjacent to the plane defined by the top surface portion 920 when the table assembly 900 is in its expanded configuration and its collapsed configuration. Similarly, the lateral side members 914 are parallel to each other and perpendicular to the longitudinal axis L when the table assembly 900 is in its expanded configuration, but are positioned such that an angle Θ between the lateral side members 914 and the longitudinal side members 918 is less than 90 degrees when the table assembly 900 is in its collapsed configuration. Although shown in FIG. 9 as being greater than zero degrees, in other embodiments, the lateral side members 914 can be substantially parallel (i.e., at an angle Θ of approximately zero degrees) to the longitudinal side members 918 when the table assembly 900 is in its collapsed configuration. Moreover, the lateral side members 914 remain substantially parallel to the plane defined by the top surface portion 920 when the table assembly 900 is in its expanded configuration and its collapsed configuration.

Figure 10:
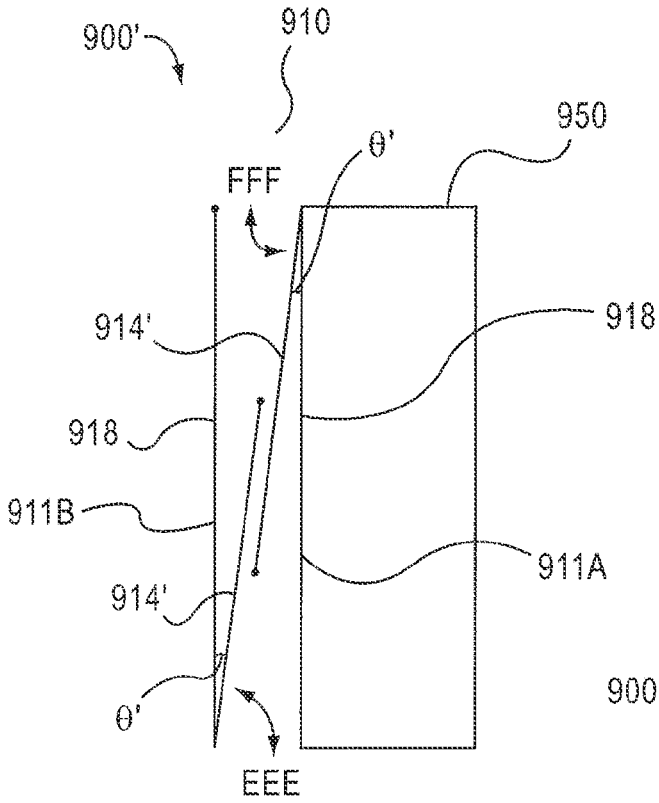
FIG. 10 is a schematic illustration showing a top view of a table assembly according to an embodiment of the invention in a second configuration.

Although the end portions of the lateral side members 914 are shown as being coupled to the longitudinal side members 918 in both the expanded configuration (FIG. 8) and the collapsed configuration (FIG. 9), in other embodiments, at least one end portion of the lateral side members 914' can be removably coupled to the corresponding end portion of the longitudinal side members 918. For example, FIG. 10 is a schematic illustration of a table assembly 900' in which one end portion of each lateral side member 914' is configured to be detached from the longitudinal side member 918 such that the lateral side members 914' can be rotated in the direction of arrows EEE and FFF. In this manner, the table 910 of the table assembly 900 can be moved between its expanded configuration (FIG. 8) and its collapsed configuration (FIG. 10). Said another way, the lateral side members 914' are configured to be removably coupled to the longitudinal side members 918 such that the table 910 is separated into two portions 911A and 911B when the table 910 is in its collapsed configuration. Moreover, as described above, the lateral side members 914' are configured to pivot about an axis substantially normal to the table top plane P. In this manner, the lateral side members 914' are parallel to each other and perpendicular to the longitudinal axis L when the table assembly 900 is in its expanded configuration, but are positioned such that an angle Θ' between the lateral side members 914' and the longitudinal side members 918 is less than 90 degrees when the table assembly 900 is in its collapsed configuration. As described above, the lateral side members 914' remain parallel to the plane defined by the top surface portion 920 when the table assembly 900 is in its expanded configuration and its collapsed configuration.

Although the lateral side members 914 are shown as being pivotable about two points, specifically the end portion and the central portion 916, in other embodiments, a table assembly can include a lateral side member being pivotable about more than two locations. For example, in some embodiments, a lateral side member can include multiple pivot points disposed along its length such that the lateral side member can be folded in an accordion-like manner to accommodate placing the table assembly in its collapsed configuration.

Figure 11:
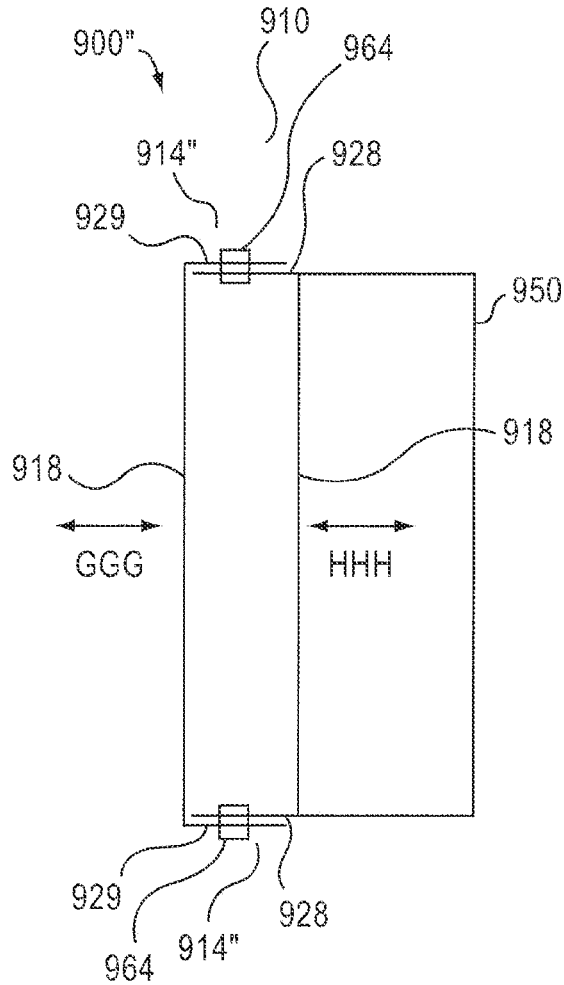
FIG. 11 is a schematic illustration showing a top view of a table assembly according to an embodiment of the invention in a second configuration.

In yet other embodiments, the lateral side members are configured to maintain a fixed angular relationship with the longitudinal side members. FIG. 11 is a schematic illustration of a table assembly 900" according to an embodiment of the invention in a collapsed configuration, in which the lateral side members 914" maintain a constant angular relationship with the longitudinal side members 918. The lateral side members 914" include a first portion 928 and a second portion 929 slidably coupled to the first portion 928. In this embodiment, the first portion 928 and the second portion 929 are slidably coupled by connector 964; in other embodiments the first support member and the support leg are slidably coupled via a telescopic coupling without a separate connector. As illustrated in FIG. 11, the table 910 of the table assembly 900 can be moved between its expanded configuration (see e.g., FIG. 8) and its collapsed configuration (FIG. 11) by moving the first portion 928 and the second portion 929 inward relative to each other as indicated by the arrows GGG and HHH. In yet other embodiments, each lateral side member can include more than two portions, slidably coupled together.

In some embodiments, the table top 920 can be removed from the longitudinal side members 918 to accommodate moving the table assembly 900 from the expanded configuration to the collapsed configuration. In other embodiments, the table top 920 can be constructed of a flexible and/or pliable material, such as a mesh and/or fabric, to accommodate placing the table assembly 900 in the collapsed configuration. For example, in such embodiments, when the longitudinal side member 918 are moved inwardly, the table top 920 can collapse or fold.

Figure 12:
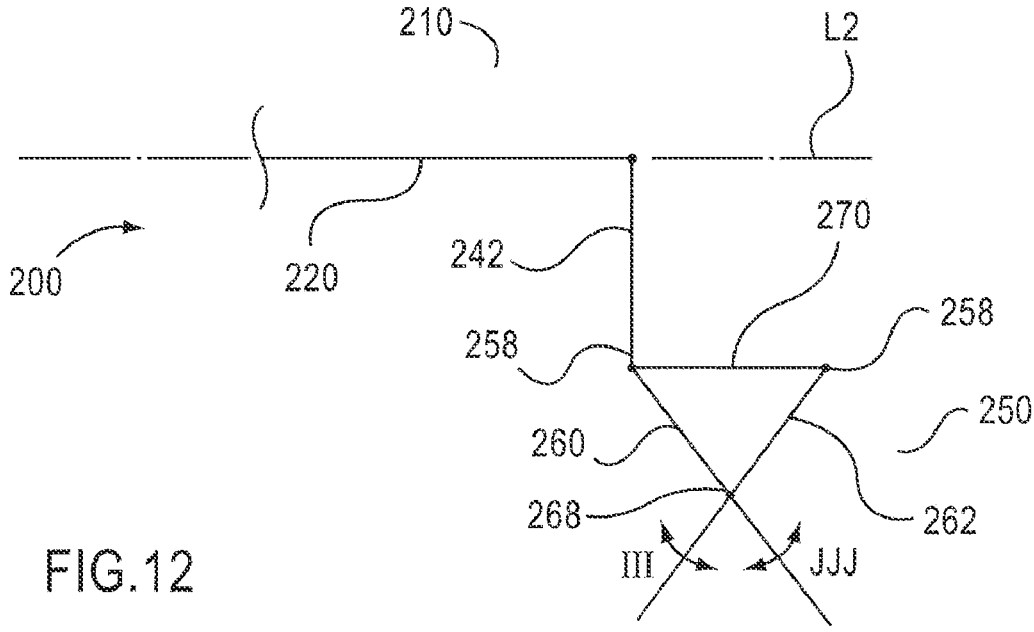
FIGS. 12 and 13 are schematic illustrations showing a front view of a portion of a table assembly according to an embodiment of the invention in an expanded configuration and a first collapsed configuration, respectively.
Figure 13:
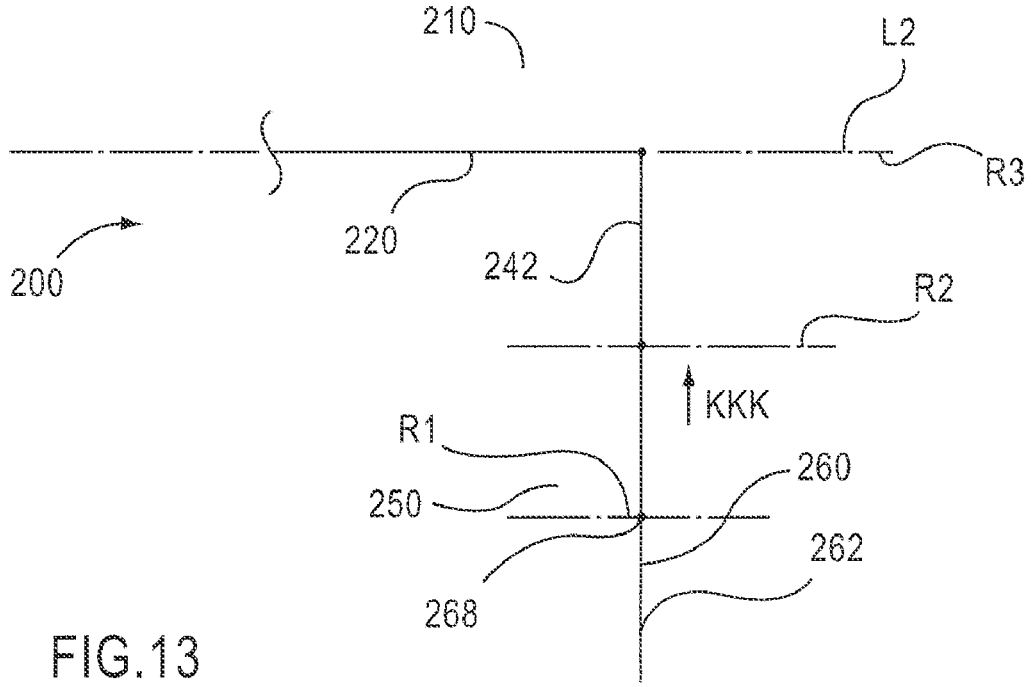
Figure 14:
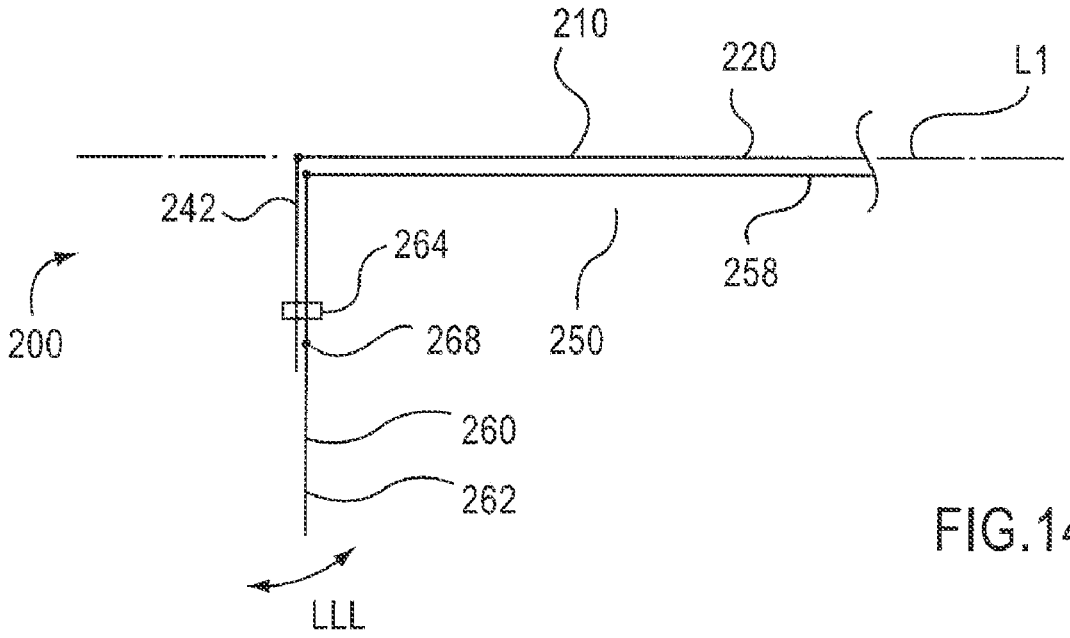
FIGS. 14 and 15 are schematic illustrations showing a side view of a portion of the table assembly illustrated in FIGS. 12 and 13 in a second collapsed configuration and a third collapsed configuration, respectively.
Figure 15:
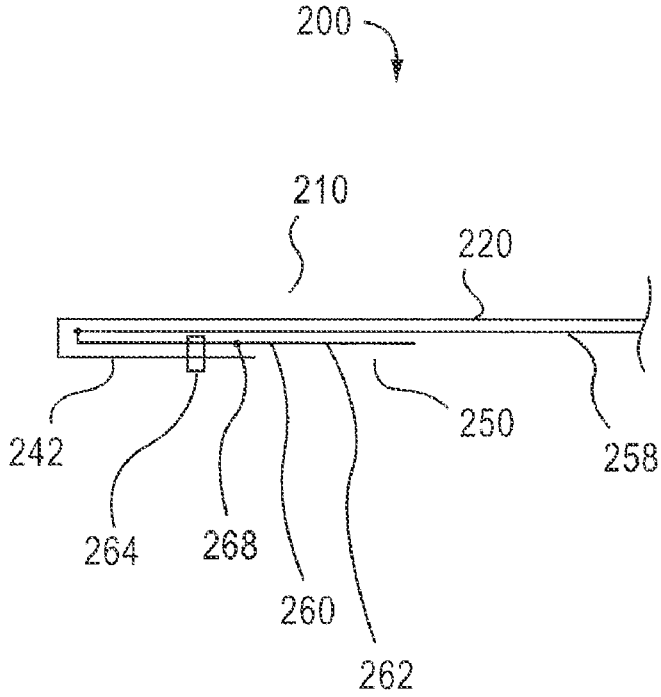
Figure 16:
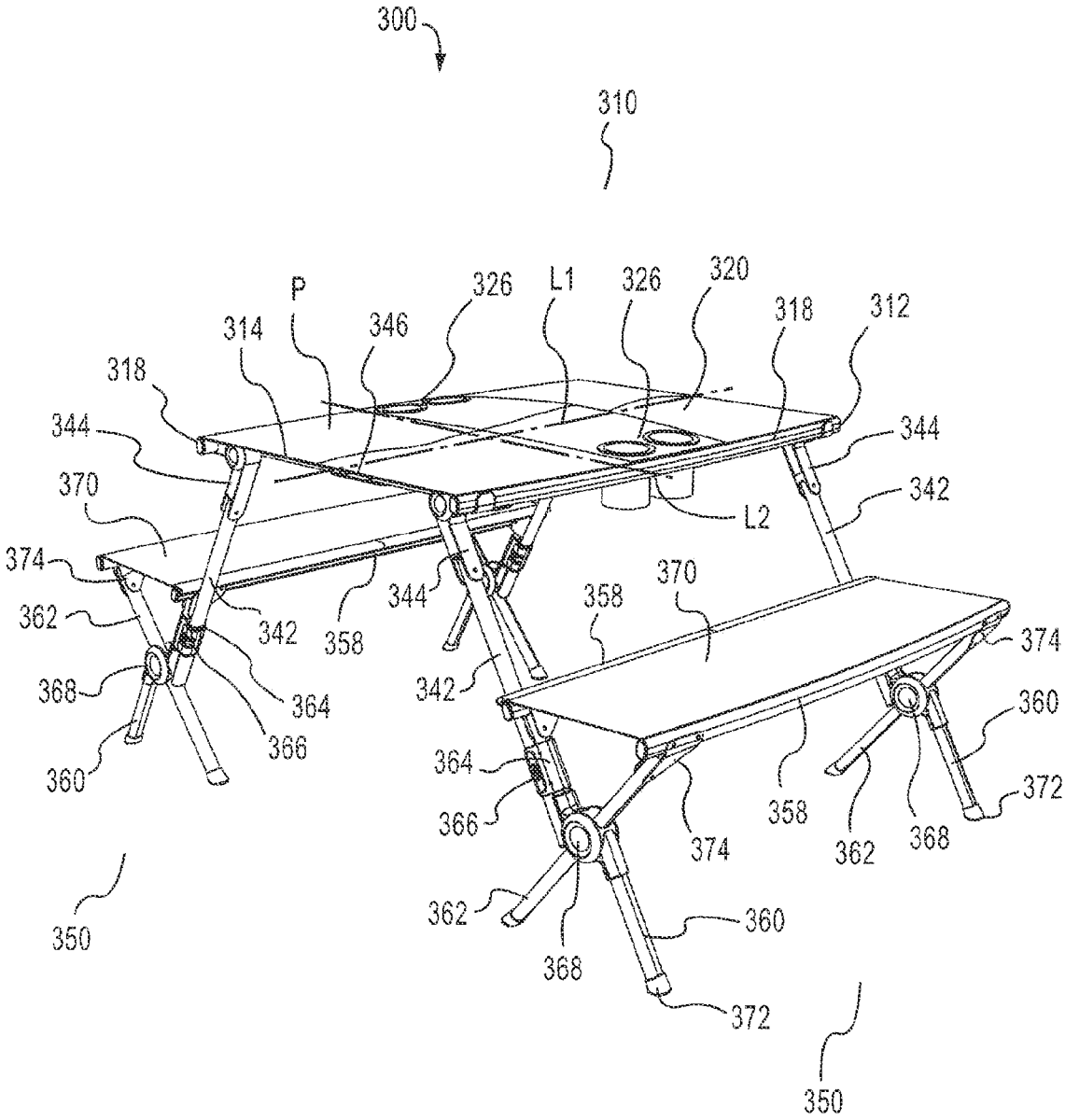
FIG. 16 is a perspective view of a picnic table in an expanded configuration according to an embodiment of the invention.

FIGS. 12 through 15 are schematic illustrations of a portion of a table assembly 200 according to an embodiment of the invention in various configurations. FIG. 12 is a schematic showing a front view (i.e., an end view) of a portion of the table assembly 200 in an expanded configuration. FIG. 13 is a schematic showing a front view of a portion of the table assembly 200 in a first collapsed configuration. FIGS. 14 and 15 are schematics showing a side view of a portion of the table assembly 200 in a second and third collapsed configuration, respectively.

The table assembly 200 includes a table 210 and a bench 250 coupled to the table 210. The table 210 includes a table top 220 and a support leg 242 coupled to the table top 220 in a manner that permits the support leg 242 to rotate relative to the table top 220. The table top 220 defines a longitudinal axis L1 (see FIG. 14) and a lateral axis L2 substantially normal to the longitudinal axis L1 (see FIG. 12). The table top 220 also defines a table top plane (not labeled in FIGS. 12-15) that includes the longitudinal axis L1 and the longitudinal axis L2.

The bench 250 includes a first support member 260, a second support member 262, two bench side members 258 (see FIGS. 14 and 15) and a bench seat 270. The bench side members 258 are substantially parallel to each other and define a bench seat plane (not labeled in FIGS. 12-15). The bench seat 270 is coupled to the bench side member 258 such that when the table assembly is in the expanded configuration (FIG. 12) the bench seat 270 provides a suitable structure upon which a person can sit.

As shown in FIGS. 12 and 13, the first support member 260 and the second support member 262 are coupled together at point 268 in a manner that permits them to rotate relative to each other. In some embodiments, point 268 can include a pivoting connector. As shown in FIGS. 14 and 15, the first support member 260 is slidably coupled to the support leg 242 of the table 210. In this embodiment, the first support member 260 and the support leg 242 are slidably coupled by connector 264; in other embodiments the first support member and the support leg are slidably coupled via a telescopic coupling without a separate connector. The first support member 260 is coupled to one of the bench side members 258 in a manner that allows relative motion between the first support member 260 and the bench side member 258. Similarly, the second support member 262 is pivotably coupled to the other bench side member 258 in a manner that allows relative motion between the first support member 260 and the longitudinal side member 258.

When the table assembly 200 is in its expanded configuration, the first support member 260 is non-parallel with the second support member 262, as shown in FIG. 3. In this manner, the bench side members 258 are positioned substantially parallel to each other and to the longitudinal axis L1. Additionally, the bench side members 258 are disposed apart from each other, thereby forming a suitable spacing to receive the bench seat 270. Moreover, when the table assembly 200 is in the expanded configuration, the bench seat plane defined by the bench side members 258 is substantially parallel to the table top plane defined by the table top 220 of the table 210. Similarly, the lower end portions of the support members 260, 262 are disposed apart from each other, thereby forming a stable support structure that can be placed, for example, on the ground.

The table assembly 200 can be placed in several different collapsed configurations, as shown in FIGS. 13 through 15. Although the various collapsed configurations as illustrated and described as occurring sequentially to transform the table assembly 200 between an expanded configuration (FIG. 12) and a third collapsed configuration (FIG. 15), the table assembly 200 can be placed in the various configurations in any sequence. To place the table assembly 200 in its first collapsed configuration (FIG. 13), the second support member 262 is rotated relative to the first support member 260 about an axis R1, as indicated by the arrows III and JJJ in FIG. 12. In this manner, the first support member 260 and the second support member 262 are positioned substantially parallel to each other, as shown in FIG. 13. Although the first support member 260 and the second support member 262 are shown in FIG. 13 as being positioned such that they are substantially perpendicular to the table top plane defined by the longitudinal axis L1 and lateral axis L2 of the table top 220, in other embodiments, the first support member 260 and the second support member 262 can be positioned in a different angular relationship with respect to the table top plane defined by the longitudinal axis L1 and lateral axis L2 of the table top 220.

In some embodiments, the bench seat 270 can be removed from the bench side members 258 to accommodate placing the table assembly 200 in the first collapsed configuration as shown in FIG. 13. In other embodiments, the bench seat 270 can be constructed of a flexible and/or pliable material, such as a mesh and/or fabric, to accommodate placing the table assembly 200 in the first collapsed configuration. For example, in such embodiments, when the second support member 262 is rotated relative to the first support member 260, the bench surface 270 can collapse or fold.

To place the table assembly 200 in its second collapsed configuration (FIG. 14), the first support member 260 is slidably displaced along the support leg 242 via connector 264, as indicated by the arrow KKK in FIG. 13. In this manner, the bench support members 258 are disposed adjacent to and remain substantially parallel to the longitudinal axis L1 and the table top plane defined by the table top 220. The table assembly 200 can then be placed in its third collapsed configuration (FIG. 15) by rotating the first support member 260, the second support member 262 and the support leg 242 as indicated by the arrow LLL in FIG. 14. Said another way, the first support member 260 and the second support member 262 can be rotated relative to their respective longitudinal support members 258 about an axis R2 (see FIG. 13). Although axis R2 is shown as being substantially parallel to the lateral axis L2 and to the table top plane defined by the table top 220, in other embodiments, the axis R2 can have some other angular relationship with respect to the table top plane defined by the table top 220. Similarly, the support leg 242 is rotated relative to the bench surface 270 of the table assembly 200 about an axis R3. Although axis R3 is shown as being coincident with the lateral axis L2, in other embodiments, the axis R3 can be offset from the lateral axis L2. In yet other embodiments, the axis R3 can have some other angular relationship with respect to the planar surface defined by the longitudinal axis L1 and lateral axis L2 of the top surface portion 220.

In some embodiments, a picnic table can combine the collapsible table 910 as described with reference to FIGS. 8 and 9 with the collapsible bench 250 as described with reference to FIGS. 12 through 15. In other embodiments, a picnic table can include only a portion of the functionality as shown and described above.

Figure 17:
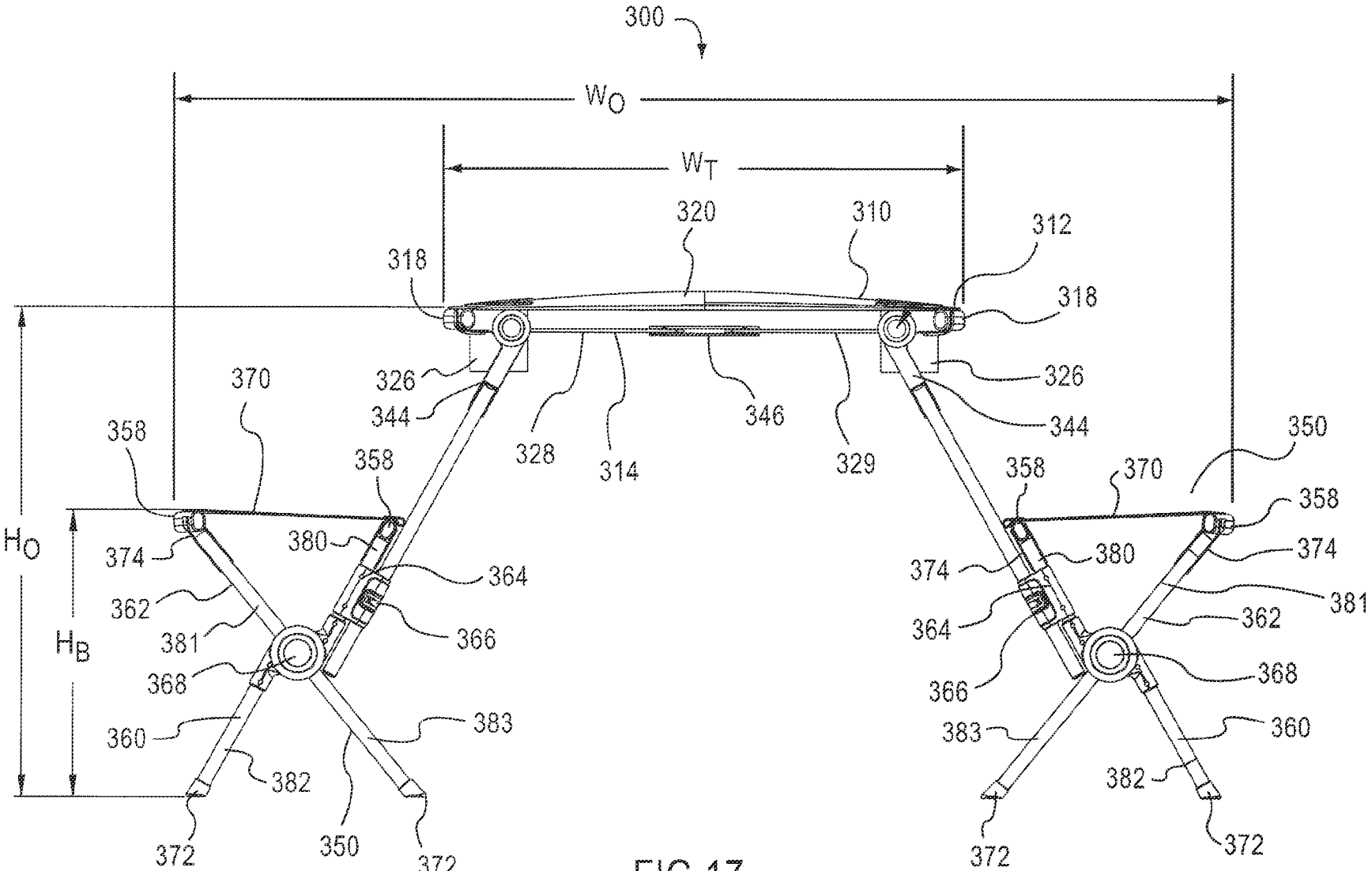
FIG. 17 is a front view of the picnic table shown in FIG. 16.
Figure 18:
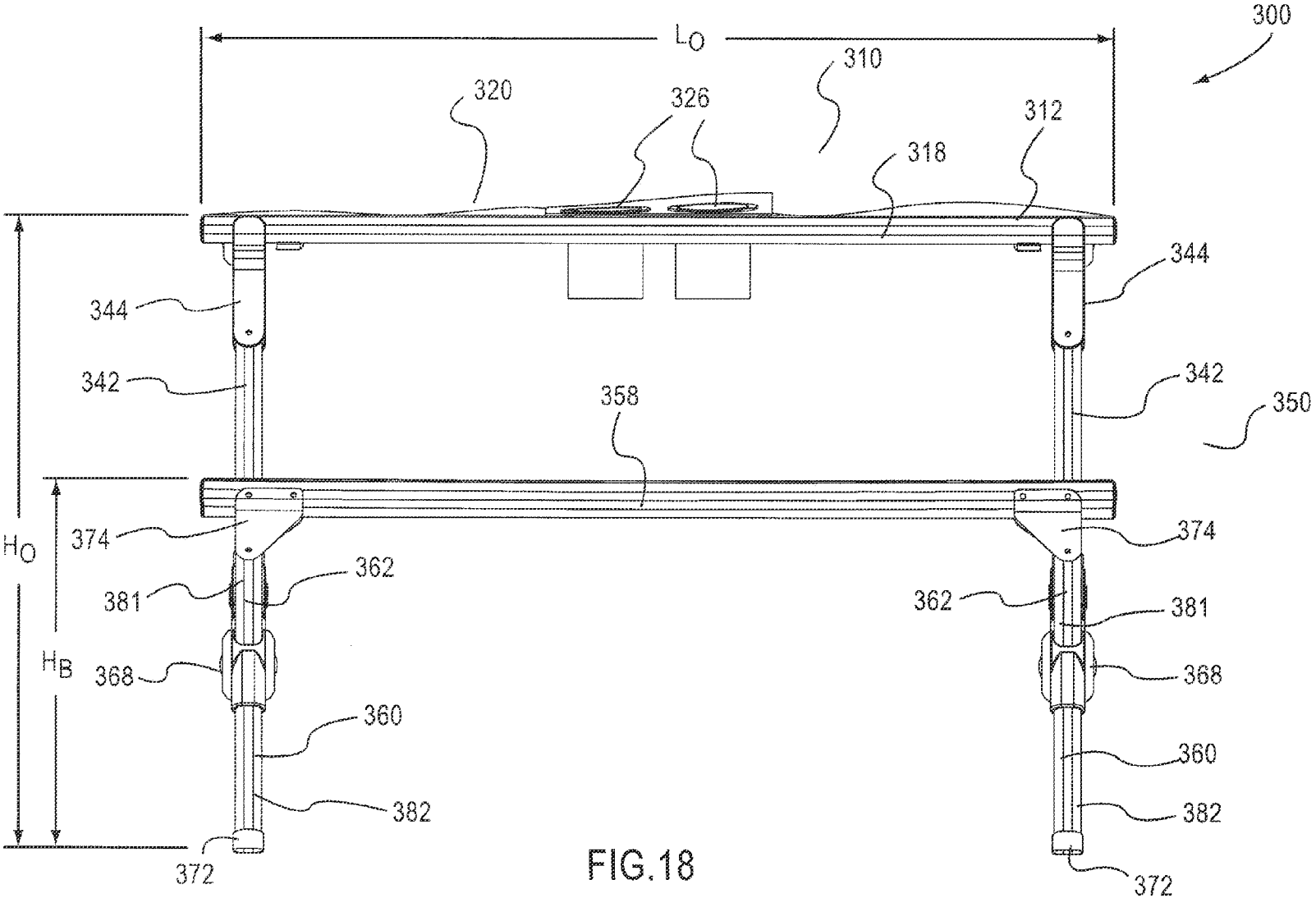
FIG. 18 is a side view of the picnic table shown in FIG. 16.
Figure 19:
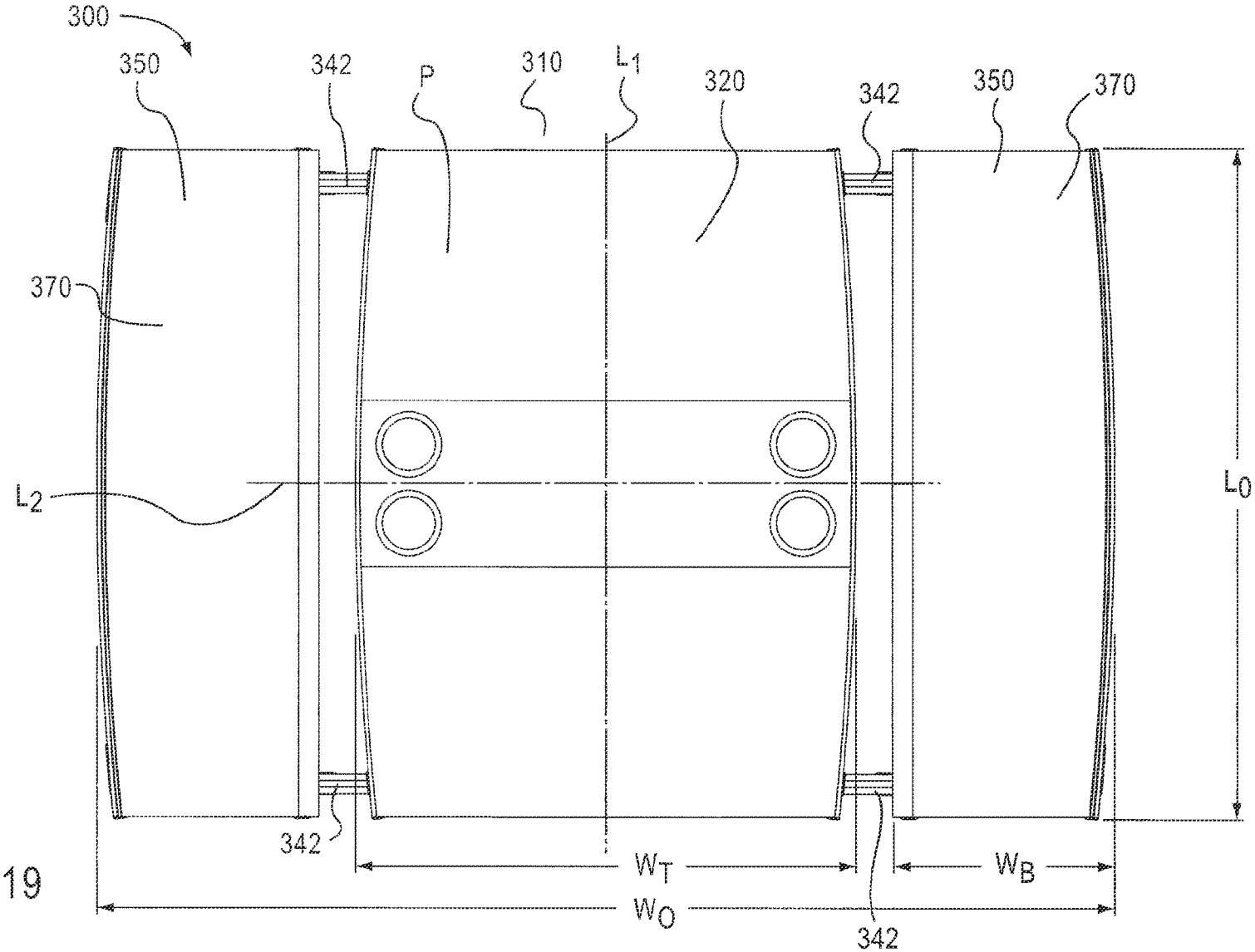
FIG. 19 is a top view of the picnic table shown in FIG. 16.

FIGS. 16 through 19 illustrate a picnic table 300 according to an embodiment of the invention in an expanded configuration. FIGS. 20 through 24 illustrate the picnic table 300 in various collapsed configurations, as discussed herein. The picnic table 300 includes a table 310 and two benches 350 coupled to the table. The table 310 includes a frame 312, a table top 320 coupled to the frame, and four support legs 342 pivotably coupled to the frame 312 via connectors 344. The table top 320 defines a longitudinal axis L1 and a lateral axis L2 substantially normal to the longitudinal axis L1, that collectively define a table top plane P. The table top 320, which can be constructed from a pliable material, includes four cup holders 326. The frame 312 includes two longitudinal side members 318 positioned substantially parallel to the longitudinal axis L1 and two lateral side members 314 positioned substantially parallel to the lateral axis L2. As shown in FIG. 17, each lateral side member 314 includes a first portion 328 and a second portion 329 pivotably coupled together via a lateral hinge member 346. The outwardly facing ends of the first portion 328 and the second portion 329 are pivotably coupled to the longitudinal side members 318. The operation of the lateral hinge member 346 will be discussed in more detail herein with reference to FIGS. 29 and 30.

When the table assembly 300 is in the expanded configuration, the longitudinal side members 318 are spaced apart from each other such that the table top 320 is maintained in a taut condition. In this manner, when the table assembly 300 is in the expanded configuration, the table 310 can provide a suitable surface upon which a user can eat, work or the like.

Figure 28:
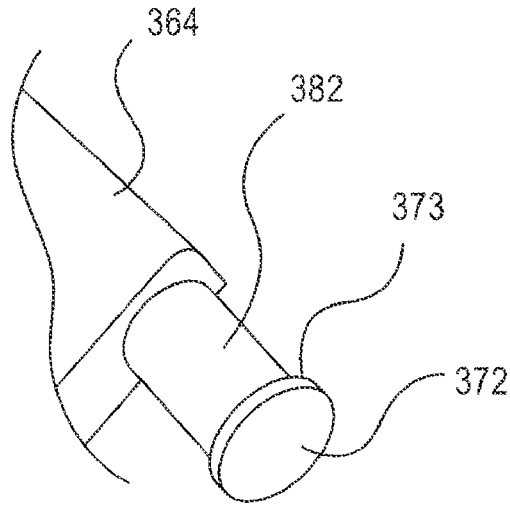
FIG. 28 is a perspective view of a portion of the bench of the picnic table shown in FIG. 16.

Each bench 350 includes two support sub-assemblies (not labeled in FIGS. 16-19), two longitudinal bench support members 358, and a bench seat 370. Each support sub-assembly includes two first support members 360 and two second support members 362. As illustrated, each of the first support members 360 is pivotably coupled to one of the second support members 362 via connector 368. As best shown in FIG. 17, each first support member 360 includes an upper portion 380 disposed above the connector 368 and a lower portion 382 disposed below the connector 368. Similarly, each second support member 362 includes an upper portion 381 and a lower portion 383. The lower portions 382 and 383 include feet 372 configured to engage a support surface, such as the ground or floor. The feet 372 can be, for example, slip-resistant rubber feet. As shown in FIG. 28, in some embodiments, the feet 372 can include a protrusion 373 configured to limit the sliding motion of lower portions 382 and 383 of the support members within the connection members 364. Said another way, the feet 372 are configured to prevent the lower portions 382 and 383 of the support members from sliding complete out of the connection member 364 when the lower portions 382 and 383 slide within the connection member 364.

The upper portion 380 of each first support member 360 is pivotably coupled to an end of one of the longitudinal bench support members 358 via connector 374. Similarly, the upper portion 381 of each second support member 362 is pivotably coupled to an end of another of the longitudinal bench support members 358 via connector 374. In this manner, the longitudinal bench support members 358 are positioned substantially parallel to the longitudinal axis L1. In some embodiments, connector 374 includes multiple degrees of freedom such that the support members 360, 362 can be rotated about an axis substantially parallel to the longitudinal axis L1 and an axis substantially parallel to the lateral axis L2. In other embodiments, the connector 374 is configured to permit rotation about an axis that is neither parallel to the longitudinal axis L1 or parallel to the lateral axis L2

Figure 27:
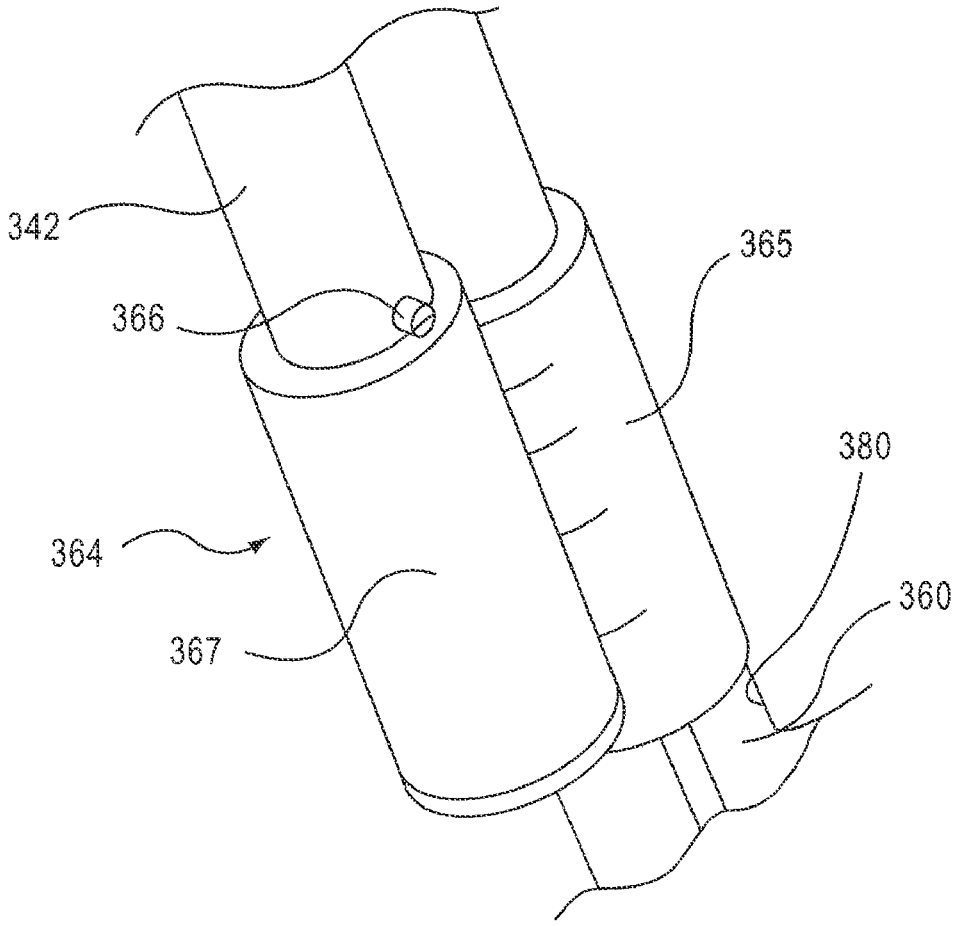
FIG. 27 is a perspective view of the connection member of the picnic table shown in FIG. 16.

Each first support member 360 is slidably coupled to the corresponding support leg 342 by connection member 364. As illustrated in FIG. 27, a first portion 365 of the connection member 364 is attached to the upper portion 380 of the support member 360 of the bench 350. A second portion 367 of the connection member 364 includes an opening configured to receive a portion of the support leg 342 of the table 310. The opening is configured to allow the support leg 342 to slide therein such that the position of the bench 350 can be adjusted along the length of the support leg 342. The support leg 342 includes a locking member 366 configured to retain the bench 350 in a desired position along the support leg 342 of the table 310. The locking member 366 can be, for example, a spring-biased pin configured to retain the bench 350 in a desired position along the support leg 342 of the table 310. To change the position of the bench 350 along the support leg 342 of the table 310, a user can move the locking member 366 inward, thereby allowing the support leg 342 to freely slide within the connection member 364. Although the locking member 366 is shown as being disposed on the support leg 342, in other embodiments, the locking member can be disposed on the connection member 364.

When the table assembly 300 is in the expanded configuration, as shown in FIGS. 16 through 19, the first support members 360 are angularly offset from their corresponding second support members 362. Accordingly, the longitudinal bench support members 358 are disposed apart from each other, thereby forming a suitable spacing to receive the bench seat 370. Similarly, the lower portions 382 and 383 of the support members 360 and 362 are disposed apart from each other, thereby forming a stable support structure configured to engage a support surface, such as, for example, the ground or a floor. In this manner, when the bench 350 is in the expanded configuration, the first support member 360 and the second support member 360 can apply sufficient tension to the bench seat 370 to maintain the bench seat 370 in a taut condition such that the bench 350 can support the weight of a user seated on the bench seat 370.

When the table assembly 300 is in the expanded configuration, the table assembly 300 has an overall height $H_O$, an overall length $L_O$ and an overall width $W_O$. In some embodiments, for example, the overall height $H_O$ can be approximately 720 mm, the overall length $L_O$ can be approximately 1025 mm, and the overall width $W_O$ can be approximately 1545 mm. Similarly, when the table assembly 300 is in the expanded configuration, the table 310 has a table width $W_T$. In some embodiments, the table width $W_T$ can be approximately 760 mm. Similarly, when the table assembly 300 is in the expanded configuration, the bench 350 has a bench height $H_B$ and a bench width $W_B$. In some embodiments, the bench height $H_B$ can be approximately 420 mm and the bench width $W_B$ can be approximately 335 mm.

Figure 20:
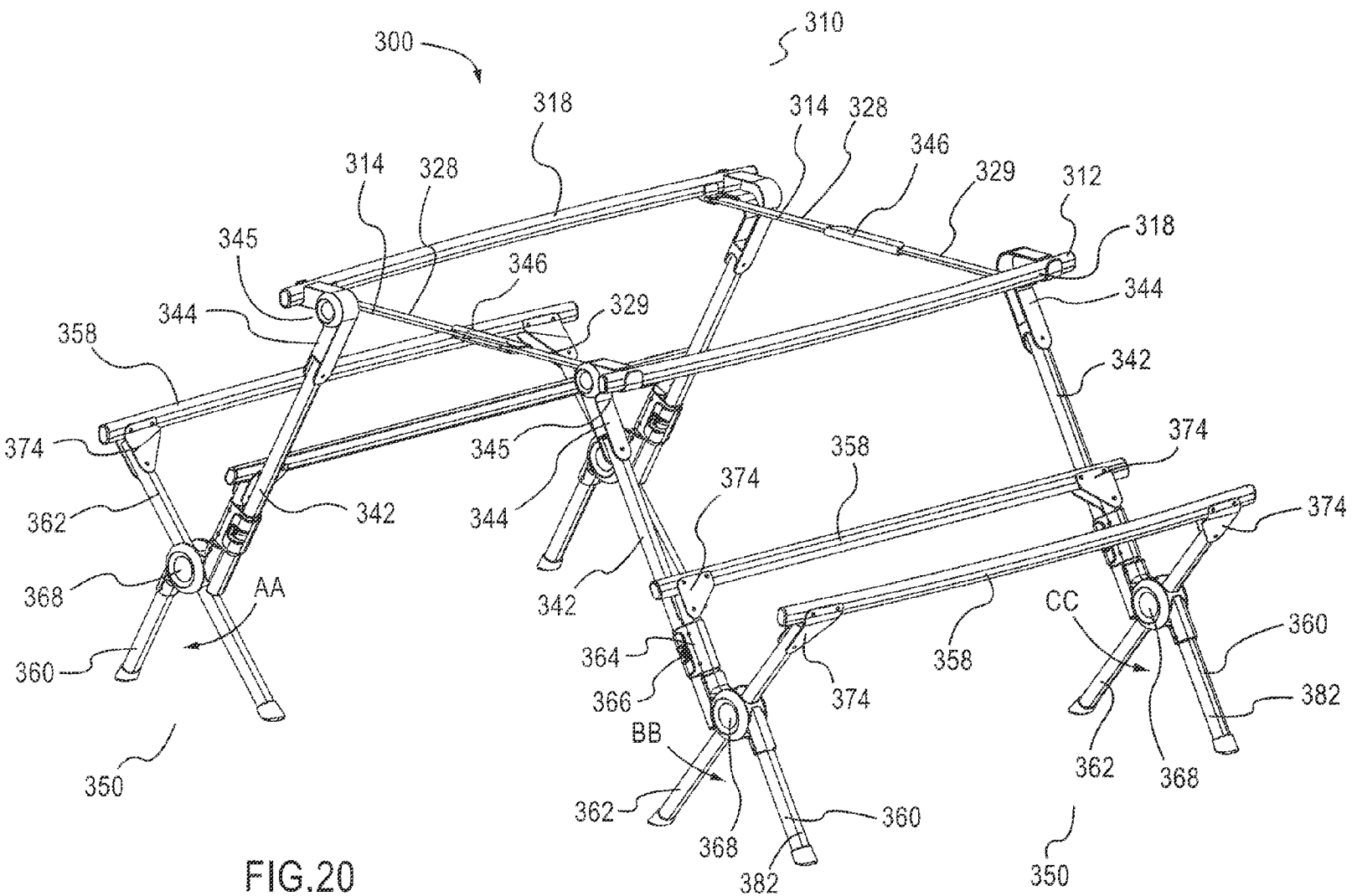
FIG. 20 is a perspective view of the picnic table frame shown in FIG. 16 in an expanded configuration.
Figure 21:
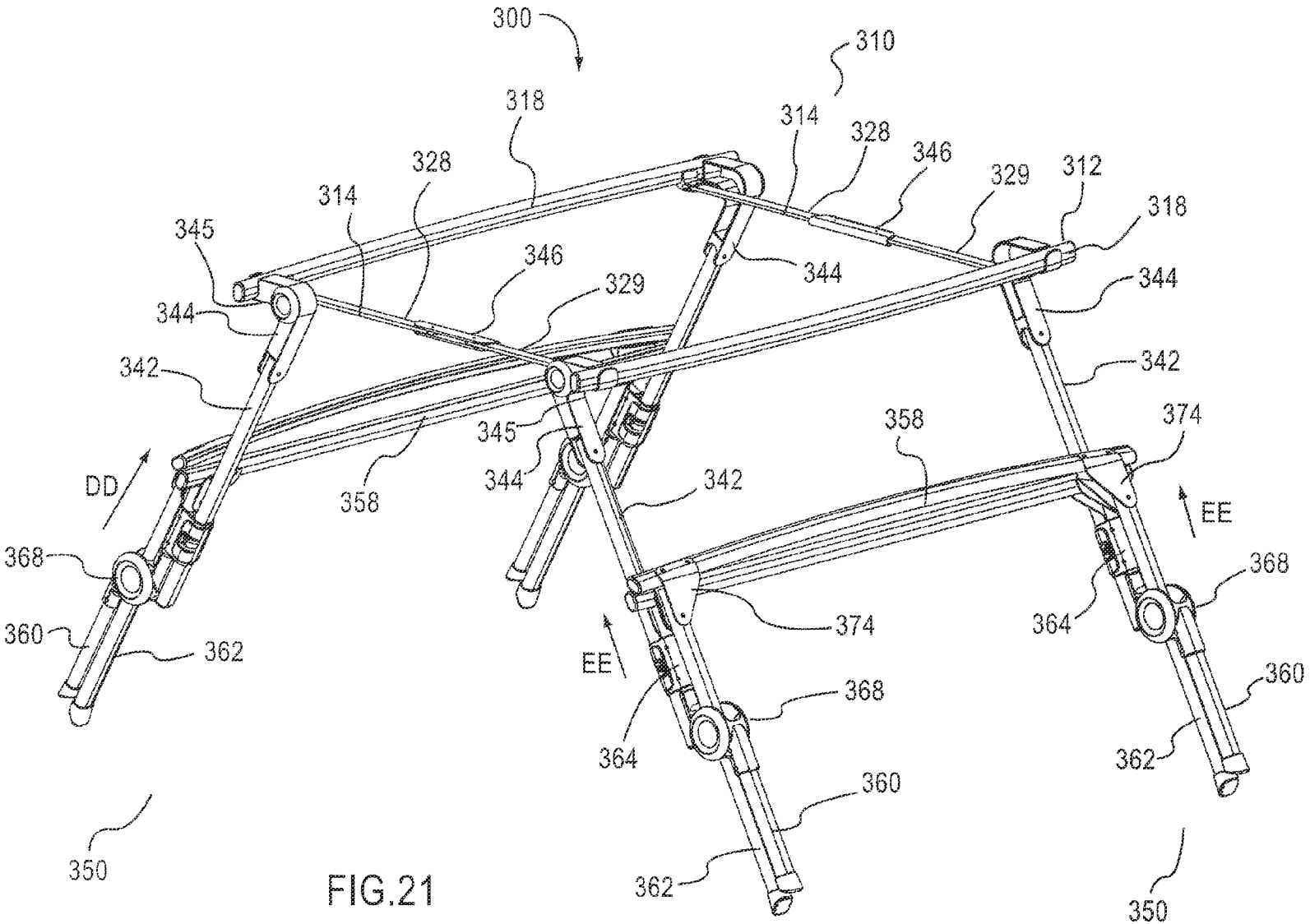
FIG. 21 is a perspective view of the picnic table frame shown in FIG. 16 in a first collapsed configuration.

The operation of the above-described picnic table 300 is described with reference to FIGS. 20 through 24, which are perspective views showing the picnic table 300 in various collapsed configurations. For illustrative purposes, FIGS. 20 through 24 show the picnic table 300 without the table top 320 and the bench seat 370. FIG. 20 is a perspective view of the picnic table 300 in its fully expanded configuration, substantially the same as that shown and described above. The picnic table 300 can be placed in its first collapsed configuration (FIG. 21) by rotating the second support members 362 relative to the first support member 360 about connector 368, as indicated by the arrows AA, BB and CC in FIG. 20. In this manner, the first support member 360 and the second support member 362 are changed from a position in which they are angularly offset from (i.e., non-parallel to) each other (FIG. 20) to a position in which they are substantially parallel to each other (FIG. 21). In some embodiments, the connector 368 can include a locking mechanism to retain the support members 360, 362 in either the expanded configuration or the collapsed configuration, thereby preventing inadvertent changes in position. In some embodiments, for example, the connector 368 can include a detent, a ratcheting mechanism or the like to retain the support members 360, 362 in their desired positions.

The picnic table 300 can be placed in its second collapsed configuration (FIG. 22) by sliding the first support member 360 along the support leg 342 via connector 364, as indicated by the arrows DD and EE in FIG. 21. In this manner, the longitudinal bench support members 358 are disposed adjacent to and substantially parallel to the longitudinal side members 318 of the table 310. As illustrated, the connectors 344 define a recessed area 345 configured to receive the longitudinal bench support members 358 when the picnic table 300 is placed in its second collapsed configuration. As described above, the bench 350 is retained in its second collapsed configuration by the locking member 366 of the support leg 342, which engages and/or contacts the connection member 364.

Figure 22:
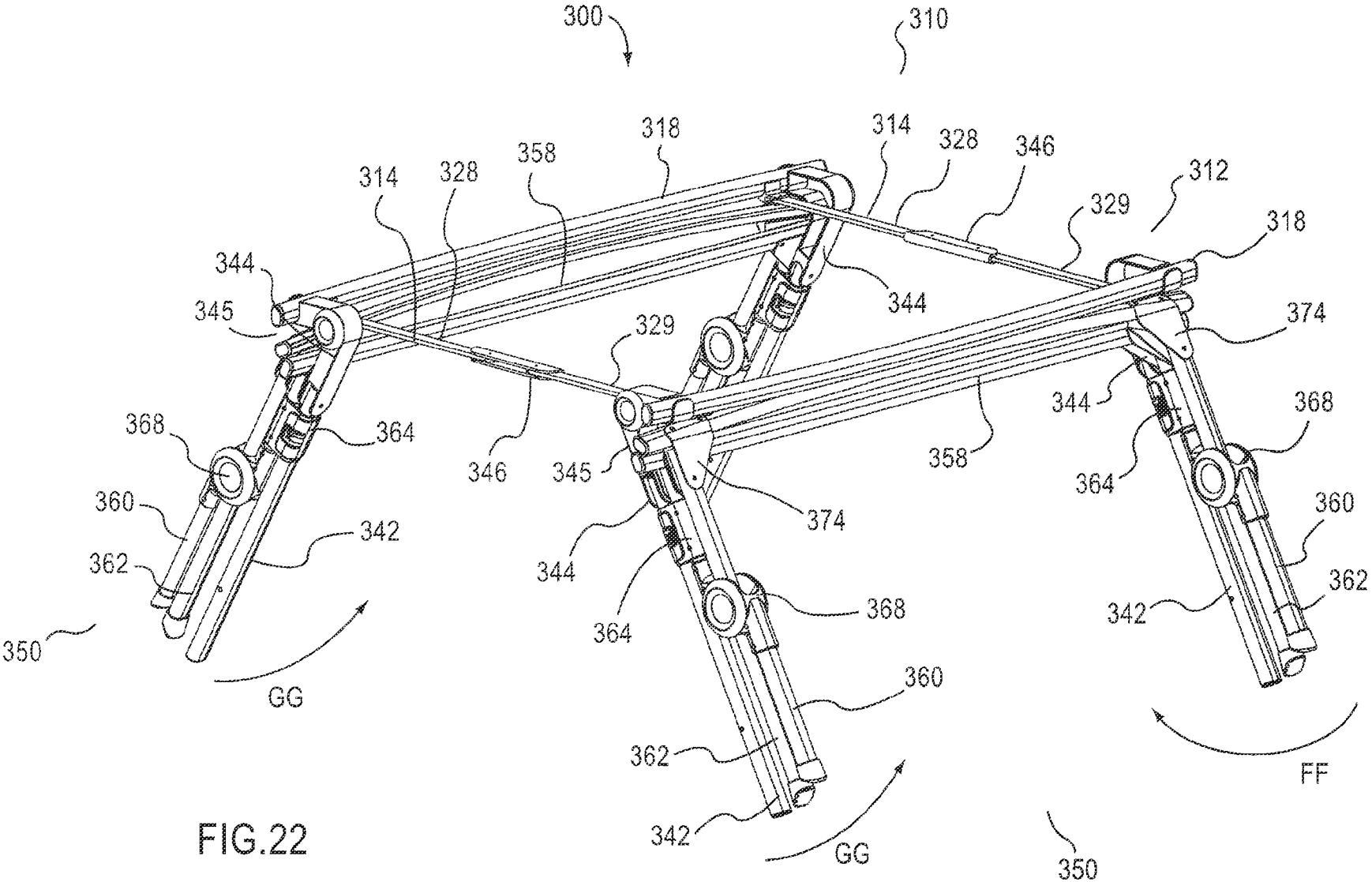
FIG. 22 is a perspective view of the picnic table frame shown in FIG. 16 in a second collapsed configuration.
Figure 23:
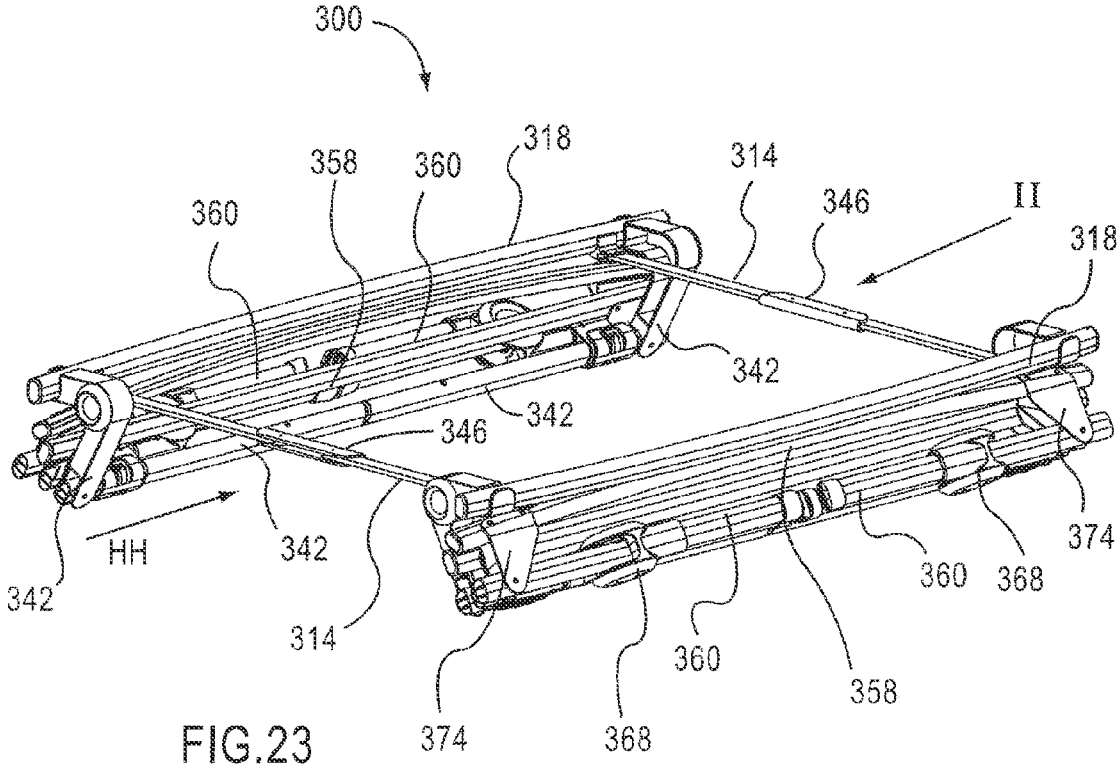
FIG. 23 is a perspective view of the picnic table frame shown in FIG. 16 in a third collapsed configuration.

The picnic table 300 can be placed in its third collapsed configuration (FIG. 23) by rotating the first support members 360 about their connectors 374, rotating the second support members 362 about their connectors 374 and by rotating the support legs 342 about connectors 344, as indicated by the arrows FF and GG in FIG. 22. Said another way, the first support members 360 and the second support members 362 are rotated relative to their respective longitudinal bench support members 358 about an axis normal to a longitudinal axis of the longitudinal bench support members 358. Similarly, the support legs 342 are rotated relative to the longitudinal support members 318 about an axis normal to a longitudinal axis of the longitudinal support members 318. In some embodiments, the connectors 374 and 344 can include a locking mechanism to retain the support members 360, 362 and/or the support legs 342 in either the expanded configurations (FIGS. 20-22) or the collapsed configurations (FIGS. 23 and 24), thereby preventing inadvertent changes in position. In some embodiments, for example, the connectors 374 and 344 can include a detent, a ratcheting mechanism or the like to retain the support members 360, 362 in their desired positions.

Figure 29:
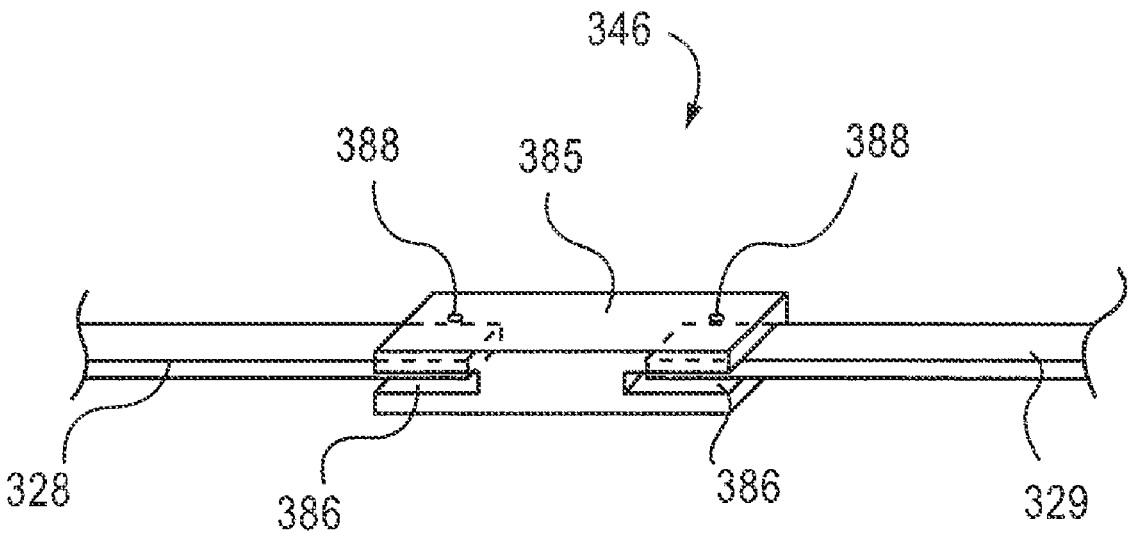
FIGS. 29 and 30 are perspective views of the lateral hinge connector of the picnic table shown in FIG. 16 in an expanded configuration and a collapsed configuration, respectively.
Figure 30:
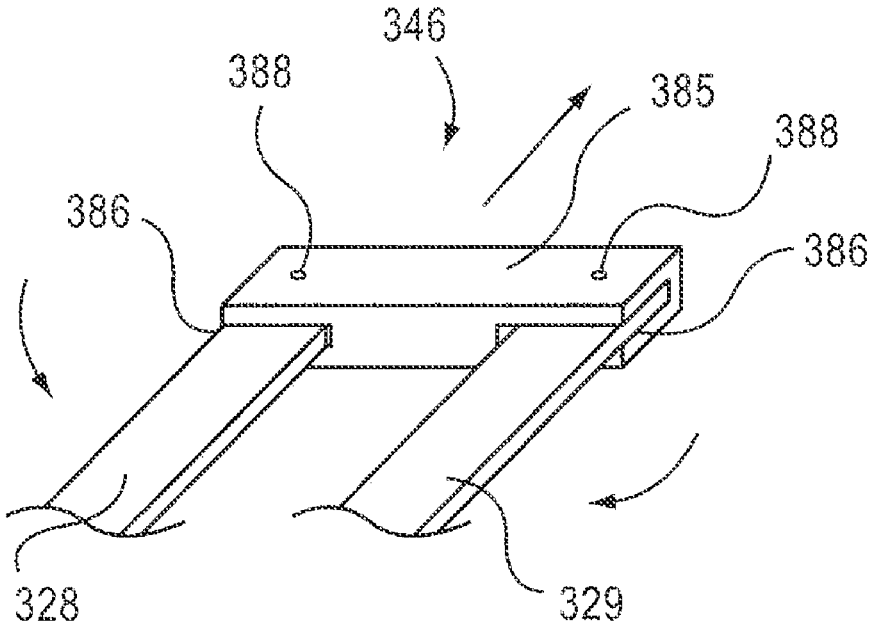

The picnic table 300 can be placed in its fourth collapsed configuration (FIG. 24) by displacing the lateral hinge members 346 of the lateral side members 314 inwardly, as indicated by the arrows HH and II in FIG. 13. As illustrated in FIGS. 29 and 30, each lateral hinge member 346 includes a body portion 385, which defines slots 386, and two pivot connectors 388. Each of the pivot connectors 388 pivotably connects the inwardly facing ends of the first portion 328 and the second portion 329 of the lateral side member 314, as discussed above. In this manner, as the lateral hinge member 346 is moved inwardly, the inwardly facing ends of the first portion 328 and the second portion 329 pivot about the pivot connectors 388 and the outwardly facing ends of the first portion 328 and the second portion 329 pivot about their respective connectors, thereby cause the lateral side member 314 to move to its collapsed configuration (see FIGS. 24 and 30). Said another way, the lateral side members 314 are configured to pivot about an axis substantially normal to a plane defined by the table top 320 (see FIG. 16) such that the table 310 of the picnic table 300 can be an moved between its expanded configuration and its collapsed configuration.

Figure 25:
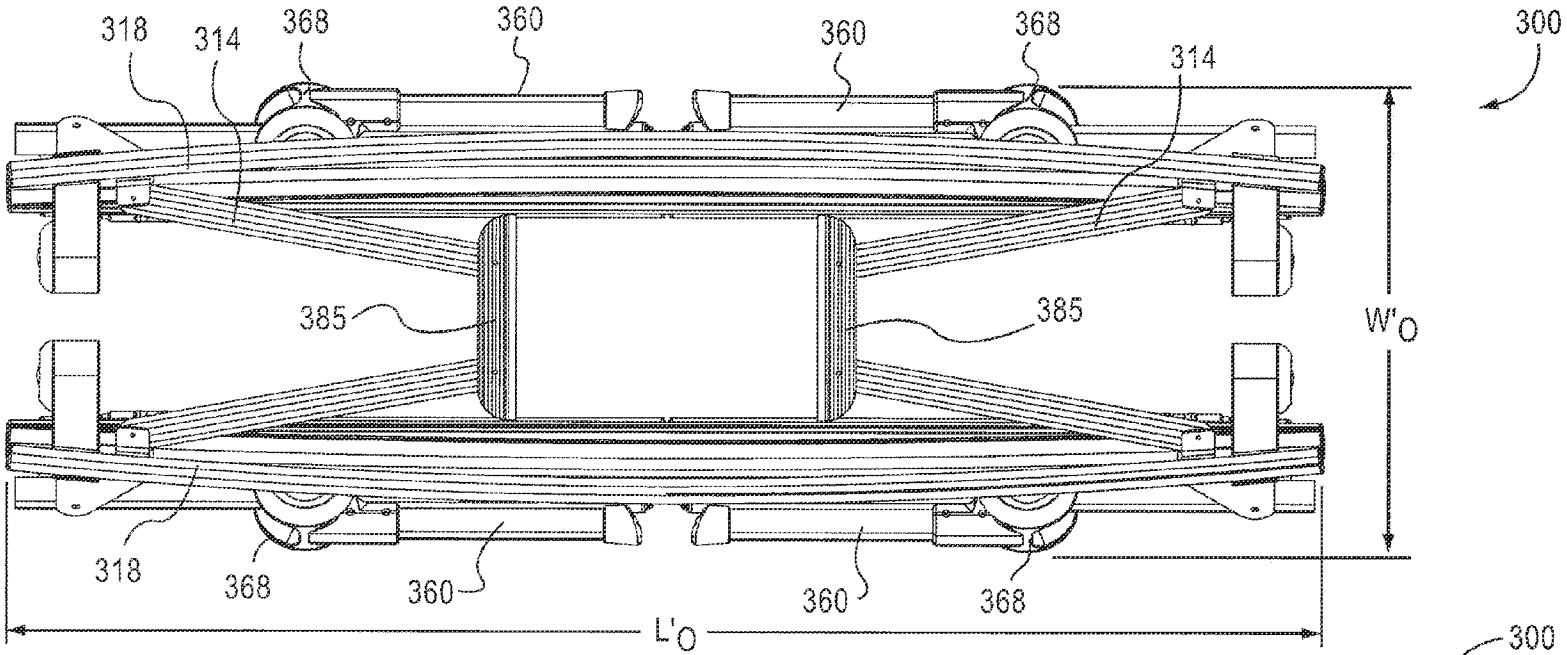
FIG. 25 is a top view of the picnic table frame shown in FIG. 16 in the fourth collapsed configuration.
Figure 26:
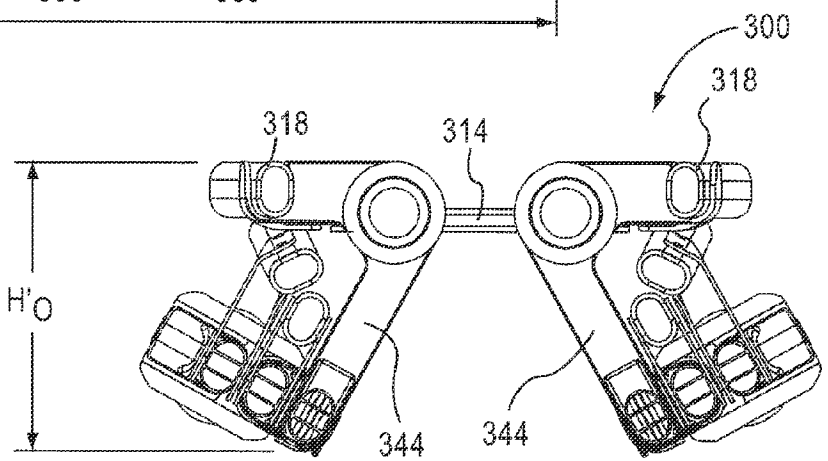
FIG. 26 is a front view of the picnic table frame shown in FIG. 16 in the fourth collapsed configuration.

When the table assembly 300 is in the fourth collapsed configuration (see FIGS. 24-26), the table assembly 300 has an overall height $H'_O$, an overall length $L'_O$ and an overall width $W'_O$. As shown, the overall height $H'_O$ is less than the overall height $H'_O$, the overall length $L'_O$ is substantially equal to the overall length $L_O$, and the overall width $W'_O$ is less than the overall width $W_O$. In this manner, the overall size of the table assembly 300 can be reduced by moving the table assembly 300 from the expanded configuration to one or more of the collapsed configurations.

In some embodiments, for example, the overall height $H'_O$ can be less than half the table width $W_T$ when the table assembly is in the expanded configuration. In other embodiments, the overall height $H'_O$ can be less than one quarter of the table width $W_T$ when the table assembly is in the expanded configuration. For example, in some embodiments, the table width $W_T$ can be approximately 760 mm and the overall height $H'_O$ can be 158 mm. Moreover, in some embodiments, the overall height $H'_O$ can be less than half the overall height $H_O$ when the table assembly is in the expanded configuration. In other embodiments, the overall height $H'_O$ can be less than one quarter of the overall height $H_O$ when the table assembly is in the expanded configuration.

In some embodiments, for example, the overall height $W'_O$ can be less than half the table width $W_T$ when the table assembly is in the expanded configuration. In other embodiments, the overall width $W_O$ can be less than one quarter of the table width $W_T$ when the table assembly is in the expanded configuration. For example, in some embodiments, the table width $W_T$ can be approximately 760 mm and the overall width $H'_O$ can be 365 mm.

Figure 31:
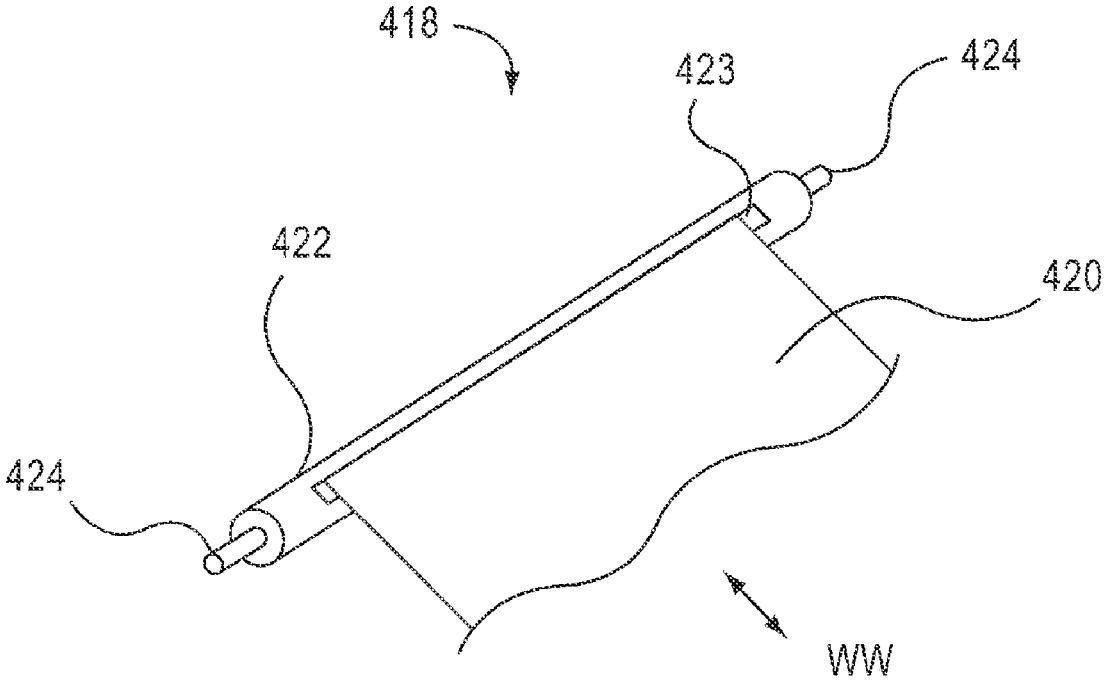
FIG. 31 is a perspective view of a longitudinal support member of a table according to an embodiment of the invention.

In some embodiments, the table top 320 can be constructed from a pliable material and/or can be removably coupled to the frame portion 312 of the picnic table 300 via mating snaps, hook and latch fasteners, Velcro® connectors or the like. In this manner, the table top 320 can be removed to accommodate transitioning the picnic table 300 between its expanded configuration and its collapsed configurations, as described above. Moreover, having a removable table top can allow the user to change the table top to meet the desired usage requirements. For example, in some instances, such as those applications requiring less portability, a user may desire a rigid table top. Conversely, in other instances, such as those applications requiring a greater degree of portability, a user may desire a more flexible, light weight table top. In yet other instances, a user may desire a table top having a specific logo or design consistent with their planned activity. For example, in some embodiments, a picnic table according to the invention may include multiple different removable table tops, each having a different logo. In one embodiment, for example, a picnic table can include a table top bearing the logo of a local baseball team, a different table top bearing the logo of local football team, and so forth In other embodiments, the table top 320 can be fixedly coupled to one of the longitudinal support members 318 and optionally removably coupled to the other components of the frame portion 312 of the picnic table 300. In this manner, the table top 320 can be removed from a portion of the frame portion 312 to accommodate transitioning the picnic table 300 between its expanded configuration and its collapsed configurations, while remaining attached to one of the longitudinal support members 318 to prevent the table top 320 from being lost or damaged when the picnic table 300 is in its collapsed configuration. For example, FIG. 31 illustrates a longitudinal support member 418 according to an embodiment of the invention that contains a table top 420 such that the table top 420 can be extended or retracted, as indicated by the arrow WW. The longitudinal support member includes a main portion 422 that defines an internal area (not shown) in which a portion of the table top 420 is disposed. The main portion 422 also defines a slot 423 through which the table top 420 can be extended. The longitudinal support member 418 also includes mounting tabs 424 configured to engage appropriate openings on the frame portion of the picnic table (not shown). In use, the longitudinal support member 418 functions similar to a spring-loaded roller shade in that the table top 420 can be pulled from the slot 423 and coupled to the remaining portions of the frame portion of the picnic table (not shown) when the picnic table is in its expanded configuration. The picnic table can be placed in its collapsed configuration in part by decoupling the table top 420 from the frame portion and allowing the biasing force of the internal springs (not shown) to retract the table top 420 into the main portion 422 of the longitudinal support member 418.

Figure 24:
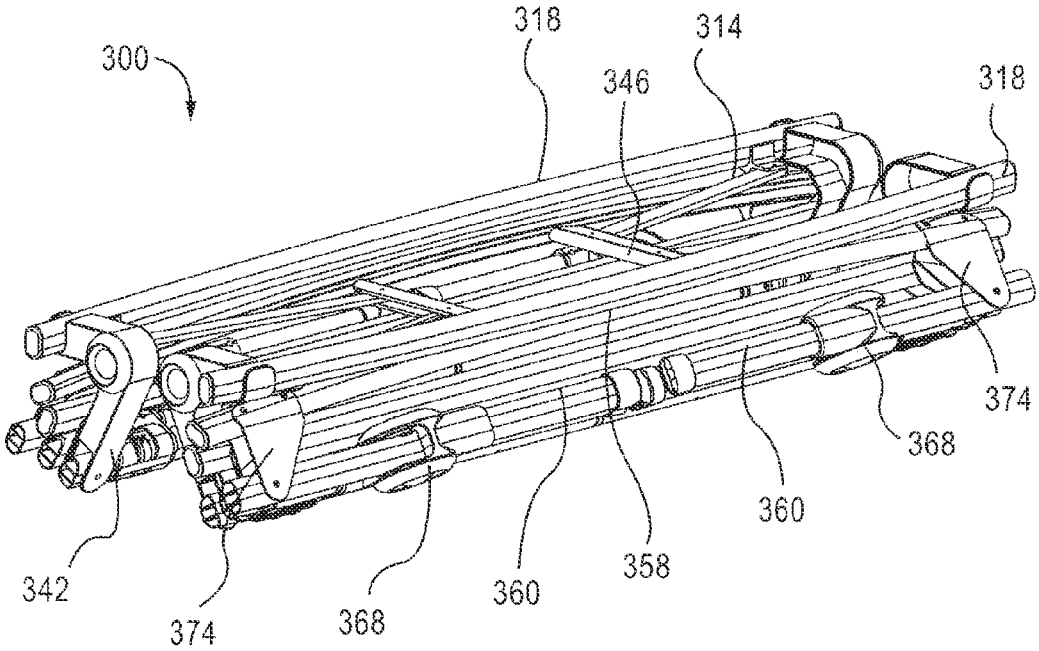
FIG. 24 is a perspective view of the picnic table frame shown in FIG. 16 in a fourth collapsed configuration.

In yet other embodiments, the table top 320 can be fixedly coupled to the frame portion 312 of the picnic table 300. In such embodiments, the table top 320 can be constructed either from an entirely pliable and/or flexible material or a partially flexible material configured to accommodate transitioning the picnic table 300 between its expanded configuration and its collapsed configuration. For example, in some embodiments, the table top can be constructed from a fabric and/or a mesh that easily folds when the lateral hinge members 346 are disposed inwardly as illustrated in FIG. 24. In other embodiments, the table top can include multiple rigid panels separated by flexible portions such that the table top folds in an accordion-like manner along the flexible portions when the lateral hinge members 346 are disposed inwardly.

In yet other embodiments, the table top can include pockets, clips and the like to provide additional functionality to the picnic table. For example, in some embodiments, a table top can include napkin clips configured to secure napkins or other light objects to the table top.

Similarly, in some embodiments, the bench seat 370 can be removably coupled to the longitudinal bench support members 358 via mating snaps, hook and latch fasteners, Velcro® connectors or the like. In this manner, the bench seat 370 can be removed to accommodate transitioning the picnic table 300 between its expanded configuration and its collapsed configurations, as described above. In other embodiments, the bench seat 370 can be fixedly coupled to one of the longitudinal bench support members 358 and removably coupled to the other longitudinal bench support member 358. In this manner, the bench seat 370 can be partially removed to accommodate transitioning the picnic table 300 between its expanded configuration and its collapsed configurations. For example, in some embodiments, a longitudinal bench support member can be configured to contain a bench seat in a similar fashion as described above with reference to the longitudinal support member 418 illustrated in FIG. 31.

In yet other embodiments, the bench seat 370 can be fixedly coupled to both longitudinal bench support members 358. In such embodiments, the bench seat 370 can be constructed either from an entirely flexible material or a partially flexible material configured to accommodate transitioning the picnic table 300 between its expanded configuration and its collapsed configuration. For example, in some embodiments, the bench seat can be constructed from a fabric and/or a mesh that easily folds when the support members 360, 362 are placed in the collapsed configuration as illustrated in FIG. 21. In other embodiments, the bench seat can include multiple rigid panels separated by flexible portions such that the bench seat in an accordion-like manner when the support members 360, 362 are placed in the collapsed configuration.

The frame members, which include the longitudinal support members, the lateral side members, the longitudinal bench support members and the like, can be constructed from aluminum, steel, plastic, fiberglass or any suitable material. In some embodiments, the frame members can have a solid cross-sectional area. In other embodiments, the frame members can be hollow tubes. In yet other embodiments, the cross-sectional shape of the frame members can be configured to have a moment of inertia that maximizes resistance to bending for a given frame weight. In still other embodiments, the frame members can include end caps to protect against the sharp edges which can be present.

Figure 32:
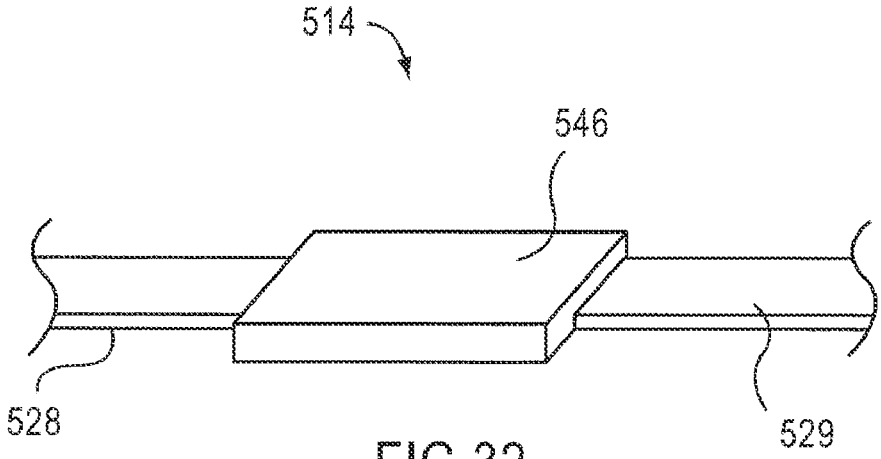
FIGS. 32 through 34 are perspective views of a portion of a lateral side member of a table according to an embodiment of the invention.
Figure 33:
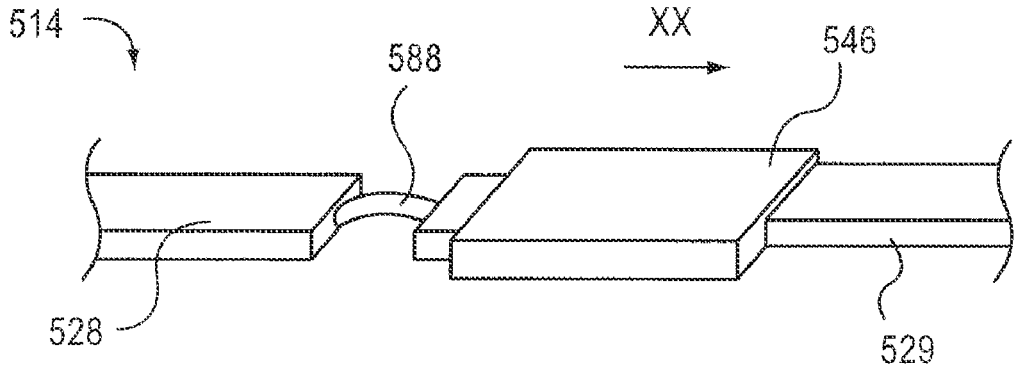
Figure 34:
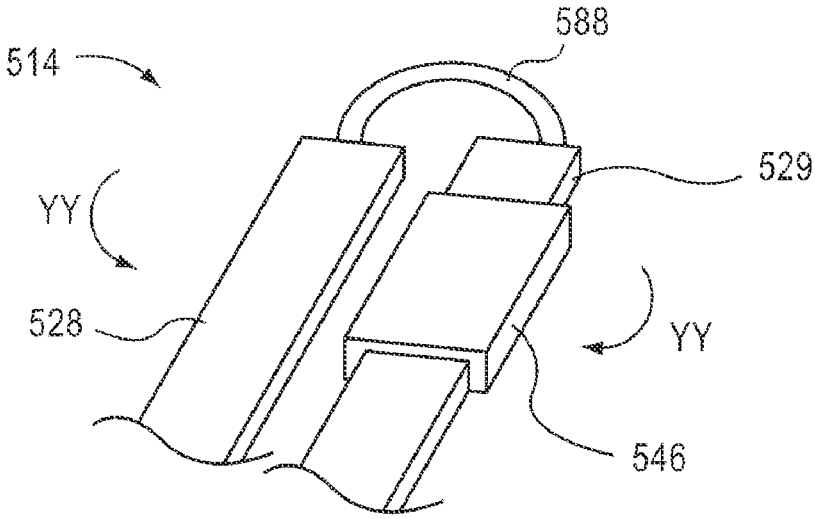

FIGS. 32 through 34 illustrate a portion of a lateral side member 514 according to an embodiment of the invention that does not require a lateral hinge member of the type shown and described in FIGS. 29 and 30. The lateral side member 514 includes a first portion 528 and a second portion 529 coupled to the first portion via a flexible elastic member 588. A rigid locking member 546 is slidably disposed on the first portion 528 and/or the second portion 529 of the lateral side member 514.

In use, lateral side member 514 can be retained in its expanded configuration by positioning the locking member 546 such that it contains a portion of the first portion 528 and the second portion 529 of the lateral side member 514. In this manner, the first portion 528 and the second portion 529 cannot be pivoted relative to each other. To place the lateral side member 514 in its collapsed configuration, the locking member 546 is positioned on the second portion 529 in the direction of arrow XX, thereby exposing the interface between the first portion 528 and the second portion 529 of the lateral side member 514. The first portion 528 and the second portion 529 can then be pivoted relative to each other, as shown by arrows YY, about an axis substantially normal to a plane defined by the top surface of the table (not shown), as indicated by the arrows in FIG. 34.

Although shown and described as being separate components, in some embodiments certain of the components can be monolithically formed. For example, in some embodiments, the hinge connectors can be monolithically formed with the longitudinal support members. In yet other embodiments, the components can be formed from separate components and coupled together as appropriate. For example, in some embodiments, the hinge connectors can be separate components coupled to the longitudinal support members via cap screws, rivets, welding, brazing, chemical bonding or any other suitable method.

Figure 35:
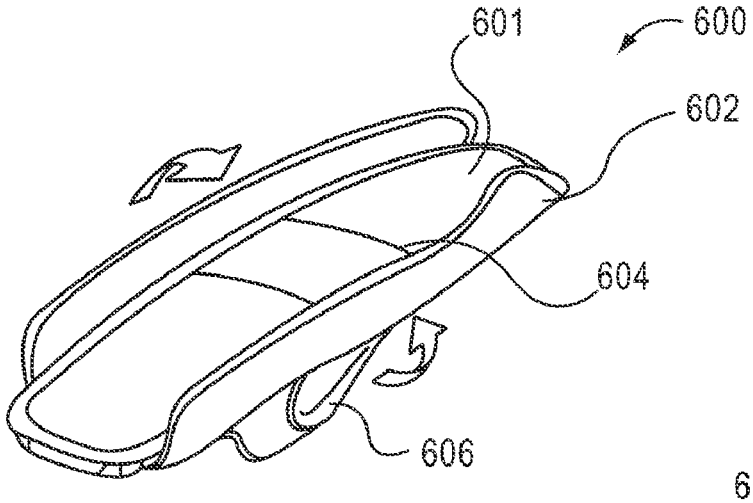
FIGS. 35 through 37 are perspective views of a table and a carrying case according to an embodiment of the invention.
Figure 36:
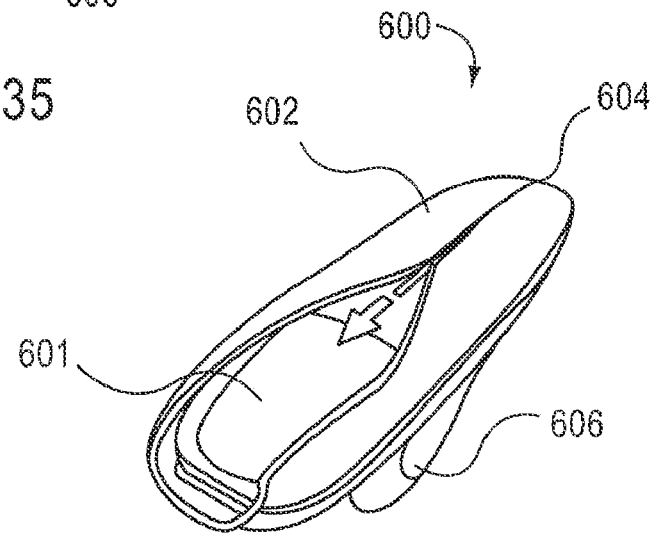
Figure 37:
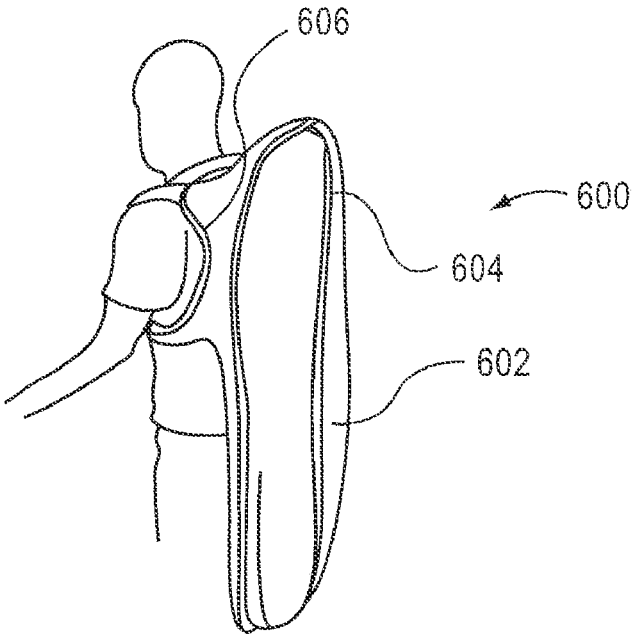

FIGS. 35 through 37 are perspective views of a picnic table kit 600 according to an embodiment of the invention that includes a picnic table 601 and a carrying case 602 configured to contain the picnic table 601 when the picnic table 601 is in its collapsed configuration. The picnic table 601 can be any portable picnic table, such as those described herein. As illustrated, carrying case 602 includes a zippered opening 604 through which the picnic table 601 can be disposed. The carrying case also includes shoulder straps 606 so that a user can carry the picnic table kit 600. Although illustrated as being a separate component, in some embodiments, the carrying case 602 can also serve as the table top of the picnic table 601.

Although the carrying case 602 is shown as being constructed from a pliable material, in other embodiments the carrying case can be any suitable container. For example, in some embodiments, a kit can include a table assembly configured to be contained within a rigid or partially rigid container when the table assembly is in a collapsed configuration.

Figure 38:
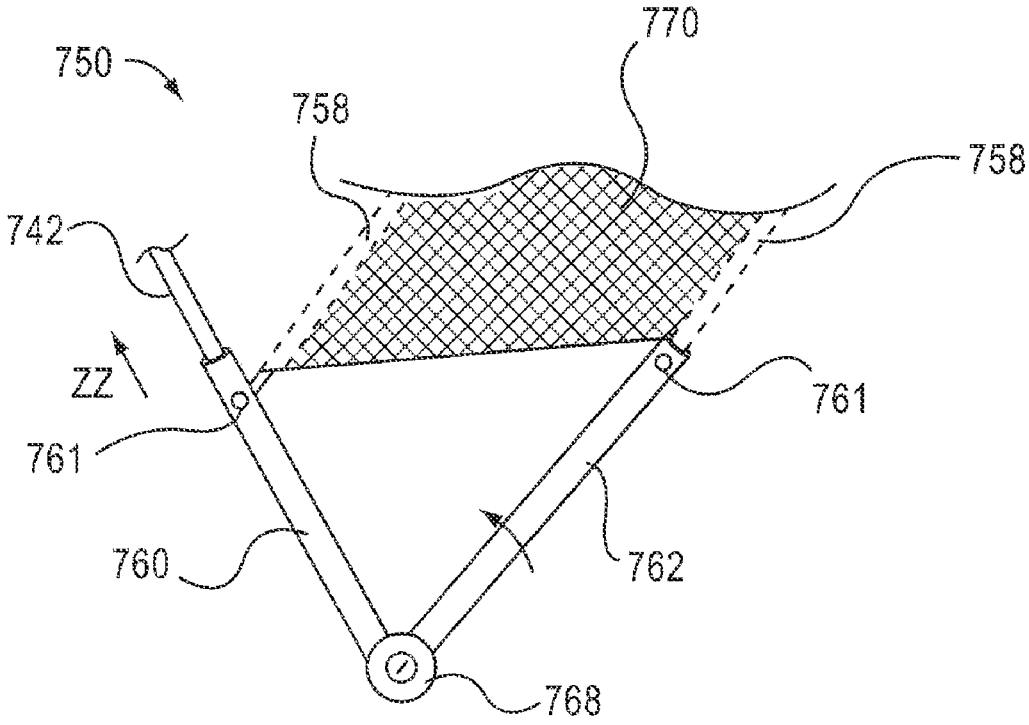
FIGS. 38 and 39 are perspective views of a portion of a bench of a picnic table according to an embodiment of the invention in an expanded configuration and a collapsed configuration, respectively.
Figure 39:
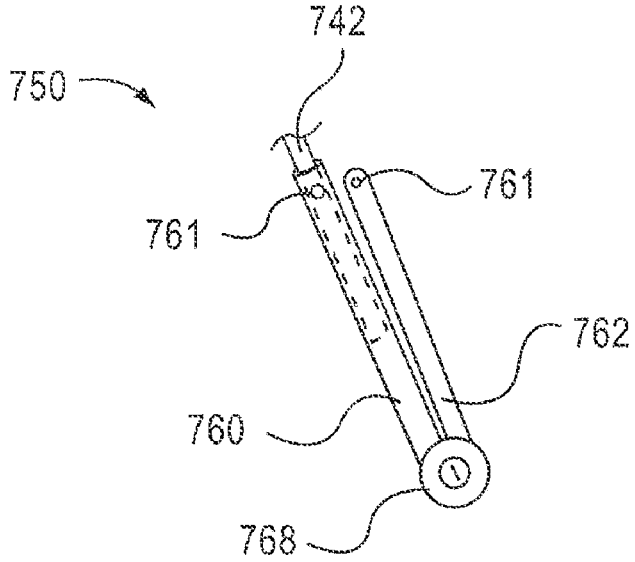

FIGS. 38 and 39 are perspective views of a portion of a bench 750 according to an embodiment of the invention in an expanded configuration and a collapsed configuration, respectively. The bench 750 includes two first support members 760, two second support members 762, two longitudinal bench support members 758 and a bench seat 770. Because the bench 750 is symmetrical, only one set of the support members 760, 762 is shown and described. As illustrated, the bench 750 is slidably coupled to a support leg 742 of a table (not shown).

The first support member 760 is pivotably coupled to the second support member 762 via connector 768, which is located at the lower end of the support members 760, 762. In some embodiments, the connector 768 can be configured to engage a support surface, such as the floor or the ground, by including, for example, feet of the type described above (not shown).

One of the bench support members 758 is removably coupled to the pair of first support members 760 (only one first support member 760 is shown) by disposing an end portion of the bench support member 758 into an opening 761 in the first support member 760. The other bench support member 758 is removably coupled to the pair of second support members 761 in a similar fashion. In this manner, the longitudinal bench support members 758 are positioned substantially parallel to a longitudinal axis of a picnic table to which the bench is coupled (not shown). Moreover, by configuring the longitudinal bench support members 758 to be removably coupled to the support members 760, 762, a connector, such as connector 374 described above, is not needed to couple pivotably the support members 760, 762 to the longitudinal bench support members 758.

When in the expanded configuration (FIG. 38), the first support member 760 is angularly offset from the second support member 762. As such, the longitudinal bench support members 758 are disposed apart from each other, thereby forming a suitable spacing to receive the bench seat 770. The bench seat 770 can be constructed from any suitable material and can be coupled to the longitudinal support members 758 in any suitable manner, as described above.

The bench 750 can be placed in its collapsed configuration (FIG. 39) by first removing the bench seat 770 and the longitudinal bench support members 758. The second support member 762 is then rotated relative to the first support member 760 about connector 768, as indicated by the arrow adjacent the second support member 762 in FIG. 24. As described above, in some embodiments, the connector 768 can include a locking mechanism to retain the support members 760, 762 in either the expanded configuration or the collapsed configuration, thereby preventing inadvertent changes in position. In some embodiments, for example, the connector 768 can include a detent, a ratcheting mechanism or the like to retain the support members 760, 762 in their desired positions.

The first support member 760 is then moved upwardly along the support leg 742 as indicated by the arrow ZZ adjacent the support leg 742 in FIG. 24. In this manner, a portion of the support leg 742 is disposed within the first support member 760, as indicated by the dashed lines in FIG. 25. By configuring support leg 742 to be telescopically disposed within the first support member 760, a connector, such as connection member 364 described above, is not needed to slidingly couple the first support members 760 to the support leg 742. In alternative embodiments, a table assembly can be configured such that the first support member 760 is telescopically disposed within the support leg 742. In some embodiments, the first support member 760 and/or the support leg 742 can include a locking mechanism configured to maintain the support leg within the first support member in a desired position. As described above, in some embodiments, the support leg 742 can be slidingly disposed within the first support member in several different positions.

In some embodiments, the first support member 760 can extend past the connector 768 such that a bottom portion (not shown) of the first support member 760 can contact a support surface; and the second support member 762 can likewise extend past connector 768 such that a bottom portion (not shown) of the second support member 760 can contact a support surface. For example, the first support member 760 and the second support member 762 can be in an intersecting relation to each other when in an expanded configuration similar to the first support member 360 and the second support member 362 of table assembly 300. In addition, the longitudinal bench support members 758 can alternatively be fixedly coupled to the first support member 760 and/or the second support member 762. In such an embodiment, the bench 750 can be moved to a collapsed configuration by rotating the second support member 762 relative to the first support member 760 about connector 768, as indicated by the arrow adjacent the second support member 762 in FIG. 24. The support surface 770 will then collapse or fold in a similar manner as bench seat 370 of table assembly 300.

Figure 40:
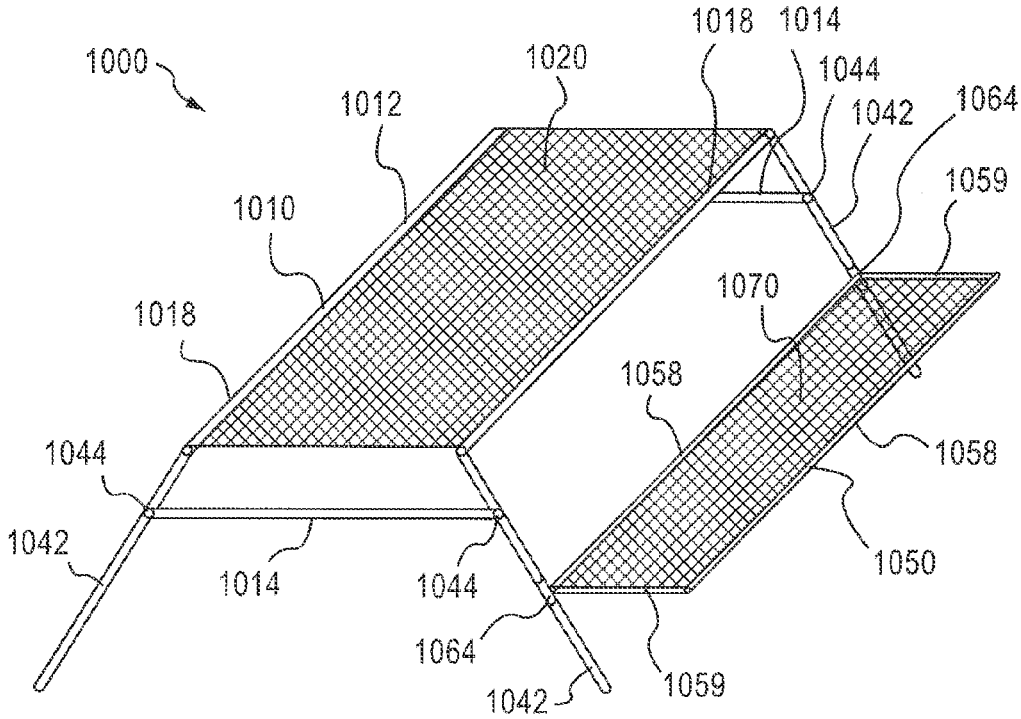
FIGS. 40-43 are schematic illustrations showing a perspective view of a table assembly according to an embodiment of the invention in an expanded configuration, a first collapsed configuration, a second collapsed configuration, a third configuration and a fourth collapsed configuration, respectively.

FIGS. 40 through 43 are schematic illustrations of a table assembly 1000 according to an embodiment of the invention in an expanded configuration, a first collapsed configuration, a second collapsed configuration and a third collapsed configuration, respectively. The table assembly 1000 includes a table 1010 and a bench 1050 coupled to the table 1010. The table 1010 includes a frame 1012, a pliable table top 1020 coupled to the frame 1012, and four support legs 1042 pivotably coupled to the frame 1012 via connectors 1044. The frame 1012 includes two longitudinal side members 1018 and two lateral side members 1014. As described in more detail herein, the lateral side members 1014 are removably coupled to the frame 1012. As shown in FIG. 40, when the table assembly 1000 is in the expanded configuration, the longitudinal side members 1018 are spaced apart from each other such that the table top 1020 is maintained in a taut condition.

The bench 1050 includes two longitudinal side members 1058, two lateral support members 1059, and a bench seat 1070. One of the longitudinal support members 1058 is coupled to each of the lateral side members 1059 via a pair of couplings 1064. Moreover, each of the couplings 1064 is slidably coupled to one the support legs 1042 of the table 1010. In this manner, the bench 1050 is movably coupled to the table 1010.

The lateral side members 1059 of the bench 1050 are each configured to have a adjustable length. For example, in some embodiments, the lateral side members 1059 of the bench 1050 are telescoping members. In this manner, the width of the bench 1050 can be adjusted to collapsed the table assembly 1000. Moreover, each of the lateral side members 1059 is rotatably coupled to the corresponding coupling 1064.

Figure 41:
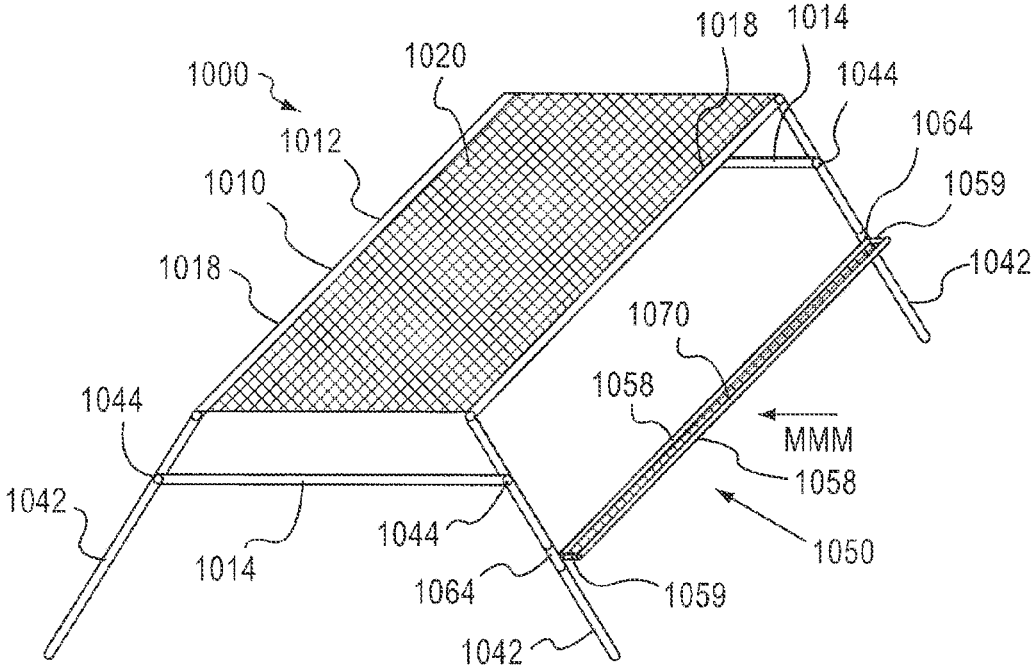
Figure 42:
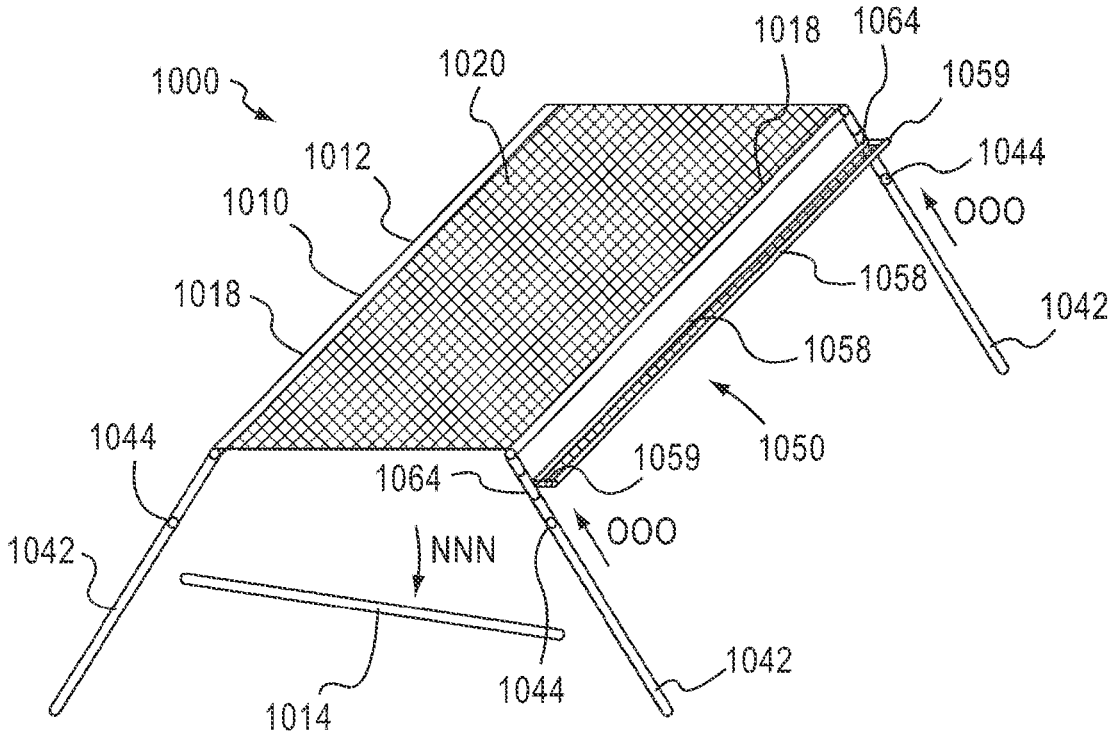

As shown in FIG. 41, the table assembly 1000 can be placed in its first collapsed configuration by decreasing the length of the lateral side members 1059 of the bench 1050, as shown by the arrow MMM. Said another way, the table assembly 1000 can be placed in its first collapsed configuration by moving the outer longitudinal support member 1058 of the bench 1050 towards the inner longitudinal support member 1058 of the bench 1050. In this manner, the width of the bench can be decreased.

The table assembly 1000 can be placed in its second collapsed configuration (FIG. 42) by first removing the lateral side members 1014 from the support legs 1042 and then sliding the couplings 1064 upwardly along the support legs 1042, as shown by the arrows NNN and OOO, respectively. In this manner, the longitudinal side members 1058 of the bench 1050 are disposed adjacent to and substantially parallel to the longitudinal side members 1018 of the table 1010. When the table assembly 1000 is in the second collapsed configuration, the couplings 1064 are positioned above the connectors 1044 to allow the support legs 1042 to be freely rotated relative to the longitudinal side members 1058 of the bench 1050 and the longitudinal side members 1018 of the table 1010. Although the lateral side members 1014 are shown and described as being removable from the table 1010, in other embodiments, the lateral side members 1014 can be pivotably coupled to one of the support legs 1042 such that the table assembly 1000 can be placed in its second collapsed configuration by first rotating the lateral side members 1014 relative to the support legs 1042 such that the lateral side members 1014 are substantially parallel to the longitudinal side members 1018 of the table 1010.

Figure 43:
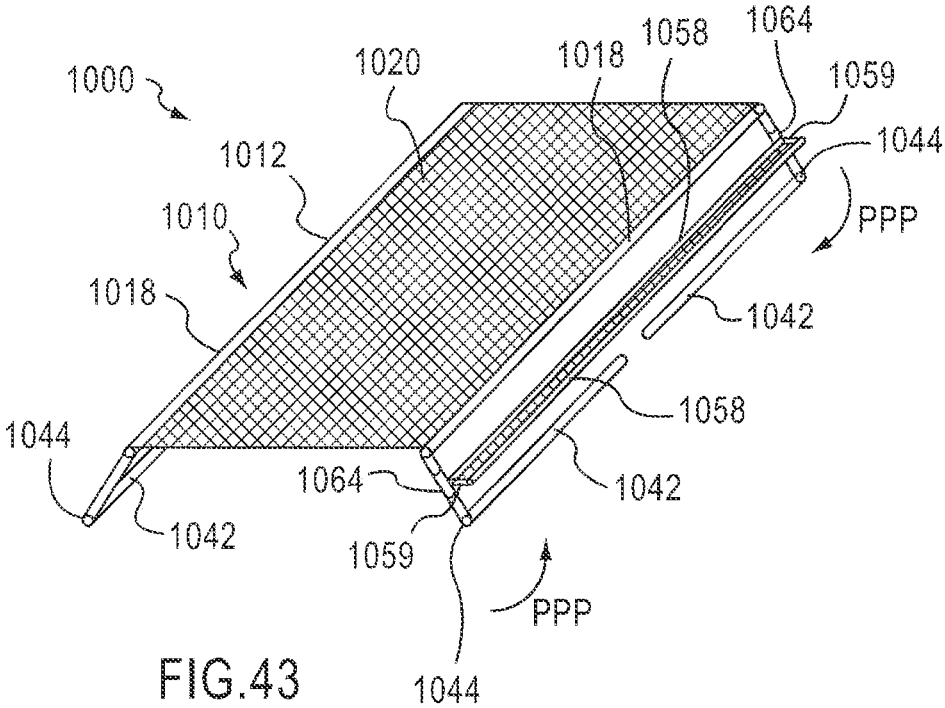

As shown in FIG. 43, the table assembly 1000 can be placed in its third collapsed configuration by rotating the support legs 1042 relative to the longitudinal side members 1018 of the table 1010, as shown by the arrow PPP. The support legs 1042 can be rotated via the connectors 1044, which can be any suitable pivot connector of the types shown and described herein. In this manner, the support legs 1042 can be rotated relative to the longitudinal side members 1058 of the bench and the longitudinal side members 1018 of the table 1010 about an axis normal to a longitudinal axis of the longitudinal side members 1058 and/or the longitudinal side members 1018.

The picnic table 1000 can be placed in its fourth collapsed configuration (not shown in FIGS. 40-43) by placing the lateral side members 1014 of the table 1010 on the table top 1020 such that they are substantially parallel to the longitudinal side members 1058 and/or the longitudinal side members 1018. The longitudinal side members 1058 and the longitudinal side members 1018 can then be collectively rolled up within the pliable table top 1020.

Although the picnic table 1000 is shown and described as having two lateral side members 1014 removably coupled to the support legs 1042, in other embodiments, a picnic table can have any suitable type and number of lateral side members. For example, FIGS. 44-47 show a table assembly 1100 according to an embodiment of the invention. The table assembly 1100 is similar to the picnic table 300 shown and described above with reference to FIGS. 16-30, therefore a description of the entire structure and function of the table assembly 1100 is not presented below. As described below, the table assembly 1100 differs from the picnic table 300 in that the table assembly 1100 includes four lateral side members (labeled as lateral side members 1114 and 1114'), whereas the picnic table 300 includes two lateral side members 314.

The table assembly 1100 includes a table 1110 and two benches 1150 coupled to the table 1100. The table 1110 includes a frame 1112, a pliable table top (not shown in FIGS. 44-47) coupled to the frame 1112. The frame 1112 includes two longitudinal side members 1118, two upper lateral side members 1114, two lower lateral side member 1114', and four support legs 1142. The two longitudinal side members 1118 are positioned substantially parallel to each other, similar to the longitudinal side members 318 shown and described above. The two upper lateral side members 1114 are similar to the lateral side members 314 shown and described above, and are pivotably coupled to the longitudinal side members 1118. The two lower lateral side members 1114' are removably coupled to the support legs 1142 by connectors 1164.

Each bench 1150 includes two support sub-assemblies (not labeled in FIGS. 44-47), two longitudinal bench support members 1158, and a bench seat (not labeled in FIGS. 44-47). Similar to the benches 350 shown and described above, each bench 1150 is slidably coupled to the support legs 1142 by connectors 1164.

Figure 44:
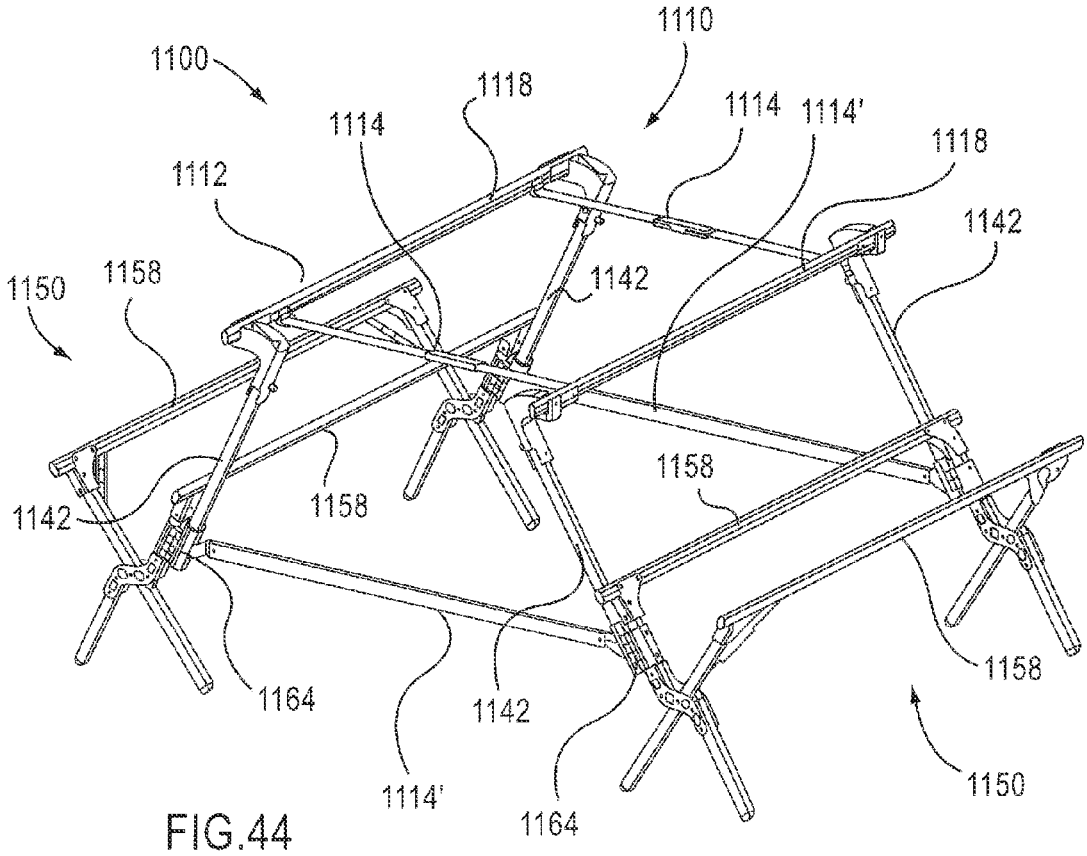
FIG. 44 is a perspective of a table assembly according to an embodiment of the invention in an expanded configuration.
Figure 45:
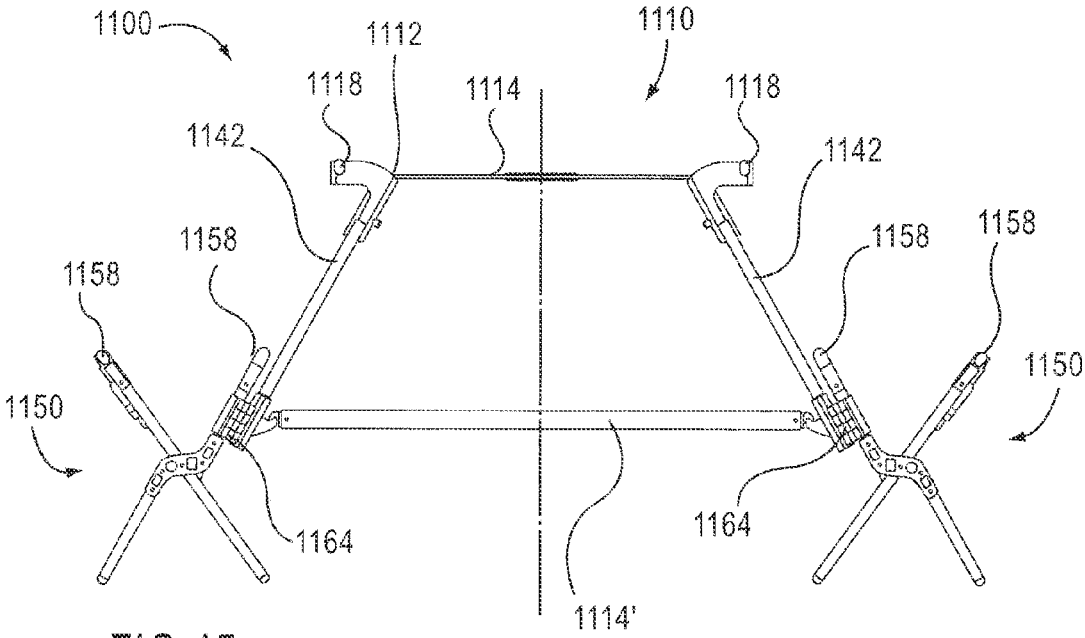
FIGS. 45 and 46 are front and top views, respectively of the table assembly shown in FIG. 44 in the expanded configuration.
Figure 46:
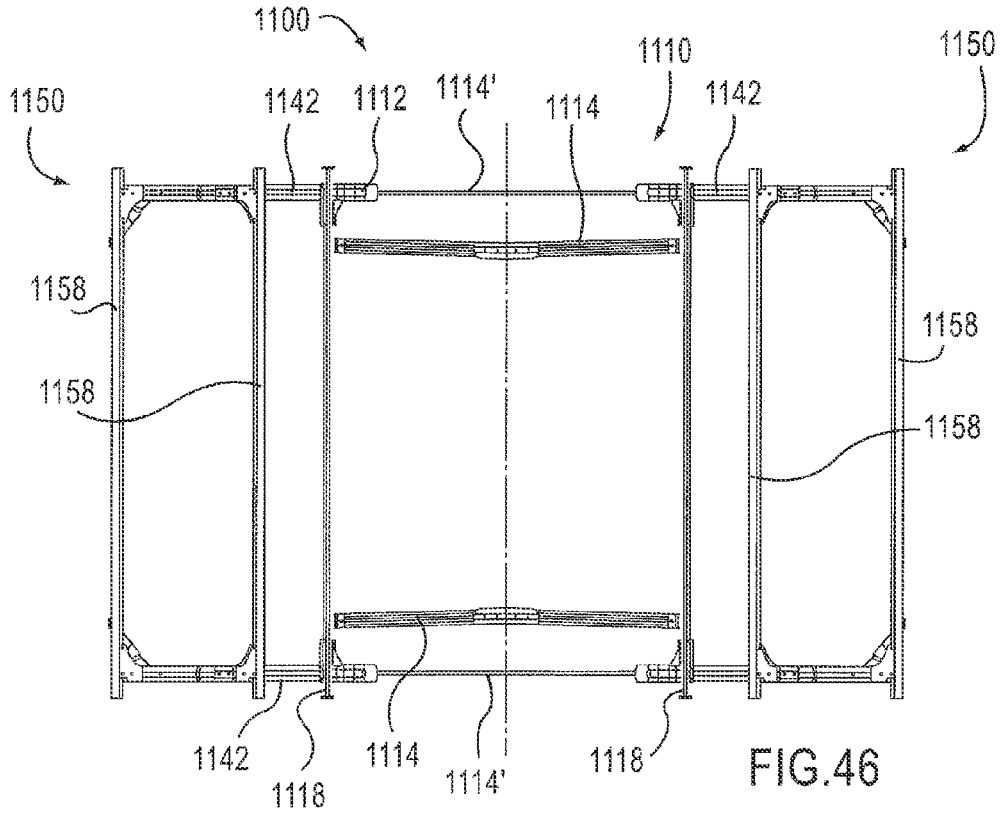

When the table assembly 1100 is in the expanded configuration, as shown in FIGS. 44 through 46, the two lower lateral side members 1114' are coupled to the support legs 1142 such that the two lower lateral side members 1114' are substantially parallel to the two upper lateral side members 1114. In this manner, the two lower lateral side members 1114' can provide structural support to the table frame 1112.

Figure 47:
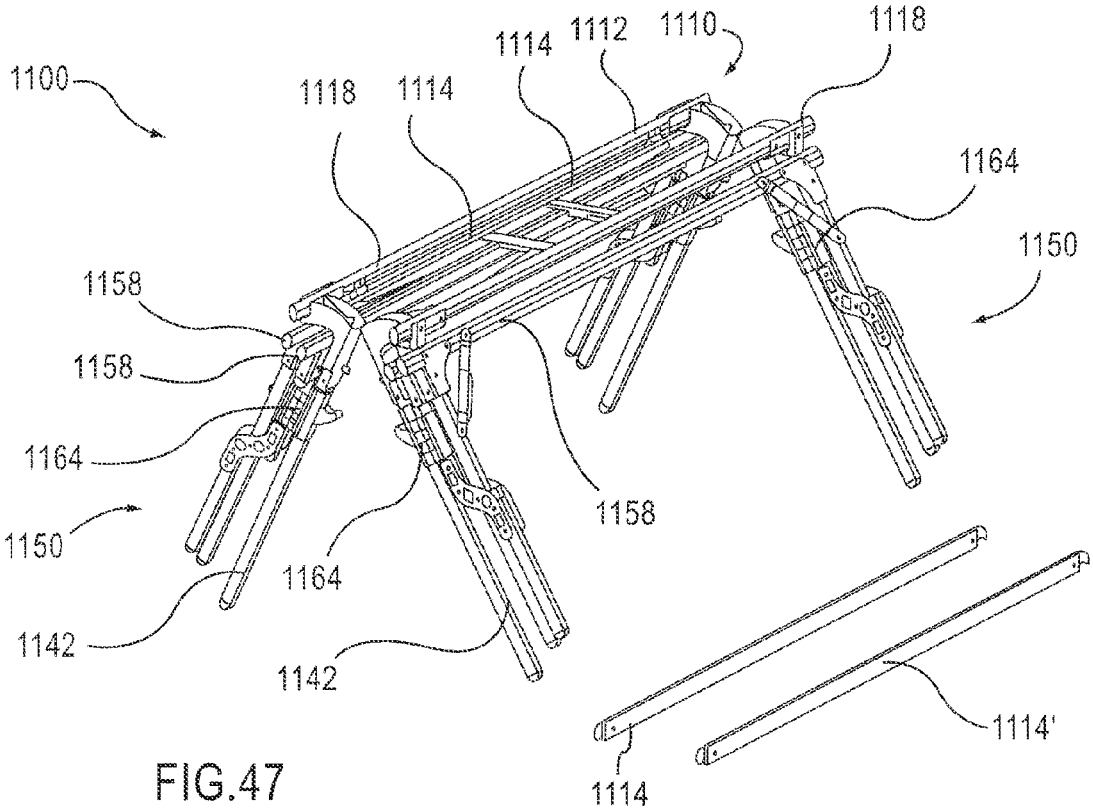
FIG. 47 is a perspective view of the table assembly shown in FIG. 44 in a collapsed configuration.

The table assembly 1100 can be placed in a collapsed configuration by first removing the two lower lateral side members 1114' from the support legs 1042, as shown in FIG. 47. The table assembly 1100 can then be placed in one or more different collapsed configurations in a similar manner as described above with reference to picnic table 300.

Figure 48:
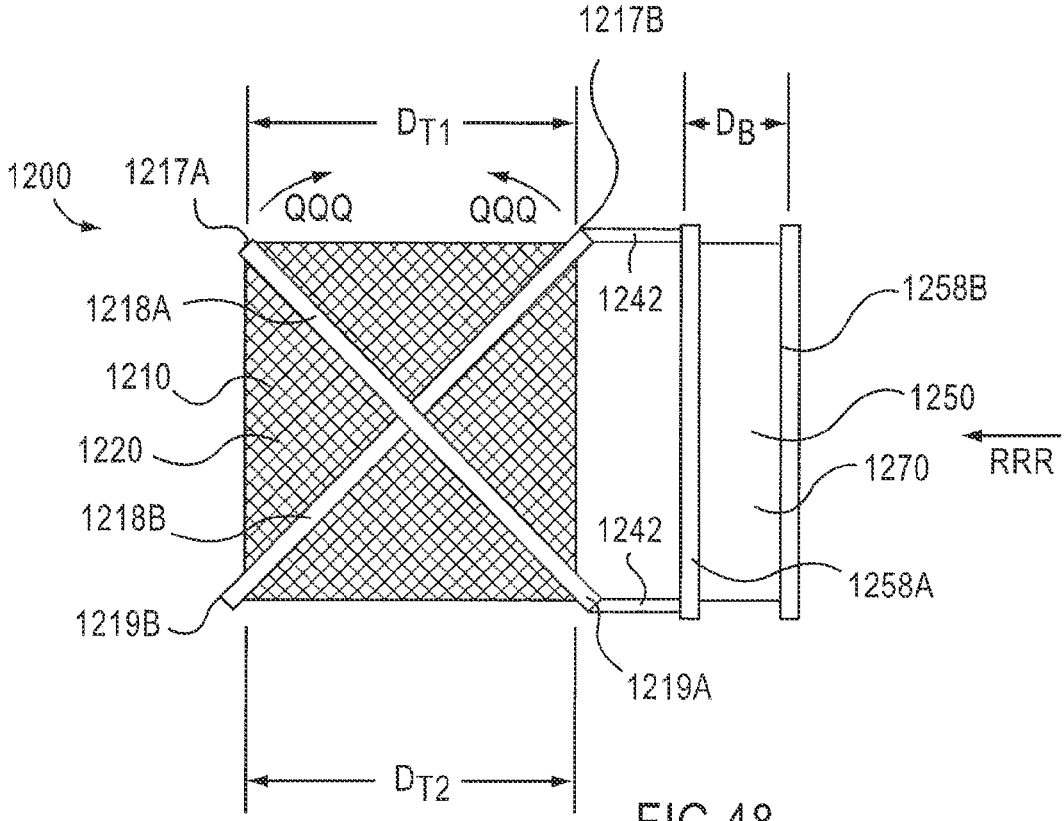
FIGS. 48 and 49 are schematic illustrations showing a top view of a table assembly according to an embodiment of the invention in a first configuration and a second configuration, respectively.
Figure 49:
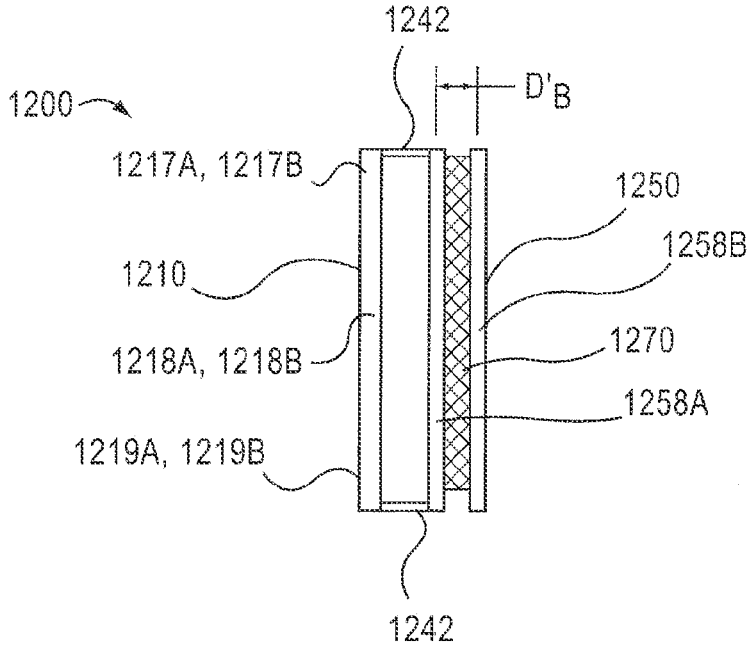

Although the first longitudinal side member 818A is shown in FIGS. 3 and 4 as being parallel to the second longitudinal side member 818B when the table assembly 800 is in the first configuration and the second configuration, in other embodiments, the orientation of a first longitudinal side member relative to a second longitudinal side member can change when a table assembly is moved from a first configuration to a second configuration. Moreover, although the longitudinal side members shown and described above are disposed on a side of the table, in other embodiments, a table assembly can include a longitudinal side member that is disposed apart from the side of the table when in one or more configurations. For example, FIGS. 48 and 49 are schematic illustrations showing a top view of a table assembly 1200 according to an embodiment of the invention in a first configuration and a second configuration, respectively. The table assembly 1200 includes a table 1210 and a bench 1250 coupled to the table 1210 by two support members 1242. The table 1210 includes a first side member 1218A, a second side member 1218B, and a table top 1220. The first side member 1218A has a first end portion 1217A and a second end portion 1219A. Similarly, the second side member 1218B has a first end portion 1217B and a second end portion 1219B. The table top 1220 is coupled to the first side member 1218A and the second side member 1218B such that when the table assembly 1200 is in the first configuration (FIG. 48), the table 1210 can provide a suitable surface for eating, working or the like.

The bench 1250 includes a first side member 1258A, a second side member 1258B and a bench seat 1270. The bench seat 1270 is coupled to the first side member 1258A and the second side member 1258B such that when the table assembly 1200 is in the first configuration, the bench 1250 can provide a suitable surface upon which a person can sit.

When the table assembly 1200 is in the first configuration, as shown in FIG. 48, the first side member 1218A is non-parallel to the second side member 1218B. Moreover, the first side member 1218A intersects the second side member 1218B at approximately the mid-point of the first side member 1218A and the mid-point of the second side member 1218B. Said another way, the first end 1217A of the first side member 1218A is spaced apart from the first end 1217B of the second side member 1218B by a first distance $D_{T1}$ and the second end 1219A of the first side member 1218A is spaced apart from the second end 1219B of the second member 1218B by a second distance $D_{T2}$, which is the same as the first distance $D_{T1}$. In other embodiments, the second distance $D_{T2}$ can be different from the first distance $D_{T1}$. When the table assembly 1200 is in the first configuration, the first bench side member 1258A is spaced apart from the second bench side member 1258B by a distance $D_B$.

In some embodiments, the distance $D_B$ can be different than the distance $D_{T1}$ and/or the distance $D_{T2}$. Although the distance $D_{T1}$, the distance $D_{T2}$ and the distance $D_B$ are shown as being measured in a horizontal direction (i.e., within a plane defined by the table top 1220), in some embodiments, the distance $D_{T1}$, the distance $D_{T2}$ and/or the distance $D_B$ can be measured in any suitable direction.

The table assembly 1200 can be moved to the second configuration by rotating the first side member 1218A relative to the second side member 1218B, as shown by the arrows QQQ in FIG. 48, and by moving the second bench side member 1258B relative to the first bench side member 1258, as shown by the arrow RRR in FIG. 48. When the table assembly 1200 is in the second configuration, as shown in FIG. 49, the first side member 1218A is substantially parallel to the second side member 1218B. Said another way, the first end 1217A of the first side member 1218A is aligned with the first end 1217B of the second side member 1218B and the second end 1219A of the first side member 1218A is aligned with the second end 1219B of the second member 1218B. When the table assembly 1200 is in the second configuration, the first bench side member 1258A is spaced apart from the second bench side member 1258B by a distance $D'_B$ less than the distance $D_B$. In this manner, the overall distance between the second side member 1218B of the table 1210 and the second bench side member 1258B, which can, for example, represent the width of the table assembly 1200, is less when the table assembly 1200 is in the second configuration than when the table assembly 1200 is in the first configuration.

Although not shown in FIGS. 48 and 49, in some embodiments the bench 1200 can be slidably coupled to the support members 1242, such that the height of the table assembly 1200 can be changed when moving between the first configuration and the second configuration, in a similar manner as shown and described above with reference to FIGS. 5-7. Similarly, although the first side member 1218A and the second side member 1218B are shown as being aligned when the table assembly 1200 is in the second configuration, in some embodiments, the first side member 1218A and the second side member 1218B can be parallel to each other, but spaced apart from each other from the perspective of the top view when the table assembly 1200 is in the second configuration.

Figure 50:
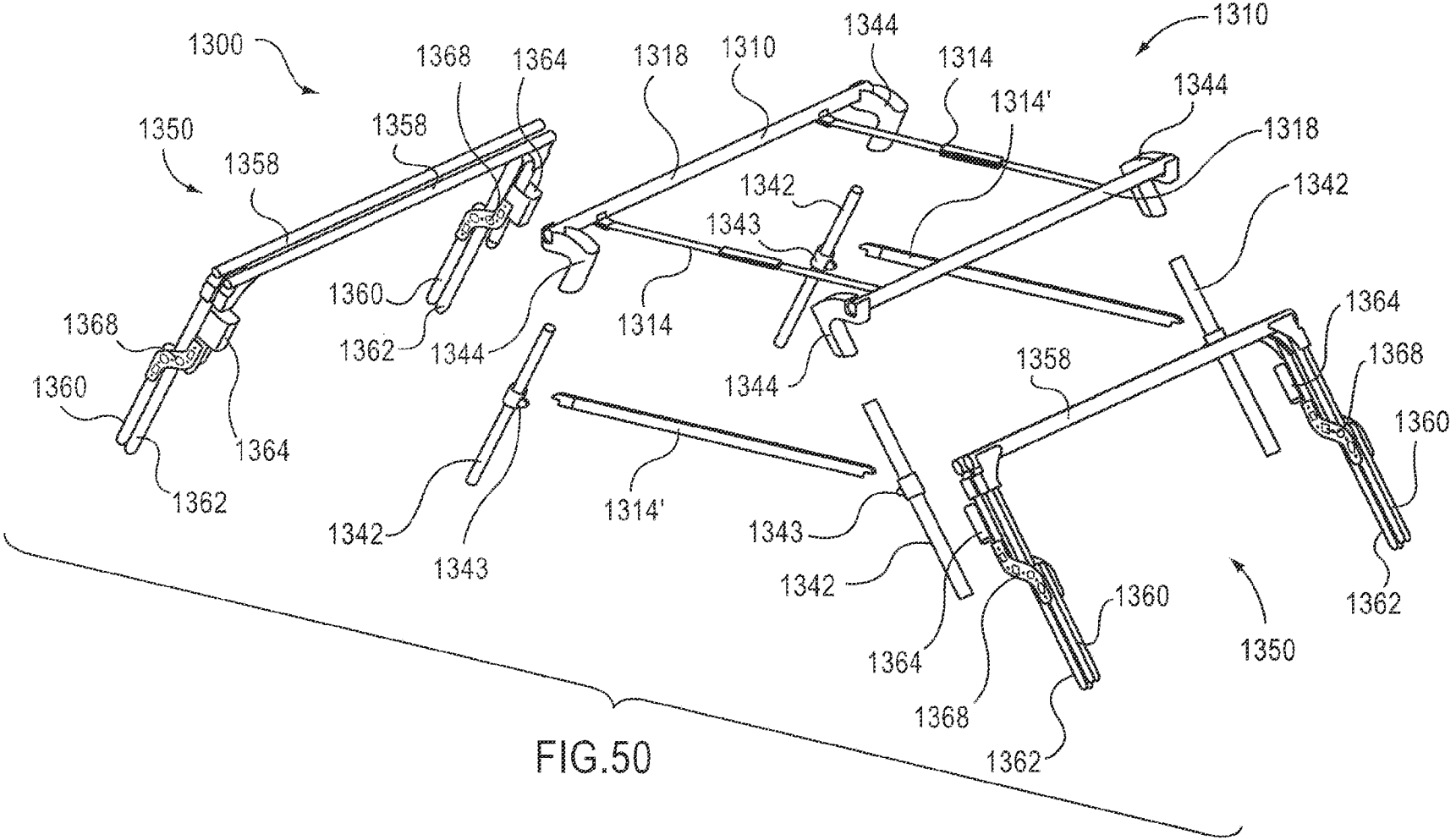
FIG. 50 is an exploded perspective view of a table assembly according to an embodiment of the invention in a partially expanded configuration.
Figure 51:
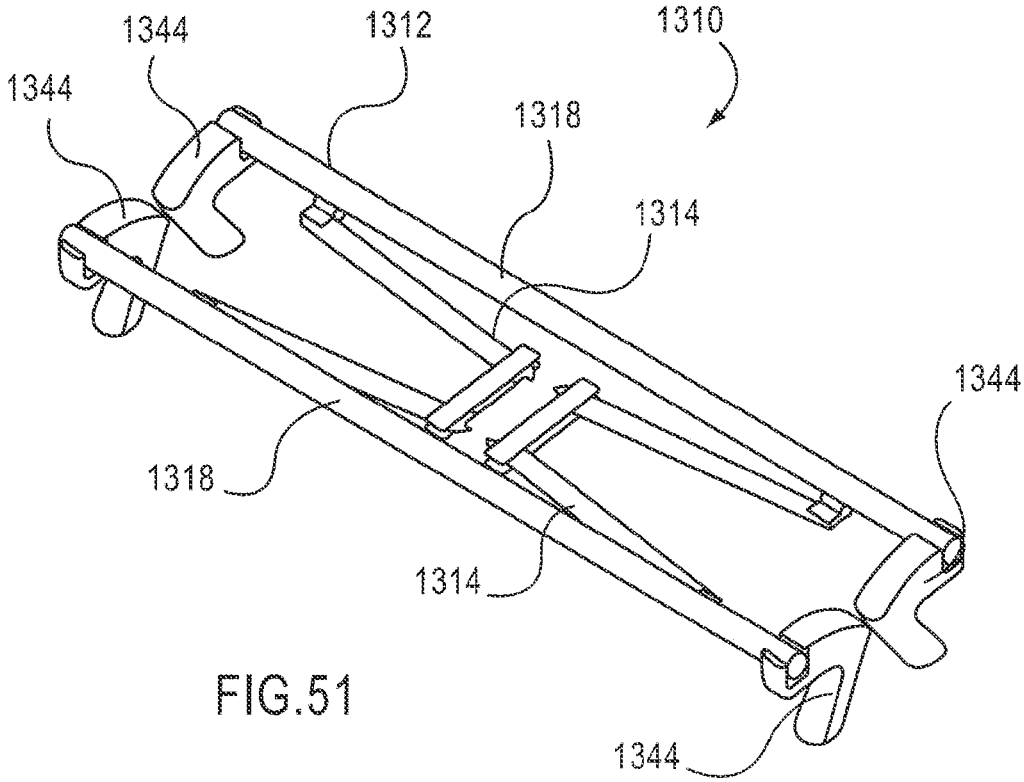
FIG. 51 is a perspective view of a table of the table assembly shown in FIG. 50 in a collapsed configuration.
Figure 52:
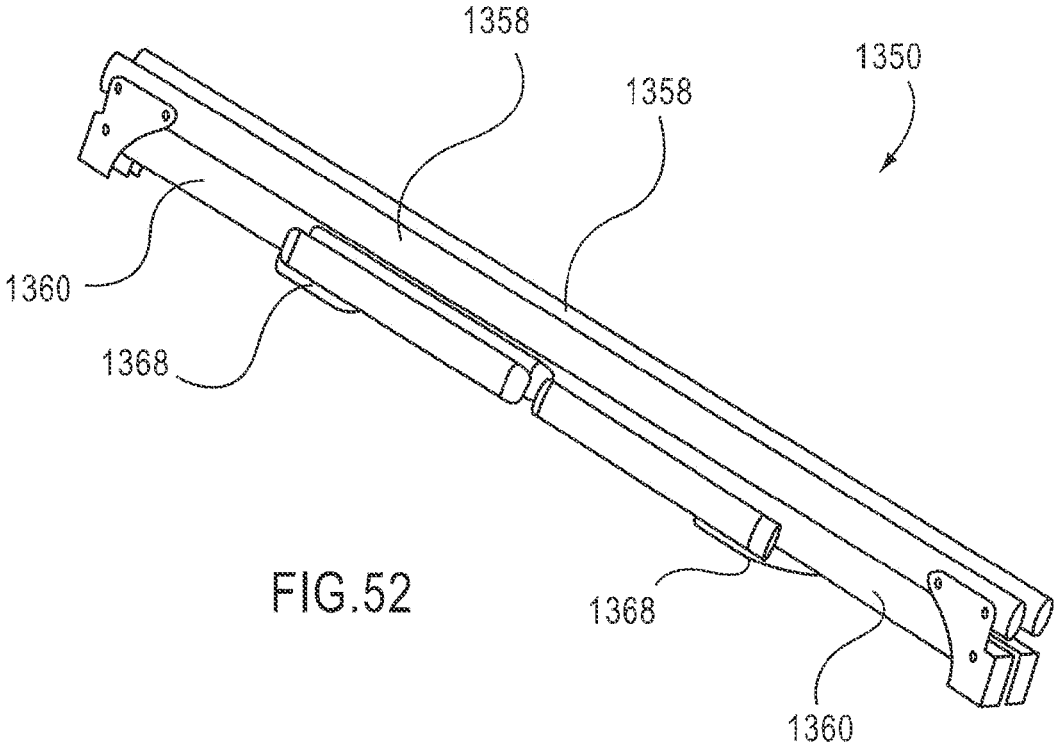
FIG. 52 is a perspective view of a bench of the table assembly shown in FIG. 50 in a collapsed configuration.
Figure 53:
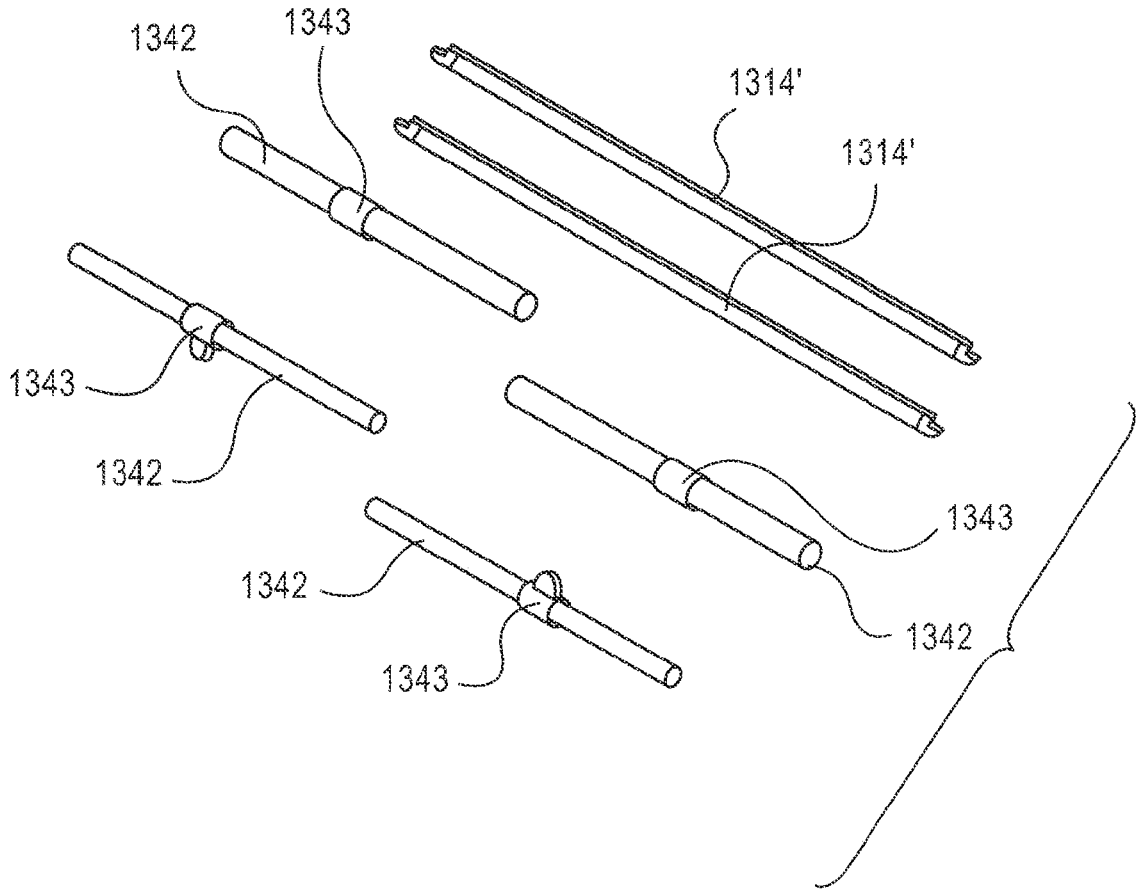
FIG. 53 is a perspective view of a portion the table assembly shown in FIG. 50 in a collapsed configuration.

Although the picnic table 300 shown and described above includes four support members 342 pivotably coupled to the table frame 312, in other embodiments a table assembly can include one or more support members removably coupled to a portion of a table. Similarly, although the picnic table 300 shown and described above includes two benches 350 slidably coupled to the support members 342 of the table, in other embodiments, a table assembly can include one or more benches removably coupled to a table. In this manner, the bench and/or the support members can be removed when the table assembly is moved between an expanded configuration and one or more collapsed configurations. For example, FIGS. 50-53 show a table assembly 1300 according to an embodiment of the invention. FIG. 50 shows an exploded perspective view of the table assembly 1300 in a partially expanded configuration. FIGS. 51-53 show portions of the table assembly 1300 in their respective collapsed configurations. The table assembly 1300 is similar to the picnic tables 300 and 1100 shown and described above with reference to FIGS. 16-30 and 44-47, respectively, therefore a description of the entire structure and function of the table assembly 1300 is not presented below.

The table assembly 1300 includes a table 1310 and two benches 1350 removably coupled to the table 1310. The table 1310 includes a frame 1312, four support legs 1342, and a pliable table top (not shown in FIGS. 50-53) coupled to the frame 1312. The frame 1312 includes two longitudinal side members 1318 and two upper lateral side members 1314. The two longitudinal side members 1318 are positioned substantially parallel to each other, similar to the longitudinal side members 318 and 1118 shown and described above. The two upper lateral side members 1314 are similar to the lateral side members 314 and 1114 shown and described above, and are pivotably coupled to the longitudinal side members 1318.

As shown in FIG. 50, an upper end portion of each of the support legs 1342 is removably coupled to the longitudinal side members 1318 by connectors 1344. Similarly, a lower end portion of each of the support legs 1342 is removably coupled to one of the benches 1350 by connecting members 1364. In some embodiments, the connectors 1344 and/or the connecting members 1364 can include a locking mechanism (not shown in FIGS. 50-53) to releasably lock the support legs 1342 to the connectors 1344 and/or the connecting members 1364, respectively. Each of the support legs 1342 includes a connector 1343 configured to removably couple a lower lateral side member 1314' between two adjacent support legs 1342.

Each bench 1350 includes two support sub-assemblies (not labeled in FIGS. 44-47), two longitudinal bench support members 1358, and a bench seat (not labeled in FIGS. 44-47). Similar to the benches 350 shown and described above, each support sub-assembly includes two first support members 1360 and two second support members 1362. Each of the first support members 1360 is pivotably coupled to one of the second support members 1362 via connector 1368. An upper end portion of each of the first support members 1360 includes a connecting member 1364. As described above, the lower end portion of each of the support legs 1342 is removably coupled to one of the benches 1350 by connecting members 1364. In this manner, the benches 1350 can be removed from the table 1310 to facilitate collapsing the table assembly 1300 and/or for use apart from the table 1310 (e.g., for use as a portable sideline bench).

When the table assembly 1300 is in the expanded configuration or the partially expanded configuration, as shown in FIG. 50, the two lower lateral side members 1314' can be coupled to the support legs 1342 such that the two lower lateral side members 1314' are substantially parallel to the two upper lateral side members 1314. In this manner, the two lower lateral side members 1314' can provide structural support to the table frame 1312.

The table assembly 1300 can be placed in one or more collapsed configurations by removing the benches 1350 from the connecting members 1364 and/or moving the benches to one or more collapsed configurations (see e.g., FIGS. 50 and 53), in a manner similar to that described above with reference to benches 350. The two lower lateral side members 1314' can be removed from the support legs 1342, as shown in FIG. 52. Similarly, the support legs 1342 can be removed from the table frame 1312, as shown in FIG. 52. As shown in FIG. 53, the table assembly 1300 can then be placed in one or more different collapsed configurations in a similar manner as described above with reference to picnic table 300. After the table assembly 1300 is in its collapsed configuration, the components of the table assembly 1300 can be aligned (e.g., the lower lateral side members 1314' and/or the support legs 1342 can be positioned substantially parallel to the benches 1350 and/or the table 1310) such that the table assembly can be easily stored and/or placed in a container similar to the carrying case 602 shown and described above with reference to FIGS. 35-37.

Figure 54:
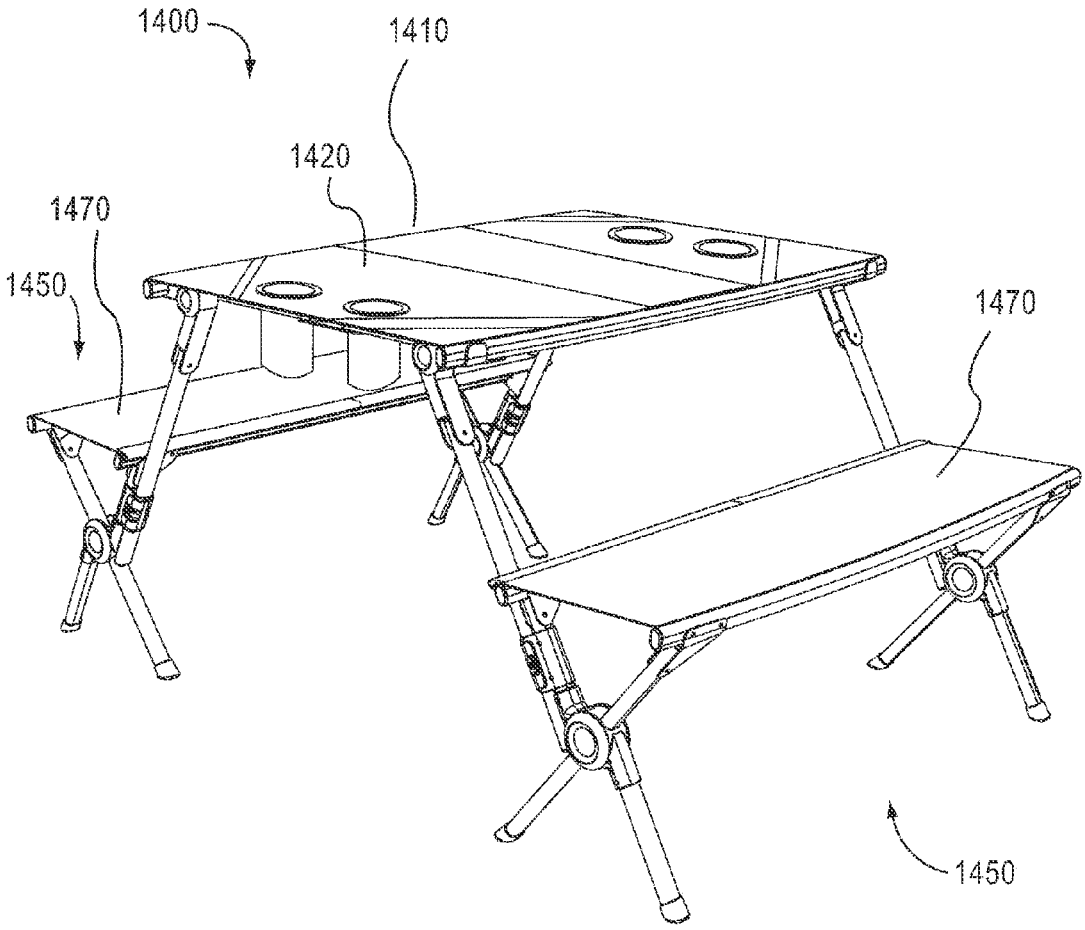
FIGS. 54-56 are a perspective view, a top view, and a side view of a table assembly according to an embodiment of the invention in an expanded configuration.
Figure 55:
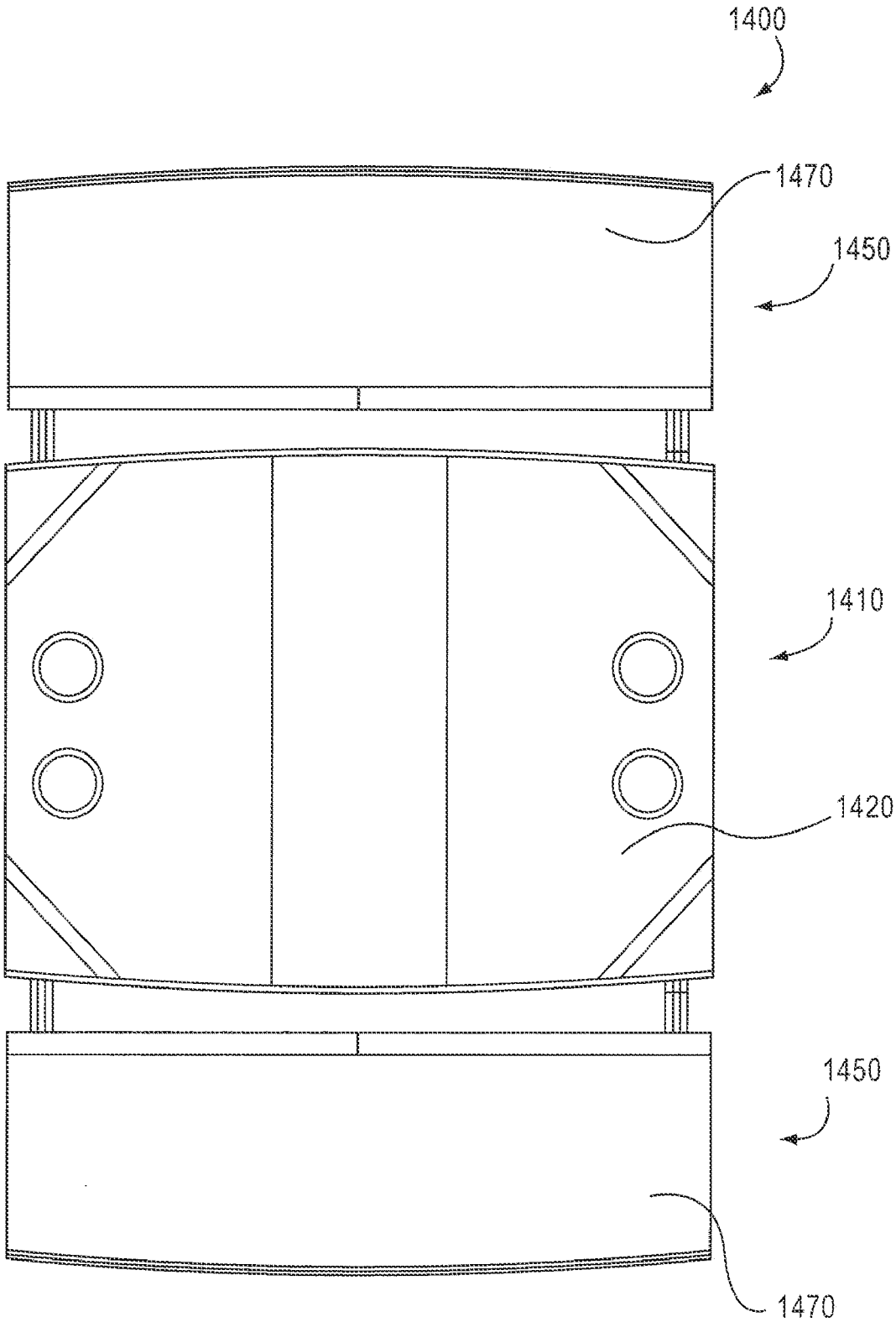
Figure 56:
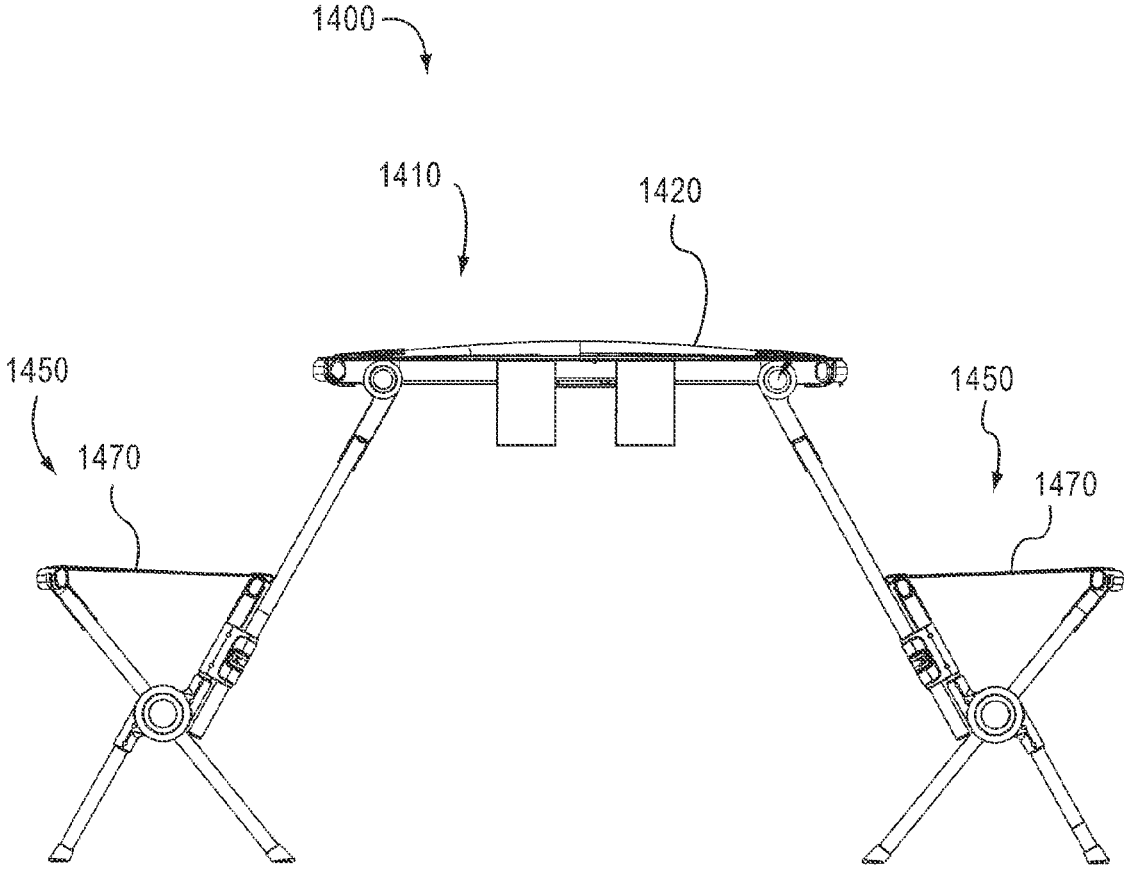

FIGS. 54-56 show a table assembly 1400 according to an embodiment of the invention in an expanded configuration. The table assembly 1400 is similar to the picnic tables 300, 1100 and 1300 shown and described above therefore a description of the entire structure and function of the table assembly 1400 is not presented below. The table assembly 1400 includes a table 1410 and two benches 1450 movably coupled to the table 1410. The table 1410 includes a pliable table top 1420, as shown. Each bench 1450 includes a bench seat 1470, as shown.

While various embodiments of the invention have been described above, it should be understood that they have been presented by way of example only, and not limitation. For example, although the picnic tables above are shown and described as being movable between an expanded configuration and a collapsed configuration in a series of operations occurring in a particular order, in some embodiments, certain operations can be completed in an order that is different from that shown and described above.

Although the table assemblies above have been described as having benches having only two longitudinal bench support members configured to support the bench seat, in some embodiments, a bench can include a lateral bench support member configured to pivot about an axis substantially normal to a plane defined by the top surface of the table.

Although the table assemblies above have been described as having one or more benches each including two longitudinal bench support members, in some embodiments, a table assembly can include a bench having only a single longitudinal bench support member. In other embodiments, a table assembly can include a bench devoid of any longitudinal bench support portions. In yet other embodiments, the table assembly can include a bench having no longitudinal bench supports portions but include lateral support portions.

Although the table assemblies are shown and described above as having an expanded configuration in which the bench has a length substantially equal to a length of the table, in some embodiments, a table assembly can include a bench having a length different than the length of the table when the table assembly is in the expanded configuration. For example, in some embodiments, a table assembly can include at least one bench have a length less than the length of the table assembly. In other embodiments, a table assembly can have multiple benches disposed adjacent one side of the table, each bench having a length less than the length of the table assembly. Such benches can be, for example, configured to provide a surface upon which a single user (rather than multiple users) can sit.

Although the table assemblies above have been described as having two lateral side members coupled to two longitudinal side members, in other embodiments, a table assembly can include a single lateral side member in combination with two longitudinal side members, a single lateral side member in combination with one longitudinal side member, or one or more longitudinal side members without any lateral side members. In other embodiments, the lateral side members can be coupled to a portion of the table assembly other than the longitudinal side members, such as, for example, the support legs and/or benches. In yet other embodiments, the longitudinal side members can be coupled to a portion of the table assembly other than the lateral side members, such as, for example, the support legs and/or benches. In yet other embodiments, a table assembly can include two lateral side members without any longitudinal side members. In such embodiments, the lateral side members can be coupled to the support legs and/or benches of the table assembly.

Although the table assemblies above have been described as having lateral side members that are configured to pivot about a central portion thereof, in other embodiments, a table assembly can include a lateral side member configured to pivot about an end portion thereof. In yet other embodiments, a table assembly can include a lateral side member configured to pivot about several locations along the lateral side member. In yet other embodiments, a table assembly can include a lateral side member configured to maintain a constant angular relationship with the longitudinal side members.

Although the locking member 366 is shown and described as being a spring-biased pin, in some embodiments, the locking member 366 can be any suitable mechanism configured to releasably lock the support leg 342 of the table 310 to the connecting member 364. For example, in some embodiments, the locking member can be a protrusion on the connecting member 364 configured to removably engage one or more openings in the support leg 342. Such openings can be, for example, slots, grooves, through-holes, detents or any suitable structure configured to retain a feature of the locking member 366 such that the bench 350 can be retained in its desired configuration. In other embodiments, the locking member is an eccentric member configured to produce an interference fit with a portion of the support leg 342 when engaged.

Similarly, although the connection member 364 is illustrated and described as allowing the first support member 360 to be slidably disposed in two positions along the support leg 342, in some embodiments the first support member 360, and therefore the bench 350 can be disposed along the support leg 342 in any number of positions. In this manner, the height of the table 310 relative to the bench 350 can be adjusted to accommodate a variety of different uses. For example, in instances when the picnic table 300 is to be used by small children, the first support member 360 can be adjusted to reduce the height of the table 310 relative to the bench 350. Similarly, in instances when the picnic table 300 is to be used on an uneven surface, such as a hillside, the height of the table 310 relative to the bench 350 on one side of the table can be set differently than on the other side of the table. In other embodiments, the support leg 342 and/or the connection member 364 include one or more visual indicia, such as a series of reference numerals, to indicate the position at which the first support member 360 (and therefore the bench 350) is coupled to the support leg 342.

Although various embodiments have been described as having particular features or combinations of components, other embodiments are possible having a combination of the various described features and components from other embodiments. For example, various different locking configurations can be used to lock the table assembly into an expanded configuration, such as a telescoping lock, a snap-lock, or other suitable locking mechanism. In another example, a table assembly can include a bench as described in one particular embodiment and a table as described in a different embodiment. Moreover, a table assembly according to an embodiment of the invention can include one or more detachable frame members, as shown and described with reference to FIGS. 40-43 and one or more pivotable frame members, as shown and described with reference to FIGS. 29 and 30.

Similarly, in some embodiments, a table assembly can include one or more frame members configured to move relative to another frame member as shown and described above with reference to FIGS. 3-7 and one or more frame members configured to move relative to another frame member as shown and described above with reference to FIG. 10.

What is claimed is:

1. An apparatus, comprising:

a table including a first table frame member, a second table frame member, a table support leg and a table top coupled to the first table frame member and the second table frame member; and a bench including a first bench support member, a second bench support member, and a bench seat coupled to the first bench support member and the second bench support member, the bench including a coupling member configured to couple the bench to the table support leg, the table and the bench collectively having a first configuration and a second configuration, the coupling member configured to slide along the table support leg of the table when the table and the bench are moved between the first configuration and the second configuration, an end portion of the second table frame member spaced apart from an end portion of the first table frame member by a first distance when the table and the bench are in the first configuration, the end portion of the second table frame member spaced apart from the end portion of the first table frame member by a second distance when the table and the bench are in the second configuration, the second distance less than the first distance, the first table frame member and the second table frame member collectively define a plane substantially parallel to the table top when the table and the bench are in the first configuration, the end portion of the first table frame member including a pivot coupling, an end portion of the table support leg coupled to the end portion of the first table frame member such that the first table frame member rotates relative to the table support leg about the pivot coupling when the table and the bench are collectively moved between the first configuration and the second configuration, an end portion of the second bench support member spaced apart from an end portion of the first bench support member by a third distance when the table and the bench are in the first configuration, the end portion of the second bench support member spaced apart from the end portion of the first bench support member by a fourth distance when the table and the bench are in the second configuration, the fourth distance less than the third distance.

2. The apparatus of claim 1, wherein:

the coupling member defines a lumen; and a portion of the table support leg of the table is disposed within the lumen when the table and the bench are moved between the first configuration and the second configuration.

3. The apparatus of claim 1, wherein the table support leg of the table includes a protrusion configured to limit movement of the coupling member along the table support leg.

4. The apparatus of claim 1, wherein:

the second distance is less than half the first distance; and the fourth distance is less than half the third distance.

5. The apparatus of claim 1, wherein the end portion of the second bench support member is in contact with the end portion of the first bench support member when the table and the bench are in the second configuration.

6. The apparatus of claim 1, wherein the table top is pliable.

7. The apparatus of claim 1, wherein the end portion of the first table frame member is a first end portion, a second end portion of the first table frame member configured to rotate relative to the first end portion when the table and the bench are collectively moved between the first configuration and the second configuration.

8. The apparatus of claim 1, wherein the first bench support member is not substantially parallel to the second bench support member when the table and the bench are in the first configuration, the first bench support member is substantially parallel to the second bench support member when the table and the bench are in the second configuration.

9. An apparatus, comprising:

a table including a frame having a first longitudinal side member, a second longitudinal side member, a lateral side member, and a table support leg, the first longitudinal side member movably coupled to the table support leg, the first longitudinal side member movably coupled to a first end portion of the lateral side member, the second longitudinal side member movably coupled to a second end portion of the lateral side member; and a bench including a first bench member, a second bench member and a bench seat coupled to the first bench member and the second bench member, the second bench member pivotably coupled to the first bench member, the bench including a coupling member configured to couple the bench to the table support leg, the table and the bench collectively having a first configuration and a second configuration, the coupling member of the bench configured to remain coupled to the table support leg when the table and the bench are moved between the first configuration and the second configuration, the first end portion of the lateral side member coupled to the second end portion of the lateral side member by a hinge member such that the first end portion of the lateral side member rotates relative to the second end portion of the lateral side member when the table and the bench are moved between the first configuration and the second configuration, the first longitudinal side member configured to rotate relative to the table support leg when the table and the bench are moved between the first configuration and the second configuration, an end portion of the first bench member being spaced apart from an end portion of the second bench member when the table and the bench are in the first configuration, the end portion of the first bench member being in contact with the end portion of the second bench member when the table and the bench are in the second configuration.

10. The apparatus of claim 9, wherein:

an end portion of the first longitudinal side member is spaced apart from an end portion of the second longitudinal side member by a first distance when the table and the bench are in the first configuration, the end portion of the first longitudinal side member is spaced apart from the end portion of the second longitudinal side member by a second distance when the table and the bench are in the second configuration, the second distance less than half the first distance.

11. The apparatus of claim 9, wherein the first end portion of the lateral side member is substantially coaxial with the second end portion of the lateral side member when the table and the bench are in the first configuration, the first end portion of the lateral side member is non-coaxial with the second end portion of the lateral side member when the table and the bench are in the second configuration.

12. The apparatus of claim 9, wherein a central portion of the first longitudinal side member is spaced apart from the table support leg when the table and the bench are in the first configuration, the central portion of the first longitudinal side member is in contact with the table support leg when the table and the bench are in the second configuration.

13. The apparatus of claim 9, wherein:

the end portion of the first bench member is a first end portion; and an end portion of the first longitudinal side member is spaced apart from a second end portion of the first bench member by a first distance when the table and the bench are in the first configuration, the end portion of the first longitudinal side member is spaced apart from the second end portion of the first bench member by a second distance when the table and the bench are in the second configuration, the second distance less than half the first distance.

14. The apparatus of claim 9, wherein:

the coupling member defines a lumen; and a portion of the table support leg of the table is configured to slide within the lumen when the table and the bench are moved between the first configuration and the second configuration.

15. An apparatus, comprising:

a table including a first table frame member, a second table frame member, a table support leg and a table top coupled to the first table frame member and the second table frame member, the table support leg including a protrusion; and a bench including a first bench support member, a second bench support member, and a bench seat coupled to the first bench support member and the second bench support member, the bench including a coupling member defining a lumen configured to receive a portion of the table support leg, the table and the bench collectively having a first configuration and a second configuration, the coupling member configured to slide along the portion of the table support leg when the table and the bench are moved between the first configuration and the second configuration, the protrusion configured contact the coupling member when the table and the bench are in the first configuration, an end portion of the first table frame member including a connector, an end portion of the table support leg coupled to the end portion of the first table frame member via the connector such that the first table frame member rotates relative to the table support leg when the table and the bench are moved between the first configuration and the second configuration, an end portion of the second bench support member spaced apart from an end portion of the first bench support member by a first distance when the table and the bench are in the first configuration, the end portion of the second bench support member spaced apart from the end portion of the first bench support member by a second distance when the table and the bench are in the second configuration, the second distance less than half the first distance.

16. The apparatus of claim 15, wherein the protrusion is configured to limit sliding movement of the coupling member along the table support leg when the table and the bench are in the first configuration.

17. The apparatus of claim 15, wherein the end portion of the second bench support member is in contact with the end portion of the first bench support member when the table and the bench are in the second configuration.

18. The apparatus of claim 15, wherein an end portion of the second table frame member is spaced apart from the end portion of the first table frame member by a third distance when the table and the bench are in the first configuration, the end portion of the second table frame member is spaced apart from the end portion of the first table frame member by a fourth distance when the table and the bench are in the second configuration, the fourth distance less than half the third distance.

19. The apparatus of claim 15, wherein:

the end portion of the first bench support member is a first end portion, the bench support member including a second end portion opposite the first end portion; and the end portion of the first table frame member is spaced apart from the second end portion of the first bench support member by a third distance when the table and the bench are in the first configuration, the end portion of the first table frame member is spaced apart from the second end portion of the first bench support member by a fourth distance when the table and the bench are in the second configuration, the fourth distance less than the third distance.

20. The apparatus of claim 1, wherein the table includes a third table frame member, a first end portion of the third table frame member pivotably coupled to a second end portion of the third table frame by a hinge member, the first end portion of the third table frame member movably coupled to the first table frame member, the second end portion of the third table frame member movably coupled to the second table frame member, the first end portion of the third table frame member configured to rotate relative to the second end portion of the third table frame member when the table and the bench are moved between the first configuration and the second configuration.

* * * * *